US012426664B2

(12) United States Patent
Galasso et al.

(10) Patent No.: US 12,426,664 B2
(45) Date of Patent: Sep. 30, 2025

(54) ARTICLES OF FOOTWEAR HAVING MODULAR, REPLACEABLE, AND/OR RECYCLABLE PARTS

(71) Applicant: NIKE, Inc., Beaverton, OR (US)

(72) Inventors: Michele Galasso, Portland, OR (US); Darryl Matthews, Portland, OR (US); William Moroski, Portland, OR (US); Danielle L Taylor, Portland, OR (US); Yukiko Toyoda, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 279 days.

(21) Appl. No.: 18/184,176

(22) Filed: Mar. 15, 2023

(65) Prior Publication Data

US 2023/0292877 A1 Sep. 21, 2023

Related U.S. Application Data

(60) Provisional application No. 63/320,125, filed on Mar. 15, 2022.

(51) Int. Cl.

| | |
|---|---|
| ***A43B 3/24*** | (2006.01) |
| ***A43B 3/00*** | (2022.01) |
| ***A43B 13/36*** | (2006.01) |

(52) U.S. Cl.

CPC ..... *A43B 3/244* (2013.01); *A43B 3/0047* (2013.01); *A43B 13/36* (2013.01)

(58) Field of Classification Search

CPC ..... A43B 3/244; A43B 3/0047; A43B 3/246; A43B 3/24; A43B 13/36; A43B 13/26

(Continued)

(56) References Cited

U.S. PATENT DOCUMENTS 997,657 A * 7/1911 Drake ..... A43B 13/125 36/129
5,799,417 A * 9/1998 Burke ..... A43B 3/0047 36/105

(Continued)

FOREIGN PATENT DOCUMENTS

WO 2018191142 A1 10/2018

OTHER PUBLICATIONS

Jun. 5, 2023 (WO) International Search Report and Written Opinion—App PCT/US/2023/064412, 9 pages.

*Primary Examiner* — Jameson D Collier
(74) *Attorney, Agent, or Firm* — Banner & Witcoff, Ltd.

(57) ABSTRACT

Footwear includes upper, midsole, and exterior sole components. One side of the upper component includes a first plurality of openings. This first plurality of openings includes two openings separated by a strip of upper component material. The midsole component is received in the upper component and includes a plurality of protrusions extending through the openings of the upper component. The strip of upper component material covers a first portion of the midsole component located in a recess between the first and second protrusions. The exterior sole component is engaged with the midsole component and includes a second plurality of openings. The plurality of protrusions extend through corresponding openings of this second plurality of openings. A strip of exterior sole component material located between two of the second plurality of openings at least partially covers the strip of upper component material.

20 Claims, 33 Drawing Sheets

(58) Field of Classification Search
USPC ..... 36/15, 101
See application file for complete search history.

(56) References Cited

U.S. PATENT DOCUMENTS

| | | | | |
|---|---|---|---|---|
| 6,023,859 | A * | 2/2000 | Burke | A43B 13/36 36/105 |
| 7,010,872 | B2 * | 3/2006 | Pawlus | A43B 3/10 36/15 |
| 7,140,129 | B2 | 11/2006 | Newson et al. | |
| 9,408,434 | B2 * | 8/2016 | Su | A43B 7/087 |
| 9,414,641 | B2 | 8/2016 | Ellis | |
| 9,955,748 | B2 | 5/2018 | Grove et al. | |
| 2004/0148803 | A1 | 8/2004 | Grove et al. | |
| 2005/0188562 | A1 | 9/2005 | Clarke et al. | |
| 2005/0268491 | A1 | 12/2005 | McDonald et al. | |
| 2008/0168681 | A1 | 7/2008 | Andersen et al. | |
| 2009/0126230 | A1 * | 5/2009 | McDonald | A43B 13/12 36/103 |
| 2009/0183392 | A1 * | 7/2009 | Shane | A43B 3/244 12/114.2 |
| 2016/0262494 | A1 * | 9/2016 | Weidl | A43B 23/042 |
| 2016/0324264 | A1 * | 11/2016 | Johnson | A43B 3/244 |
| 2020/0275739 | A1 * | 9/2020 | Linkfield | A43B 13/188 |
| 2022/0361632 | A1 | 11/2022 | Maselino | |
| 2023/0292883 | A1 * | 9/2023 | Aceves Tinajero | A43B 3/246 36/45 |

* cited by examiner

ARTICLES OF FOOTWEAR HAVING MODULAR, REPLACEABLE, AND/OR RECYCLABLE PARTS

RELATED APPLICATION DATA

This application is a U.S. Non-Provisional Application based on and claiming priority to U.S. Provisional Patent Appln. No. 63/320,125 filed Mar. 15, 2022 and entitled "Articles of Footwear Having Modular, Replaceable, and/or Recyclable Parts." U.S. Provisional Patent Appln. No. 63/320,125 is entirely incorporated herein by reference.

FIELD OF THE INVENTION

Aspects of the present invention relate to articles of footwear that include removable, replaceable, and/or recyclable components. Aspects of this invention may relate to and/or may be used with the technology described in concurrently filed U.S. Provisional Patent Appln. No. 63/320,078, entitled "Sustainable Footwear Article," which application is entirely incorporated herein by reference.

BACKGROUND

Conventional articles of athletic footwear include two primary elements, an upper and a sole structure. The upper may provide a covering for the foot that securely receives and positions the foot with respect to the sole structure. In addition, the upper may have a configuration that protects the foot and provides ventilation, thereby cooling the foot and removing perspiration. The sole structure may be secured to a lower surface of the upper and generally is positioned between the foot and any contact surface. In addition to attenuating ground reaction forces and absorbing energy, the sole structure may provide traction and control potentially harmful foot motion, such as over pronation.

The upper forms a void on the interior of the footwear for receiving the foot. The void has the general shape of the foot, and access to the void is provided at an ankle opening. Accordingly, the upper extends over the instep and toe areas of the foot, along the medial and lateral sides of the foot, and around the heel area of the foot. A lacing system often is incorporated into the upper to allow users to selectively change the size of the ankle opening and to permit the user to modify certain dimensions of the upper, particularly girth, to accommodate feet with varying proportions. In addition, the upper may include a tongue that extends under the lacing system to enhance the comfort of the footwear (e.g., to moderate pressure applied to the foot by the laces), and the upper also may include a heel counter to limit or control movement of the heel.

SUMMARY

This Summary is provided to introduce some general concepts relating to this technology in a simplified form that are further described below in the Detailed Description. This Summary is not intended to identify key features or essential features of the invention.

Aspects of this technology relate to articles of footwear that may include removable and/or potentially interchangeable components. As some more specific examples, articles of footwear may include exterior sole components that are removably engaged with midsole components (e.g., fluid-filled bladder components, foam midsole components, etc.) and/or sole components (e.g., midsole components, exterior sole components, etc.) that are removably engaged with footwear upper components. The removable and modular construction may allow users to interchange parts, e.g., for personalization and/or customization, to enable color and color combination changes, to optimize component parts for specific end uses or sports, etc. In at least some aspects of this technology, the footwear component parts may be assembled in an adhesive-free manner. One or more of the footwear components (e.g., an upper component, a midsole component, an exterior sole component, etc.) may be formed a single material, may be formed as a unitary, one-piece construction, may be formed from recycled materials, and/or may themselves be recyclable.

While aspects of this technology are described in terms of footwear upper components and footwear sole components, additional aspects of this technology relate to methods of making such articles of footwear (e.g., footwear upper components, footwear sole components, etc.), including methods of assembling and disassembling such articles of footwear.

BRIEF DESCRIPTION OF THE DRAWINGS

The following Detailed Description will be better understood when considered in conjunction with the accompanying drawings in which like reference numerals refer to the same or similar elements in all of the various views in which that reference number appears.

DETAILED DESCRIPTION

Figure 1A:
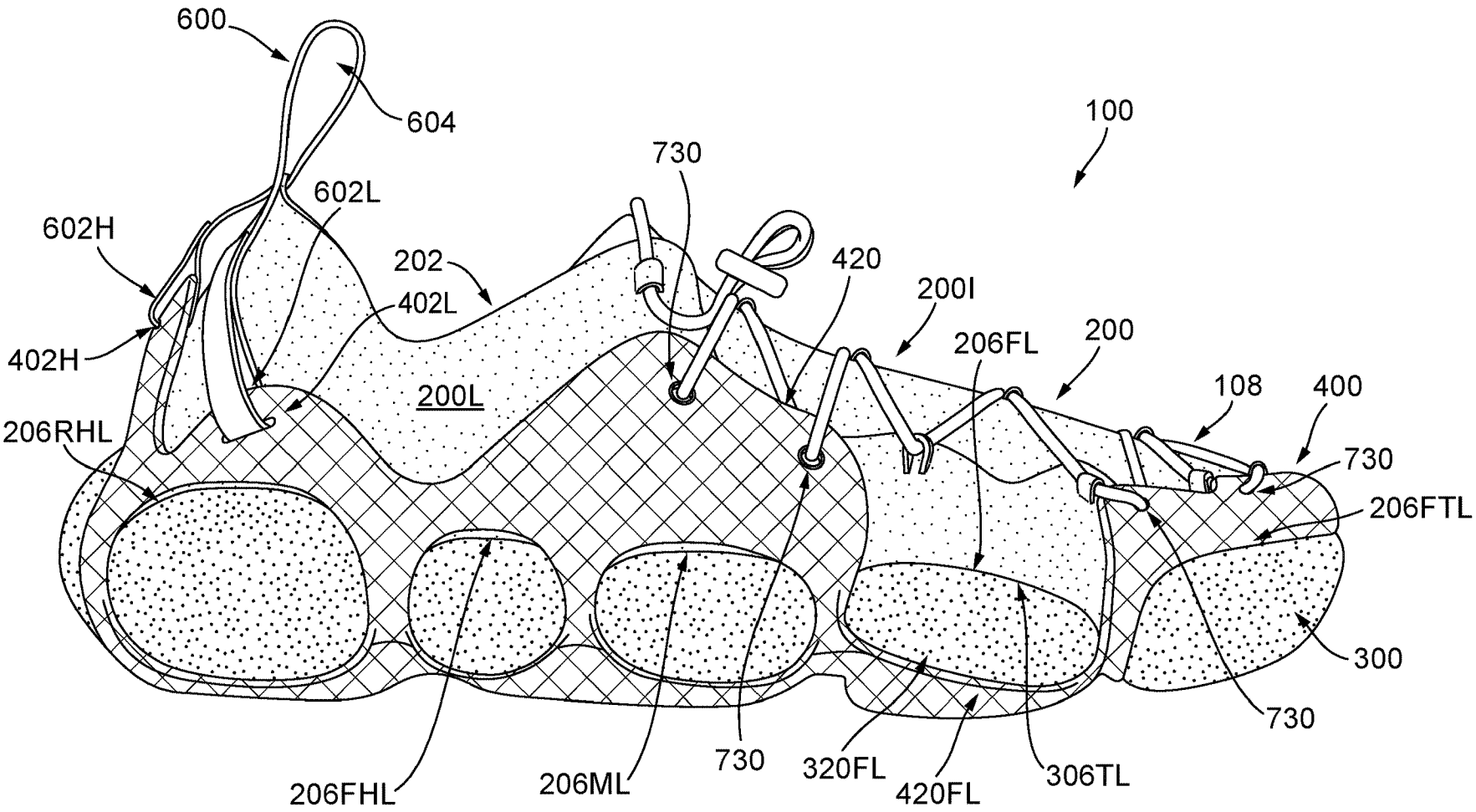
FIGS. 1A and 1B provide assembled and exploded views, respectively, of articles of footwear in accordance with some aspects of this technology.

In the following description of various examples of footwear structures and components according to the present technology, reference is made to the accompanying drawings, which form a part hereof, and in which are shown by way of illustration various example structures and environments in which aspects of this technology may be practiced. It is to be understood that other structures and environments may be utilized and that structural and functional modifications may be made to the specifically described structures, functions, and methods without departing from the scope of the present disclosure.

"Footwear," as that term is used herein, means any type of wearing apparel for the feet, and this term includes, but is not limited to: all types of shoes, boots, sneakers, sandals, thongs, flip-flops, mules, scuffs, slippers, sport-specific shoes (such as golf shoes, tennis shoes, baseball cleats, soccer or football cleats, ski boots, basketball shoes, cross training shoes, dance shoes, etc.), and the like.

The terms "removably engaged" or "removably attached" as used herein (unless otherwise noted or clear from the context) mean that the two "engaged" or "attached" objects are designed to be repeatedly "engaged/disengaged" and/or "attached/unattached" to one another without damaging either object or structures with which those objects are engaged. In other words, the terms "removably engaged" and/or "removably attached" mean that the two "engaged" or "attached" objects are "non-destructibly removable" and/or releasable from one another.

This application and/or its claims use the terms, e.g., "first," "second," "third," and the like, to identify certain components and/or features relating to this technology. These terms are used merely for convenience, e.g., to assist in maintaining a distinction between components and/or features of a specific structure. Use of these terms should not be construed as requiring a specific order or arrangement of the components and/or features being discussed. Also, use of these specific terms in the specification for a specific structure does not require that the same term be used in the claims to refer to the same part (e.g., a component or feature referred to as the "fourth" in the specification may correspond to any numerical term used for that component or feature in the claims).

Various structures and parameters of articles of footwear and components thereof are described based on a "longitudinal length" parameter L. See FIGS. 7H and 7I. The longitudinal length L can be found with the article of footwear and/or sole structure oriented on a horizontal support surface S on its ground-facing surface in an unloaded condition (e.g., with no weight applied to it other than weight of other components of the article of footwear and/or sole structure). Once so oriented, parallel vertical planes VP that are perpendicular to the horizontal support surface S are oriented to contact the rearmost heel (RH) location(s) and forwardmost toe (FT) location(s) of the article of footwear and/or sole structure. The parallel vertical planes VP should be oriented facing one another, and as far away from one another as possible while still in contact with the rearmost heel RH and forwardmost toe FT locations. The direct distance between these vertical planes VPs corresponds to the length (e.g., a longitudinal length) L of the article of footwear and/or sole structure. The locations of some footwear components are described in this specification based on their respective locations along the longitudinal length L as measured forward from the rear heel vertical plane VP. Thus, the rearmost heel location(s) is (are) located at position 0L and the forwardmost toe location(s) is (are) located at position 1L along the longitudinal length L. Intermediate locations along the longitudinal length L are referred to by fractional locations (e.g., 0.25L) along the longitudinal length L measured forward from the rear heel vertical plane VP. The term "parallel planes" as used herein are planes oriented parallel to the vertical planes VP. These parallel planes may intersect the longitudinal length or longitudinal direction somewhere between P=0L and P=1.0L.

The term "rearward" as used herein means at or toward the heel region of the article of footwear (or component thereof), and the term "forward" as used herein means at or toward a forefoot or forward toe region of the article of footwear (or component thereof). Also, the term "lateral" means the "little toe" side of an article of footwear or component thereof (e.g., an upper, a sole structure, etc.), and the term "medial" means the "big toe" side of an article of footwear or component thereof (e.g., an upper, a sole structure, etc.). The directional terms "upper," "lower," "top," and/or "bottom" and the like, as used herein, unless otherwise noted or clear from the context, refer to a direction or position with the article of footwear and/or other component oriented with its ground-facing surface supported on or facing a horizontal contact surface (e.g., level ground). The term "upper" also is used herein as a noun to refer to a footwear component structure (as conventionally used in the footwear art).

I. General Description of Aspects of this Technology

As noted above, articles of footwear in accordance with some aspects of this technology include removable (and potentially interchangeable) components (e.g., exterior sole components that are removably engaged with midsole components and/or sole components that are removably engaged with footwear upper components). The removable and modular construction may allow users to interchange parts, e.g., for personalization and/or customization, to enable color and color combination changes, to optimize component parts for specific end uses or sports, to prolong the useful life of one or more footwear component parts, etc. In at least some aspects of this technology, at least some or even all of the footwear component parts may be assembled in an adhesive-free manner. One or more of the footwear components (e.g., an upper component, a midsole component, an exterior sole component, etc.) may be formed from a single material, may be formed as a unitary, one-piece construction, may be formed from recycled materials, and/or may themselves be recyclable.

Some aspects of this technology relate to articles of footwear that include: (a) an upper component (formed from one or more component parts) including a first side defining a first plurality of openings extending through a material of the upper component, the first plurality of openings including: (i) a first opening and (ii) a second opening separated from the first opening by a first strip of upper component material, wherein the upper component at least partially defines an interior chamber configured to receive a wearer's foot; and (b) a midsole component (formed from one or more component parts) received in the interior chamber of the upper component, the midsole component having a plurality of protrusions including (i) a first protrusion extending through the first opening and (ii) a second protrusion extending through the second opening, wherein the first strip of upper component material covers a first portion of the midsole component located in a first recess between the first protrusion and the second protrusion. Such articles of footwear further may include an exterior sole component (formed from one or more component parts) engaged with the midsole component. The exterior sole component may include a second plurality of openings extending through a material of the exterior sole component, the second plurality of openings including: (i) a third opening, wherein the first protrusion extends through the third opening and (ii) a fourth opening separated from the third opening by a first strip of exterior sole component material, wherein the second protrusion extends through the fourth opening and the first strip of exterior sole component material at least partially covers the first strip of upper component material. In some examples of this technology: (a) the opposite side of the upper component may include additional openings, e.g., as part of the first plurality of openings, including: (i) a fifth opening and (ii) a sixth opening separated from the fifth opening by a second strip of upper component material; (b) the opposite side of the midsole component may include additional protrusions, e.g., as part of the plurality of protrusions, including: (i) a third protrusion extending through the fifth opening and (ii) a fourth protrusion extending through the sixth opening, wherein the second strip of upper component material covers a second portion of the midsole component located in a second recess between the third protrusion and the fourth protrusion; and (c) the opposite side of the exterior sole component (when present) may include additional openings, e.g., as part of the second plurality of openings, including: (i) a seventh opening, wherein the third protrusion extends through the seventh opening and (ii) an eighth opening separated from the seventh opening by a second strip of exterior sole component material, wherein the fourth protrusion extends through the eighth opening and the second strip of exterior sole component material at least partially covers the second strip of upper component material.

Other examples of this technology relate to articles of footwear that include: (a) an upper component (formed of one or more component parts) including a first side defining a first plurality of openings extending through a material of the upper component, the first plurality of openings including: (i) a first opening, (ii) a second opening separated from the first opening by a first strip of upper component material, and (iii) a third opening separated from the second opening by a second strip of upper component material, wherein the upper component at least partially defines an interior chamber configured to receive a wearer's foot; and (b) a midsole component (formed of one or more component parts) received in the interior chamber of the upper component, the midsole component having a plurality of protrusions including: (i) a first protrusion extending through the first opening, (ii) a second protrusion extending through the second opening, and (iii) a third protrusion extending through the third opening, wherein the first strip of upper component material covers a first portion of the midsole component located in a first recess between the first protrusion and the second protrusion, and wherein the second strip of upper component material covers a second portion of the midsole component located in a second recess between the second protrusion and the third protrusion. Such articles of footwear further may include an exterior sole component (formed from one or more component parts) engaged with the midsole component. This exterior sole component may include a second plurality of openings extending through a material of the exterior sole component, the second plurality of openings including: (i) a fourth opening, wherein the first protrusion extends through the fourth opening, (ii) a fifth opening separated from the fourth opening by a first strip of exterior sole component material, wherein the second protrusion extends through the fifth opening and the first strip of exterior sole component material at least partially covers the first strip of upper component material, and (iii) a sixth opening separated from the fifth opening by a second strip of exterior sole component material, wherein the third protrusion extends through the sixth opening and the second strip of exterior sole component material at least partially covers the second strip of upper component material. The opposite side of the article of footwear may include similar openings, protrusions, and engagement of parts. More specifically: the opposite side of the upper component may include additional openings, e.g., as part of the first plurality of openings, including: (i) a seventh opening, (ii) an eighth opening separated from the seventh opening by a third strip of upper component material, and (iii) a ninth opening separated from the eighth opening by a fourth strip of upper component material. Additionally, the opposite side of the midsole component may include additional protrusions, e.g., as part of the plurality of protrusions, including: (i) a fourth protrusion extending through the seventh opening, (ii) a fifth protrusion extending through the eighth opening, and (iii) a sixth protrusion extending through the ninth opening, wherein the third strip of upper component material covers a third portion of the midsole component located in a third recess between the fourth protrusion and the fifth protrusion, and wherein the fourth strip of upper component material covers a fourth portion of the midsole component located in a fourth recess between the fifth protrusion and the sixth protrusion. Also, when present, the opposite side of the exterior sole component may include additional openings, e.g., as part of the second plurality of openings, including: (i) a tenth opening, wherein the fourth protrusion extends through the tenth opening, (ii) an eleventh opening separated from the tenth opening by a third strip of exterior sole component material, wherein the fifth protrusion extends through the eleventh opening and the third strip of exterior sole component material at least partially covers the third strip of upper component material, and (iii) a twelfth opening separated from the eleventh opening by a fourth strip of exterior sole component material, wherein the sixth protrusion extends through the twelfth opening and the fourth strip of exterior sole component material at least partially covers the fourth strip of upper component material.

Still other aspects of this technology relate to articles of footwear that include: (a) an upper component (formed from one or more component parts) having a first side defining a first plurality of openings extending through a material of the upper component, the first plurality of openings including a first opening and a second opening separated from the first opening by a first strip of upper component material, wherein the upper component at least partially defines an interior chamber configured to receive a wearer's foot; (b) a midsole component (formed from one or more component parts) received in the interior chamber of the upper component, the midsole component having a plurality of protrusions including a first protrusion extending through the first opening and a second protrusion extending through the second opening, wherein the first strip of upper component material covers a first portion of the midsole component located in a first recess between the first protrusion and the second protrusion, and wherein a first portion of the upper component extends along and/or across and contacts a ground-facing surface of the midsole component; and (c) an exterior sole component (formed from one or more component parts) engaged with the midsole component, the exterior sole component including a second plurality of openings extending through a material of the exterior sole component, the second plurality of openings including: (i) a third opening, wherein the first protrusion extends through the third opening and (ii) a fourth opening separated from the third opening by a first strip of exterior sole component material, wherein the second protrusion extends through the fourth opening and the first strip of exterior sole component material at least partially covers the first strip of upper component material. In this example of this technology, a bottom surface of the exterior sole component covers the first portion of the upper component extending along and/or across the ground-facing surface of the midsole component. The bottom surface of the exterior sole component may extend continuously to cover bottom surfaces of plural midsole protrusions and/or extend continuously to form at least 50% of the ground-contacting surface of the article of footwear (and in some examples at least 60%, at least 70%, at least 80%, at least 90%, or even at least 95% of the ground-contacting surface of the article of footwear).

Still other aspects of this technology relate to articles of footwear including: (a) an upper component (formed from one or more component parts) having a lateral side, a medial side, and a connecting structure extending from the lateral side to the medial side and forming a bottom surface of the upper component; and (b) a midsole component including: (i) a first layer having a first outer surface and a first inner surface and (ii) a second layer having a second outer surface and a second inner surface. The first layer and the second layer form a sealed interior chamber containing a gas (e.g., sealed around a perimeter edge). This example midsole component includes one or more interior bonds where the first inner surface is fixed to the second inner surface (e.g., by welding techniques), and the interior bond(s) is (are) spaced inward from an outer perimeter edge that defines the sealed interior chamber. One or more connector components extend through: (i) the upper component (e.g., through the connecting structure of the upper component), and (ii) the midsole component at a respective one of the interior bond(s). The connector component(s) may extend from the first outer surface to the second outer surface to thereby connect the upper component with the midsole component.

Yet other aspects of this technology relate to articles of footwear that include: (a) an upper component (formed from one or more component parts) including an instep region; (b) a midsole component (formed from one or more component parts) having a plurality of protrusions including: (i) a first protrusion, (ii) a second protrusion separated from the first protrusion by a first recess, and (iii) a third protrusion separated from the second protrusion by a second recess; and (c) an exterior sole component (formed from one or more component parts) engaged with the midsole component. The exterior sole component of this aspect of the present technology includes: (i) a first hole through which the first protrusion extends, (ii) a second hole through which the third protrusion extends, and (iii) a first continuous sole portion extending through the first recess, beneath the second protrusion, and through the second recess. Thus, the exterior sole component of this example does not extend between the second protrusion and the instep region of the upper component. Rather, it extends continuously from the first protrusion to the third protrusion around the bottom of the second protrusion. The opposite side of such articles of footwear may include similar structures. More specifically, the opposite side of the midsole component of such articles of footwear may include additional protrusions, e.g., as part of the plurality of protrusions, including: (i) a fourth protrusion, (ii) a fifth protrusion separated from the fourth protrusion by a third recess, and (iii) a sixth protrusion separated from the fifth protrusion by a fourth recess. In such structures, the exterior sole component further may include: (i) a third hole through which the fourth protrusion extends, (ii) a fourth hole through which the sixth protrusion extends, and (iii) a second continuous sole portion extending through the third recess, beneath the fifth protrusion, and through the fourth recess. In such structures, the exterior sole component does not extend between the fifth protrusion and the instep region of the upper component. Rather, it extends continuously from the fourth protrusion to the sixth protrusion around the bottom of the fifth protrusion.

Still other aspects of this technology relate to articles of footwear that include: (a) an upper component (formed from one or more component parts) including an instep region; (b) a midsole component (formed from one or more component parts) having a plurality of protrusions including: (i) a first protrusion and (ii) a second protrusion separated from the first protrusion by a first recess; and (c) an exterior sole component (formed from one or more component parts) engaged with the midsole component. The exterior sole component according to this aspect of the present technology includes a first continuous perimeter edge that includes: (i) a first top edge portion located above the first protrusion and along the instep region of the upper component, (ii) a first intermediate portion extending through the first recess, along a bottom surface of the second protrusion, and upward forward of a forward edge of the second protrusion, and (iii) a second top edge portion extending toward and/or to a forward toe region of the upper component. Either or both of the first top edge portion and/or the second top edge portion may include one or more lace-engaging components. The opposite side of such articles of footwear may include similar structures. More specifically, the opposite side of the midsole component of such articles of footwear may include additional protrusions, e.g., as part of the plurality of protrusions, including: (i) a third protrusion and (ii) a fourth protrusion separated from the third protrusion by a second recess. In such structures, the exterior sole component further may include a second continuous perimeter edge having: (i) a third top edge portion located above the third protrusion and along the instep region of the upper component, (ii) a second intermediate portion extending through the second recess, along a bottom surface of the fourth protrusion, and upward forward of a forward edge of the fourth protrusion, and (iii) a fourth top edge portion extending toward and/or to the forward toe region of the upper component. Either or both of the third top edge portion and/or the fourth top edge portion may include one or more lace-engaging components. The second top edge portion and fourth top edge portion may meet and form a continuous top edge at the forward toe region of the upper component.

At least some aspects of this technology (and/or any of the above aspects and examples of this technology) may include further components and/or features. For example, in any of the aspects and examples described above, an insole component may be provided on (e.g., releasably engaged with) an upper surface of the midsole component. Such insole components may include one or more projections that extend into one or more midsole recesses defined in the upper surface of the midsole component. Additionally or alternatively, any of the examples and aspects of this technology described above may include a gas-filled midsole component formed from two layers (e.g., of thermoplastic elastomer material) in which the midsole component is engaged with the upper component by one or more connectors, e.g., of the types described above. Also, in any of the examples and aspects of this technology described above, the exterior sole component may cover at least 75%, and in some examples, at least 80%, at least 85%, at least 90%, at least 95%, or even 100% of a surface area of a bottom surface of the upper component (e.g., the portions of the upper component located at or in contact with the ground-facing surface of the midsole component).

At least some aspects of this technology (and any of the above aspects and examples of this technology) may include: (i) an upper component having a first rear heel opening (e.g., a first center rear heel opening), (ii) a midsole component having a rear heel protrusion (e.g., a center rear heel protrusion) that extends through the first rear heel opening, and (iii) an exterior sole component having a second rear heel opening (e.g., a second center rear heel opening), wherein the rear heel protrusion extends through the second rear heel opening. Alternatively, the exterior sole component could form a closed rear end that covers the upper component and midsole component at the rear heel area. Additionally or alternatively, any of the above aspects and examples of this technology may include: (i) an upper component having a first lateral side forward toe opening and a first medial side forward toe opening separated from the first lateral side forward toe opening by a first center forward toe band; (ii) a midsole component having a lateral side forward toe projection extending through the first lateral side forward toe opening and a medial side forward toe projection extending through first medial side forward toe opening; and (iii) an exterior sole component having a second lateral side forward toe opening and a second medial side forward toe opening separated from the second lateral side forward toe opening by a second center forward toe band. In such structures, the lateral side forward toe projection extends through the second lateral side forward toe opening, the medial side forward toe projection extends through the second medial side forward toe opening, and the second center forward toe band at least partially covers the first center forward toe band.

At least some aspects of this technology (and any of the examples and aspects of this technology described above) may include a midsole component having a lateral forefoot protrusion and/or a medial forefoot protrusion, but the exterior sole component may not completely extend around an outer perimeter of this lateral forefoot protrusion and/or this medial forefoot protrusion. In such structures, a top edge of the exterior sole component may extend along a bottom perimeter edge of the lateral forefoot protrusion and/or along a bottom perimeter edge of the medial forefoot protrusion. In some more specific examples of this technology, this lateral forefoot protrusion may be located at a fifth metatarsal head area of the upper component and/or this medial forefoot protrusion may be located at a first metatarsal head area of the upper component. The fact that the exterior sole component does not completely surround either or both of these forefoot protrusions can improve the flexibility and natural motion of the footwear structure.

Any one or more of the examples and aspects of this technology described above further may include any one or more of the following properties: (a) the article of footwear may be assembled in an adhesive-free manner; (b) some or all of the component parts of the article of footwear (e.g., at least the upper component, the midsole component, the exterior sole component, and/or the insole component (when present)), may be non-destructively removable from one another; (c) the upper component may be formed from a single material and/or as a unitary, one-piece construction; (d) the midsole component may be formed from a single material and/or as a unitary, one-piece construction; (e) the exterior sole component may be formed from a single material and/or as a unitary, one-piece construction; (f) the exterior sole component may be releasably engaged with the midsole component and/or the upper component; and/or (g) the midsole component may be releasably engaged with the upper component.

Still other aspects of this technology relate to methods of assembling articles of footwear of the various types described above as well as to methods of using sole structures and/or articles of footwear of the types described above (e.g., by attaching and detaching the footwear components from one another, by interchanging different component parts, by recycling one or more component parts, etc.). For example, the upper component may be formed from parts (e.g., a set of yarns) recycled or derived from a no-longer existing upper component (e.g., a previously used knitted upper component), the midsole component may comprise a material (e.g., a TPU, an EVA, etc.) recycled or derived from a no-longer existing midsole component (e.g., from a previously used footwear midsole), and/or the exterior sole component may comprise a material (e.g., a TPU, a rubber, etc.) recycled or derived from a no-longer existing exterior sole component (e.g., from a previously used footwear sole component).

Given the general description of features, examples, aspects, structures, processes, and arrangements according to certain aspects and examples of this technology provided above, a more detailed description of specific example sole structures, articles of footwear, and/or methods in accordance with this technology follows.

Figure 1B:
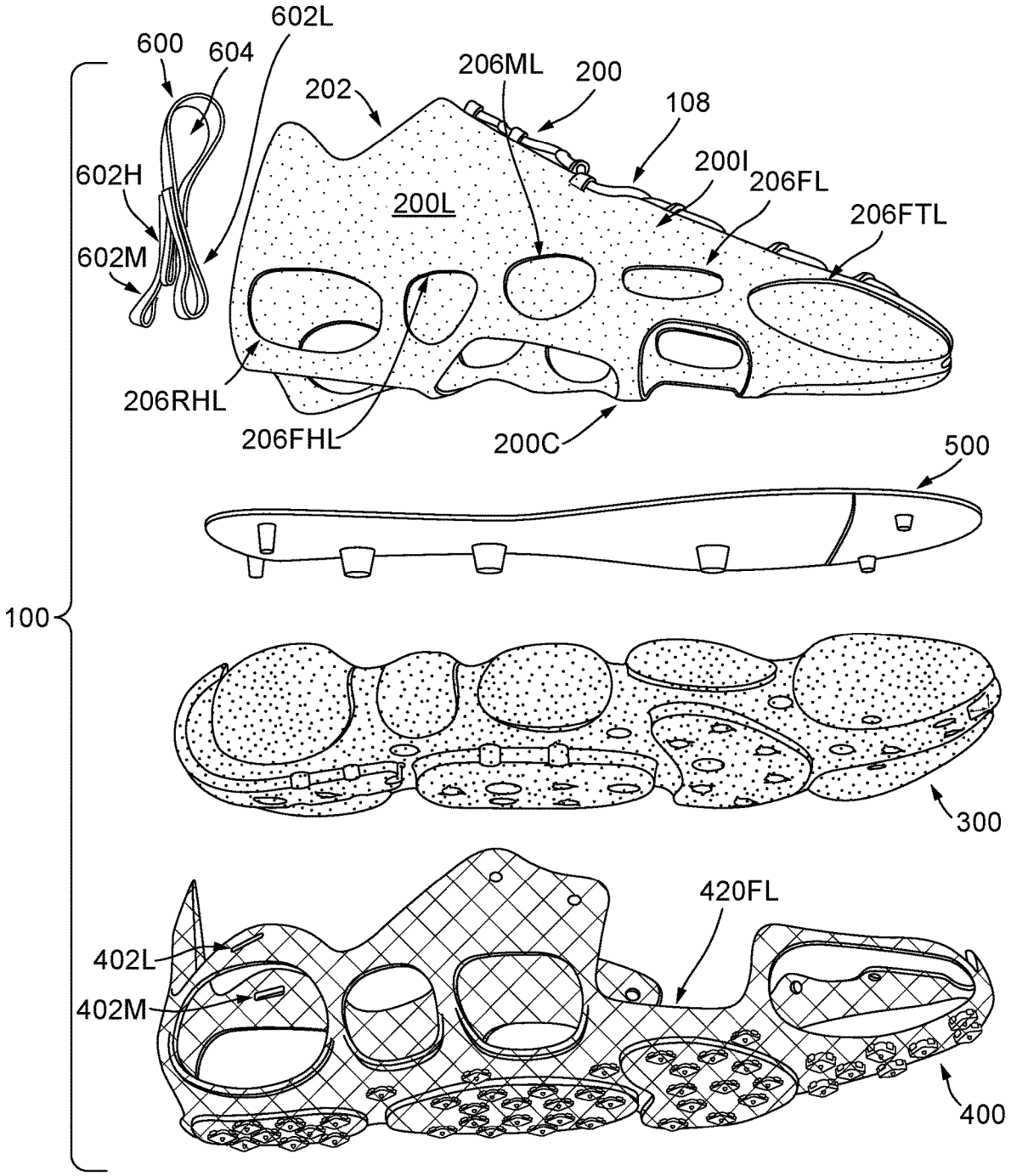
Figure 3:
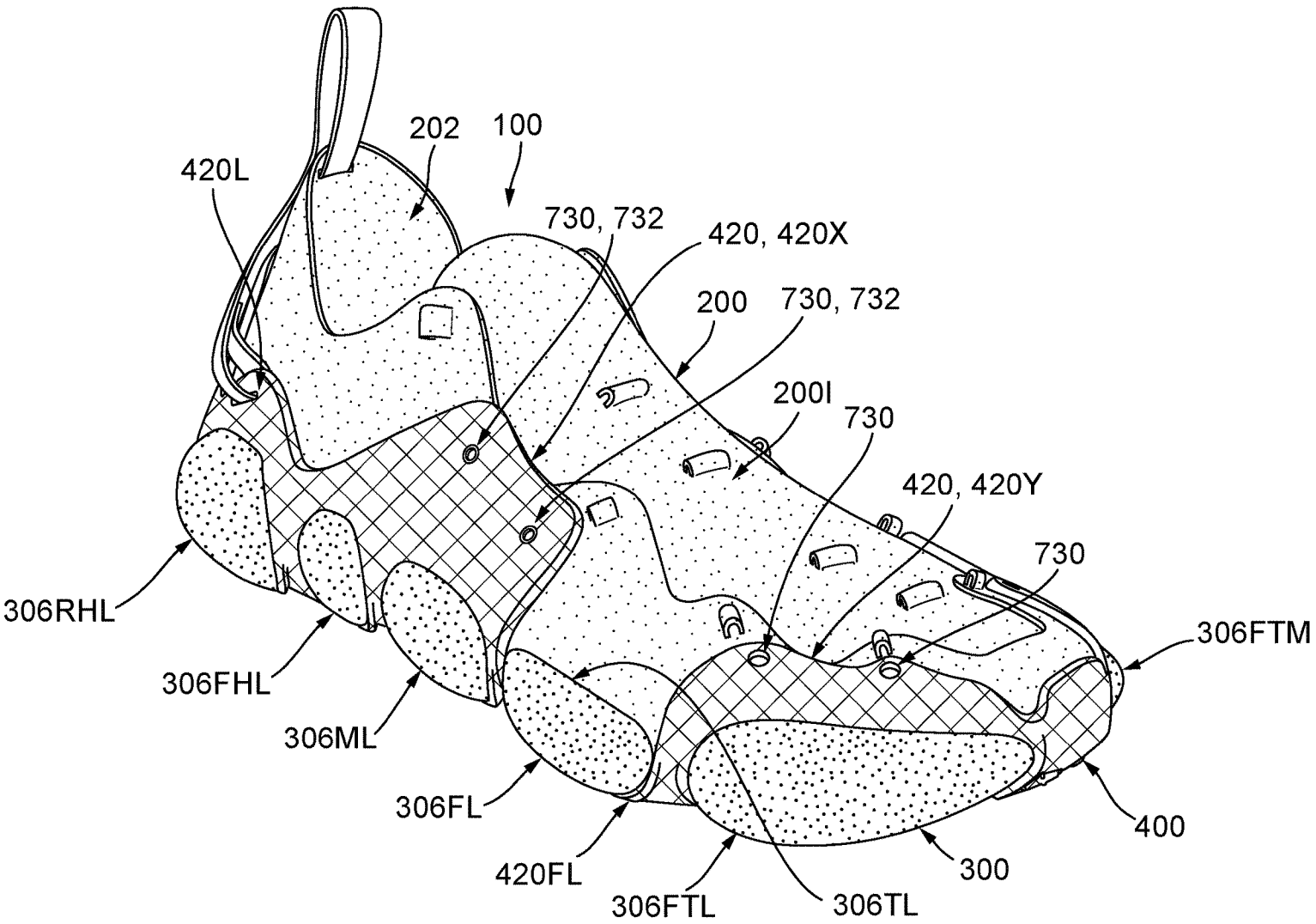
FIG. 3 provides a front, top, lateral perspective view of an article of footwear in accordance with some aspects of this technology.

II. Detailed Description of Example Articles of Footwear and Components/Features Thereof According to Aspects of this Technology Referring to the figures and following discussion, examples of footwear upper components, foot support components, sole structures, and articles of footwear in accordance with aspects of this technology are described. FIGS. 1A, 1B, and 3 provide assembled, exploded, and perspective views, respectively, of articles of footwear 100 in accordance with some aspects and examples of this technology. As shown in these figures, this example article of footwear 100 includes three main components, namely: an upper component 200 (formed from one or more component parts); a midsole component 300 (formed from one or more component parts); and (c) an exterior sole component 400 (formed from one or more component parts). In at least some examples of this technology, one or more of the upper component 200, the midsole component 300, and/or the exterior sole component 400 will be formed from a single material and/or as a unitary, one-piece construction. Additionally or alternatively, in at least some examples of this technology, the entire article of footwear 100 may be assembled in an adhesive-free manner. Further, in at least some examples, the individual upper component 200, midsole component 300, and/or exterior sole component 400 may be made without using adhesives and in an adhesive-free manner. Additionally or alternatively, in at least some examples of this technology (and as will be described in more detail below), the components 200, 300, and 400 (as well as the other components described herein) may be releasably engaged together and/or non-destructibly removable and/or releasable from one another (e.g., the exterior sole component 400 may be releasably engaged with and/or non-destructibly removable from the midsole component 300; the midsole component 300 may be releasably engaged with and/or non-destructibly removable from the upper component 200; the exterior sole component 400 may be releasably engaged with and/or non-destructibly removable from the upper component 200; etc.). These features, when present, improve the environmentally "friendliness" of the article of footwear 100 and/or enhance recyclability of the individual component parts 200, 300, 400.

FIGS. 1A and 1B illustrate additional components that may be included in articles of footwear 100 in accordance with at least some examples of this technology. For example, an interior sockliner 500 (also called an "insole component" herein) is shown in FIG. 1B, e.g., releasably engagable with a top surface 300S of the midsole component 300 and located within an interior chamber 202 defined at least in part by the upper component 200. Additionally, a pull tab 600 is shown at the rear heel area engaged at least with the exterior sole component 400 (e.g., with loops 602L, 602H, 602M of the pull tab 600 extending through openings 402M, 402H, and 402L defined in the heel area of the exterior sole component 400). This example pull tab 600 further includes a main loop 604 for the wearer to use when pulling the article of footwear 100 onto his/her foot. Each of the loops 602L, 602H, 602M, 604 may be releasably formed, e.g., using hook-and-loop fastener connectors or other connectors (as will described in more detail below in conjunction with FIGS. 8A-8C), to allow easy attachment and removal. Alternatively, if desired, one or more of the loops 602L, 602H, 602M, 604 may be fixed by a sewn seam or in another manner. This example article of footwear 100 further includes a shoelace 108 for securing the footwear to a wearer's foot (although other types of securing systems may be used, such as straps, etc.).

In some examples of this technology, an article of footwear 100 will consist only of (or consist essentially of) (a) the upper component 200 (including laces 108 or any other securing system for securing the article of footwear 100 to a wearer's foot), (b) the midsole component 300, and (c) the exterior sole component 400. In other examples of this technology, an article of footwear 100 will consist only of (or consist essentially of) (a) the upper component 200 (including laces 108 or any other securing system for securing the article of footwear 100 to a wearer's foot), (b) the midsole component 300, (c) the exterior sole component 400, and (d) the sockliner component 500. Additionally, however, a pull tab 600 (e.g., of the types described above) also may be included with either or both of these footwear structures. The individual footwear components and their assembly will be described in more detail below.

Figure 2B:
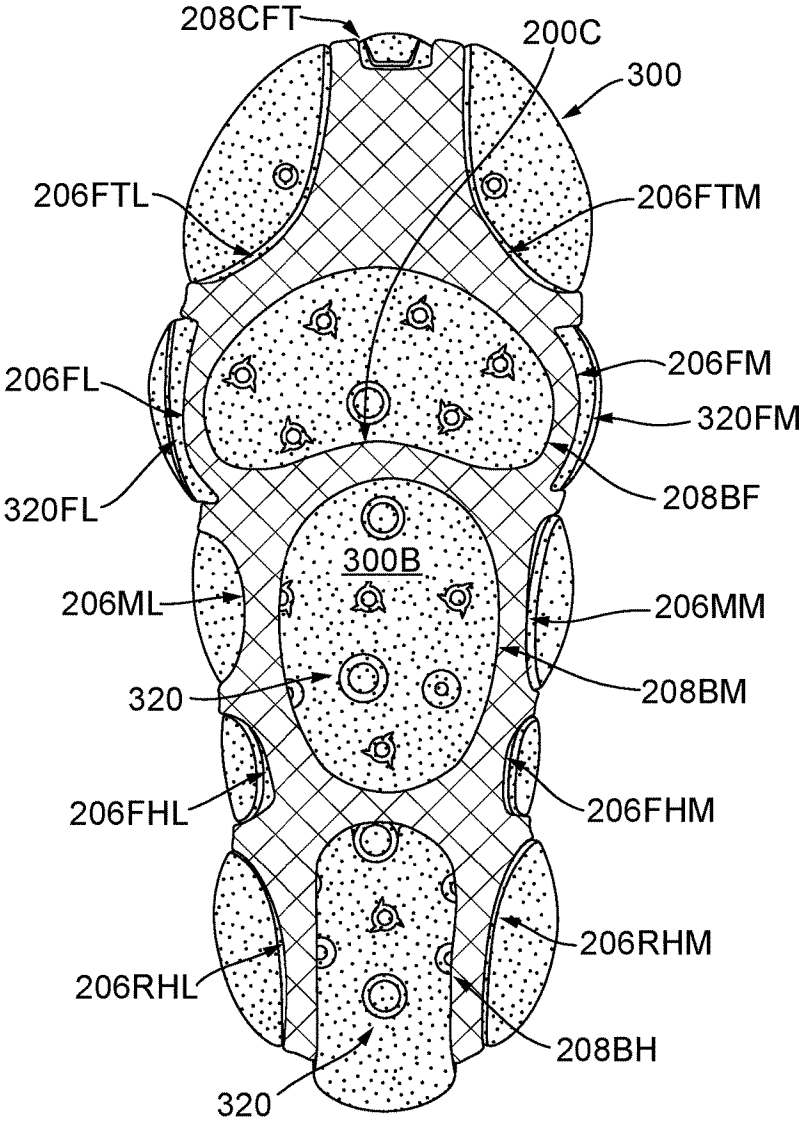
FIGS. 2A and 2B provide views of a combination upper component and midsole component in accordance with some aspects of this technology.
Figure 2A:
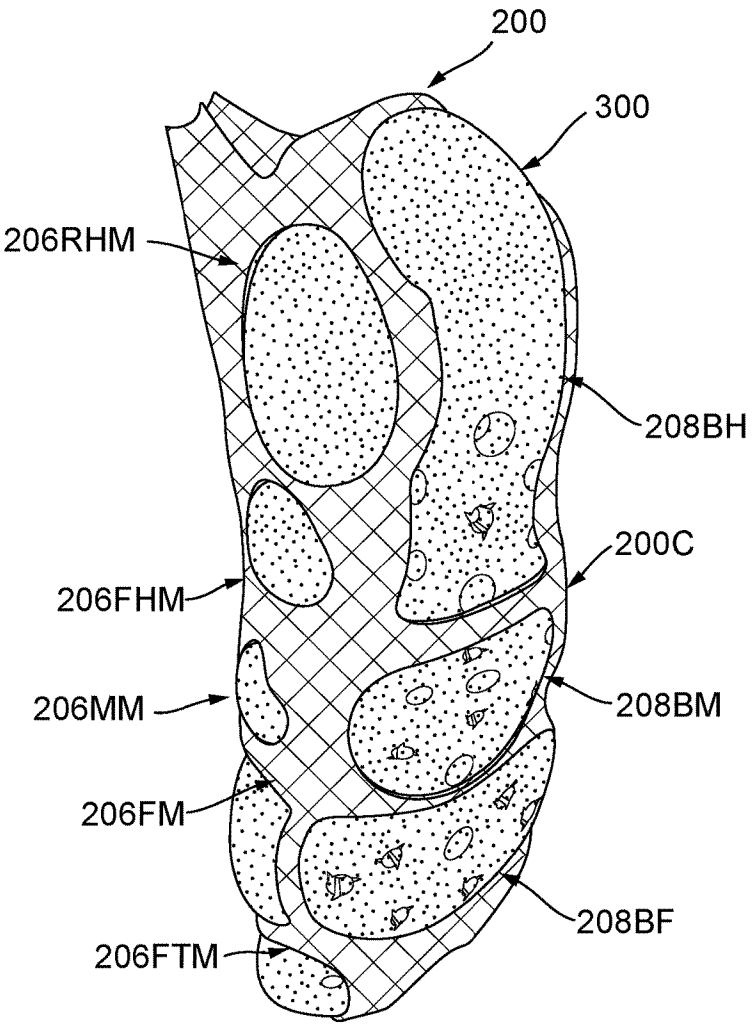

FIGS. 2A and 2B, together with FIGS. 1A and 1B, provide various views of an upper component 200 in accordance with some examples of this technology. FIG. 2A provides a bottom, medial perspective view of the upper component 200 (with the midsole component 300 inserted therein) and FIG. 2B provides a bottom view of the upper component 200 (with the midsole component 300 inserted therein). The upper component 200 may be made from one or more parts. These one or more parts may form: (a) a lateral side 200L, (b) a medial side 200M, (c) a connecting structure 200C connecting the lateral side 200L and medial side 200M and extending to form at least a portion of the bottom surface of the upper component 200, and (d) an instep portion 200I connecting the lateral side 200L and medial side 200M and extending to form at least a portion of the top, instep area of the upper component 200. As described above, the upper component 200 at least in part defines an interior chamber 202 configured to receive a wearer's foot. The upper component 200 may extend from the rear heel area to the forward toe area of the footwear 100 structure. The instep portion 200I may include a tongue element, e.g., as are conventionally known and used in the footwear arts.

The upper component 200 may be made from any desired material(s), including material(s) conventionally known and used in the footwear arts. As some more specific examples, the upper component 200 may comprise one or more of: a fabric or textile component, a leather (natural or synthetic) material, a knit material, a woven material, a thermoplastic polyurethane material, etc. The upper component 200 also may be made from one or more recycled parts (e.g., one or more parts previously used in a footwear upper product). When made from multiple parts, the upper component 200 parts may be engaged together in any desired manner, including in conventional manners as are known and used in the footwear arts. As some more specific examples, the upper component 200 parts, when multiple parts are used, may be engaged by stitching or sewn seams, by mechanical connectors or fasteners, or by adhesives (but, as noted above, in some examples of this technology, the upper component 200 may be made in an adhesive-free manner). In some specific examples of this technology, the upper component 200 may include knit structures of the type described in U.S. Provisional Patent Appln. No. 63/320,078, entitled "Sustainable Footwear Article."

FIGS. 1A-2B further illustrate that the upper component 200 is formed to include a plurality of openings extending through a material of the upper component 200, e.g., with some openings on each side 200L, 200M of the upper component 200 and/or with some openings located on the bottom of the upper component 200 (e.g., formed as part of the connecting structure 200C). The openings may be separated from one another and/or at least partially defined by strips of upper component 200 material. While any desired number and arrangement of openings may be used, this illustrated example includes: (a) a rear heel lateral opening 206RHL, (b) a rear heel medial opening 206RHM, (c) a forward heel lateral opening 206FHL, (d) a forward heel medial opening 206FHM, (e) a midfoot lateral opening 206ML, (f) a midfoot medial opening 206MM, (g) a forefoot lateral opening 206FL, (h) a forefoot medial opening 206FM, (i) a forward toe lateral opening 206FTL, and (j) a forward toe medial opening 206FTM. In addition, as shown in FIGS. 2A and 2B, the upper component 200 of this example includes one or more bottom openings, e.g., (a) the bottom heel opening 208BH (which extends upward to the rear heel side surface in this example), (b) the bottom midfoot opening 208BM, and (c) the bottom forefoot opening 208BF. This example upper component 200 further includes a central forward toe opening 208CFT. As shown in FIGS. 1A-2B, the midsole component 300 is exposed through one or more of the openings 206RHL, 206RHM, 206FHL, 206FHM, 206ML, 206MM, 206FL, 206FM, 206FTL, 206FTM, 208BH, 208BM, and/or 208BF of the upper component 200.

In at least some of the locations, strips (e.g., partial loops) of upper component 200 material extend between at least some of the adjacent openings 206RHL, 206RHM, 206FHL, 206FHM, 206ML, 206MM, 206FL, 206FM, 206FTL, 206FTM, 208BH, 208BM, and/or 208BF and define, in part, the openings 206RHL, 206RHM, 206FHL, 206FHM, 206ML, 206MM, 206FL, 206FM, 206FTL, 206FTM, 208BH, 208BM, and/or 208BF. The strips may be integrally formed with the main part(s) of the upper component 200 (e.g., panels forming sides 200L, 200M), or they may be formed, at least in part, by separate components that are sewn on (or otherwise attached) to the main part(s). These strips may be flexible components configured to be fit between protrusions of the midsole component 300, as will be described in more detail below. The strips also may be somewhat stretchable and/or elastic, e.g., to provide a tight and secure fit. If necessary, the strips may be reinforced and/or formed of a durable material (e.g., a tear resistant material).

FIG. 3 provides a front, top, lateral perspective view of an article of footwear 100 in accordance with some aspects of this technology (without a lace 108 or pull tab 600 shown). Referring also to FIGS. 1A-2B, the article of footwear 100 is assembled by placing the midsole component 300 within the interior chamber 202 defined by the upper component 200 such that the portions of the midsole component 300 are exposed and/or extend through at least some of the openings 206RHL, 206RHM, 206FHL, 206FHM, 206ML, 206MM, 206FL, 206FM, 206FTL, 206FTM, 208BH, 208BM, and/or 208BF of the upper component 200. The sockliner component 500, if present, may be placed on the top surface 300S of the midsole component 300 either before or after the midsole component 300 is inserted into the interior chamber 202 of the upper component 200. Then, the exterior sole component 400 is placed over the bottom surface of the combined upper component 200 and midsole component 300. These individual parts and assembly process are described in more detail below.

Figure 4A:
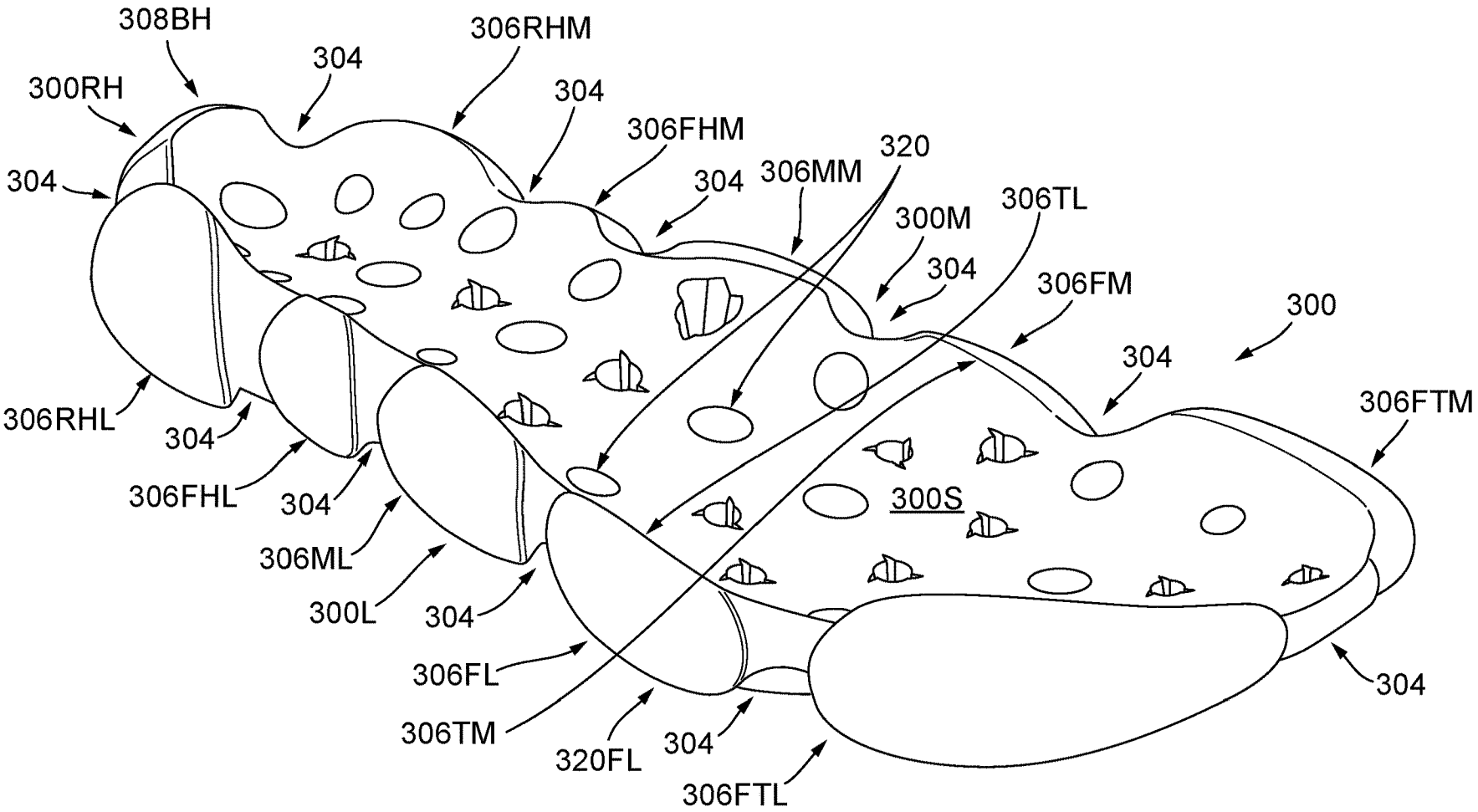
FIGS. 4A-4M provide various views of midsole components in accordance with some aspects of this technology.
Figure 4B:
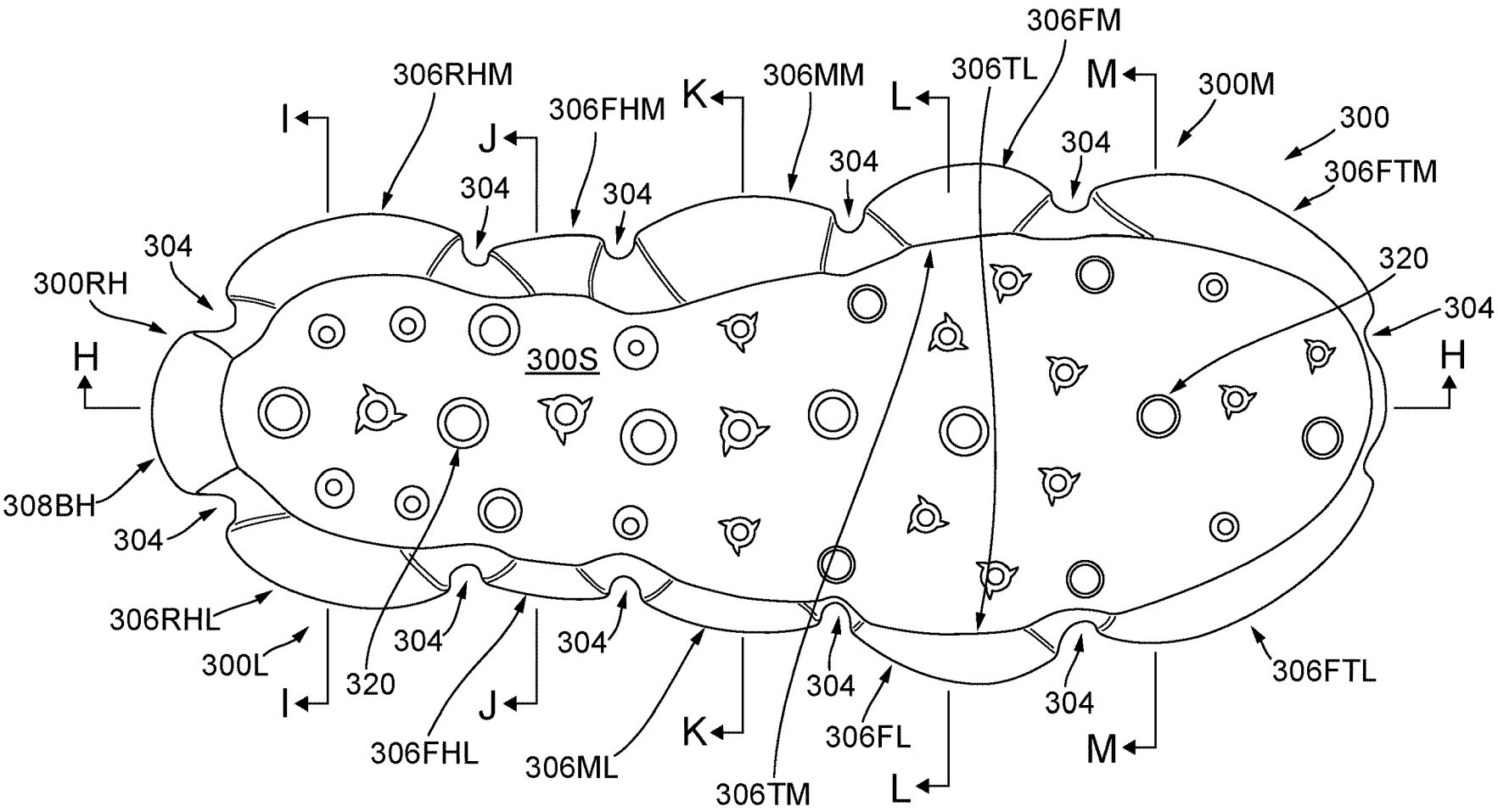
Figure 4C:
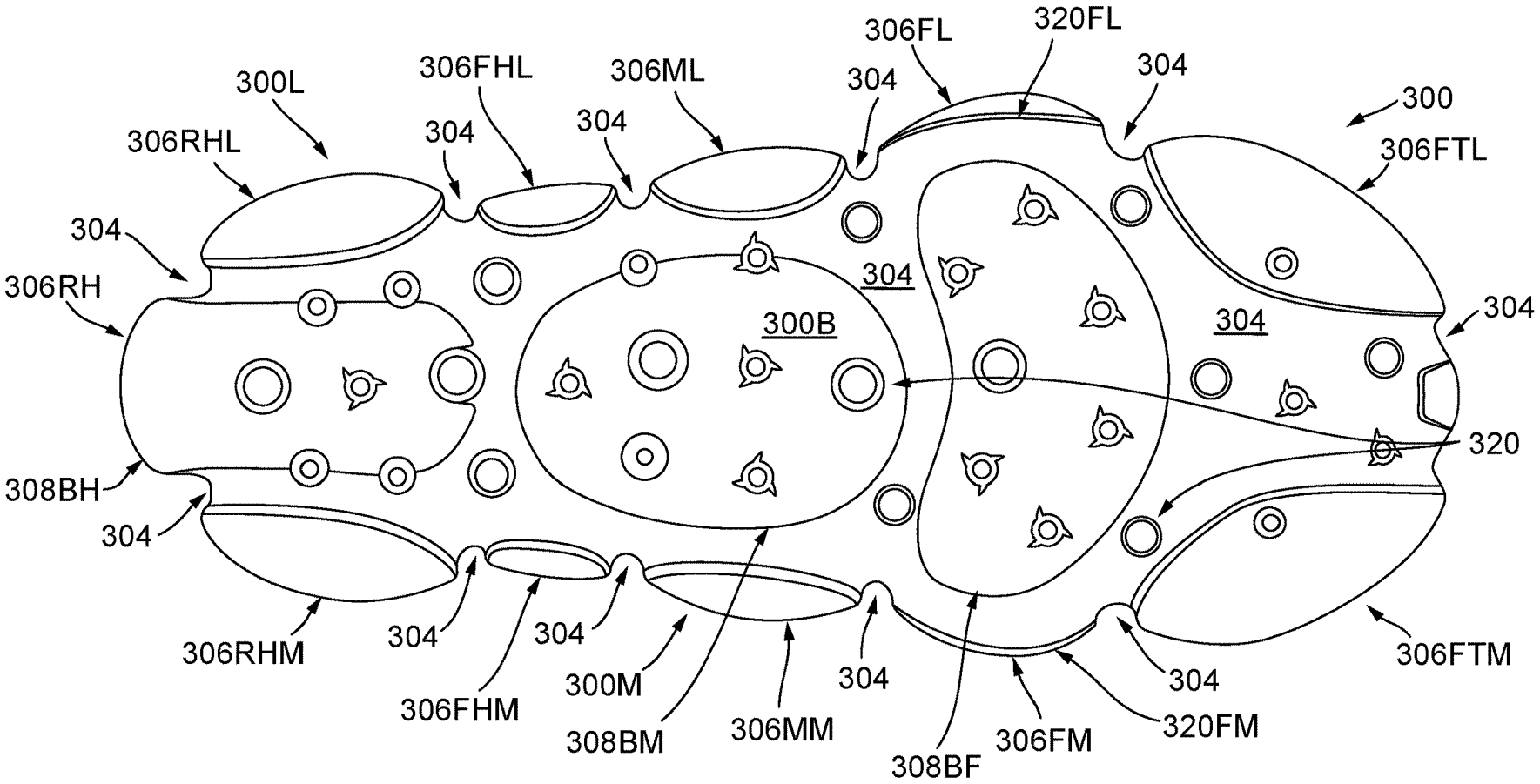
Figure 4D:
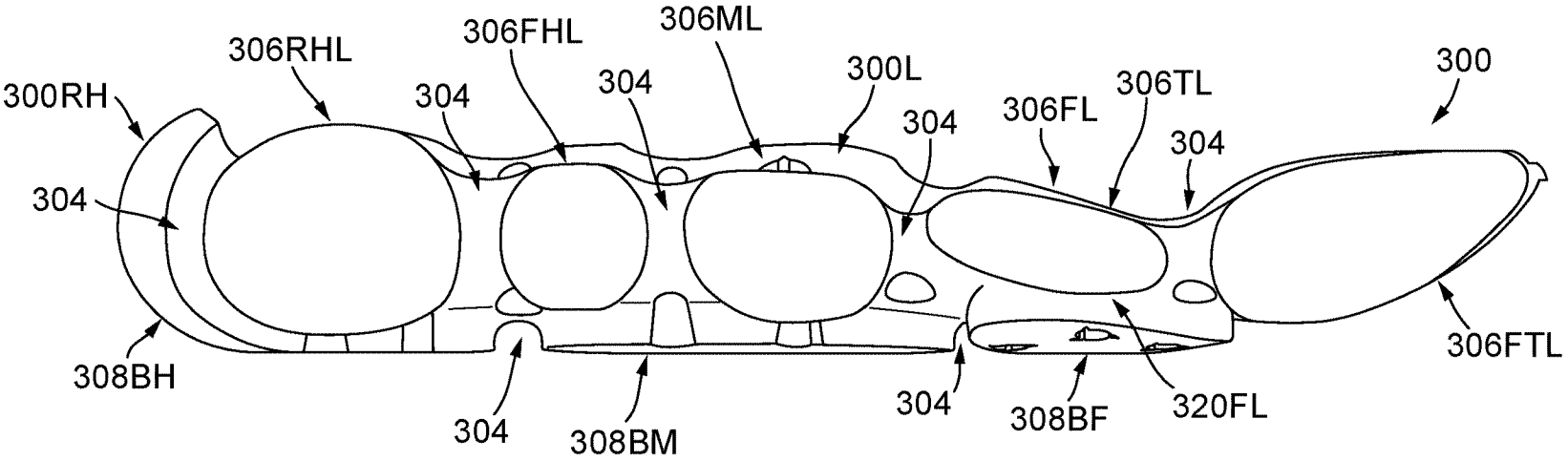
Figure 4E:
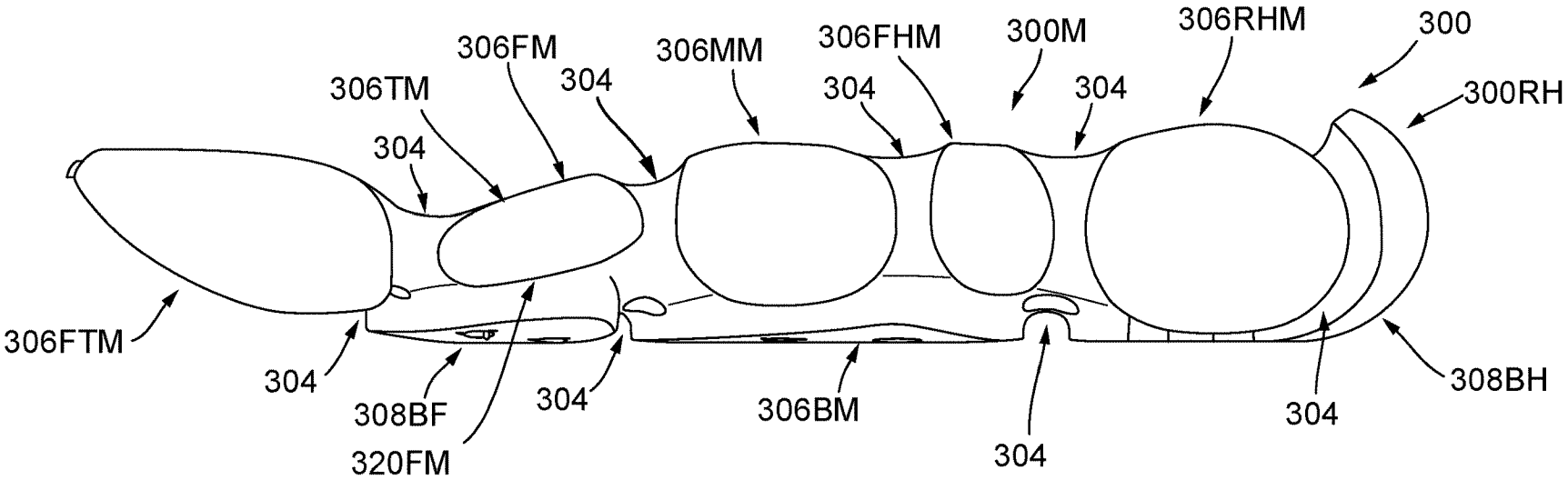
Figure 4G:
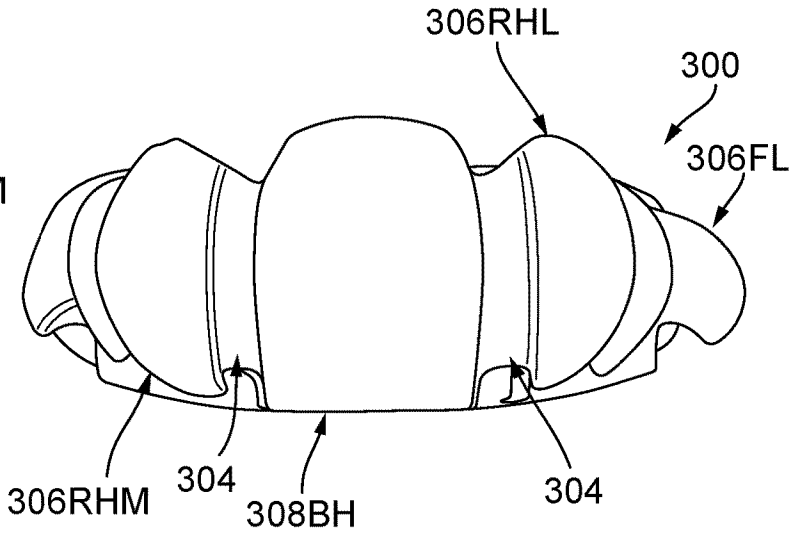
Figure 4F:
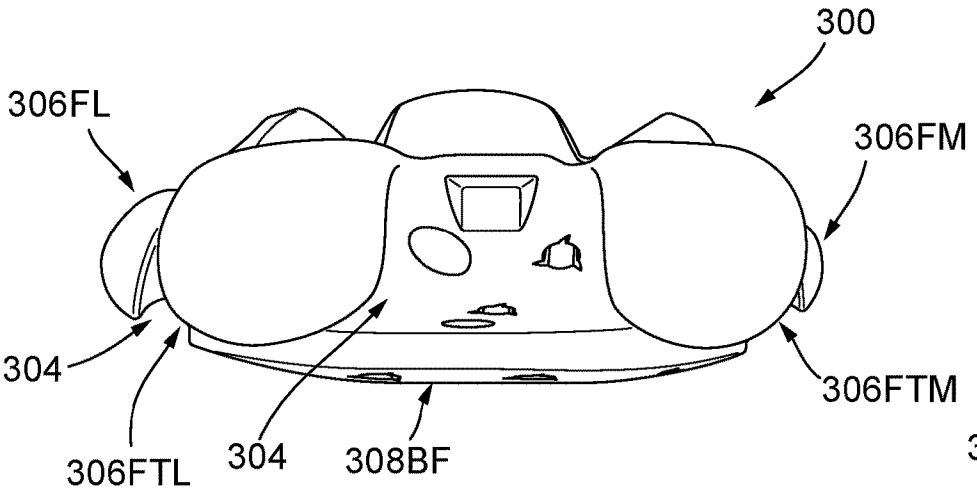
Figure 4H:
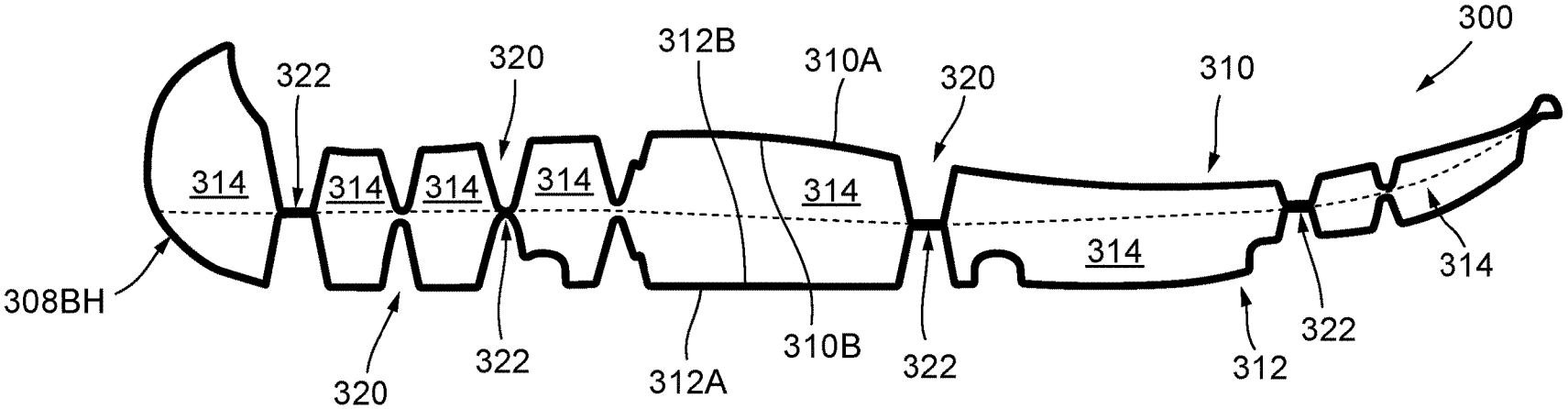
Figure 4J:
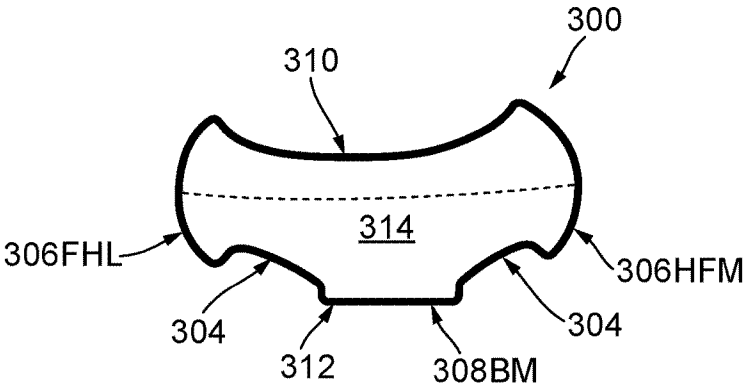
Figure 4L:
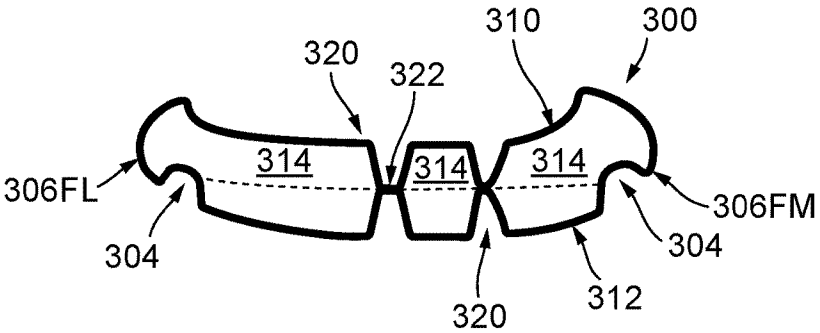
Figure 4I:
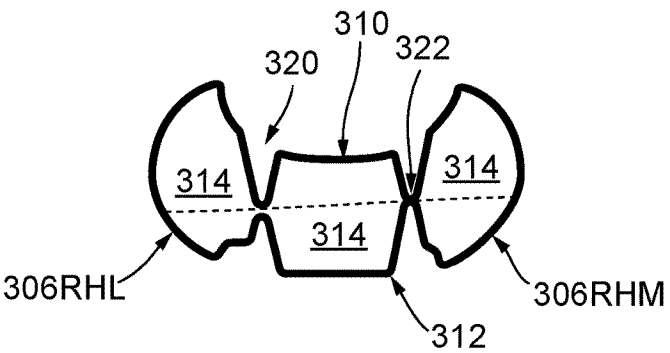
Figure 4K:
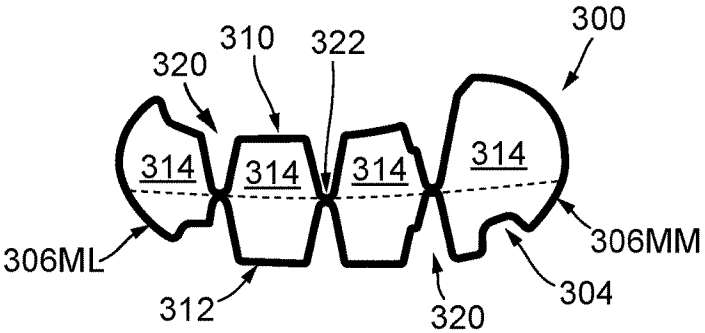
Figure 4M:
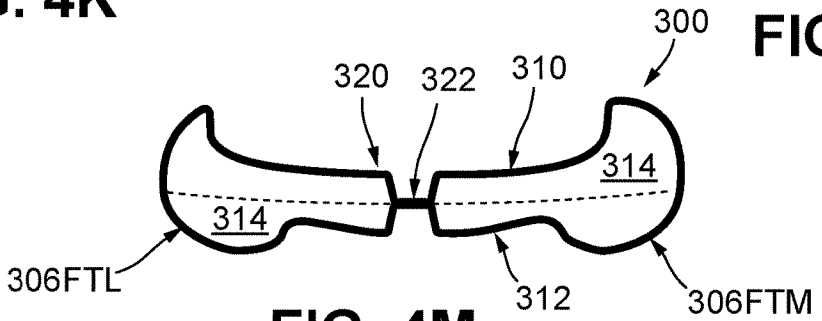

FIGS. 4A-4M provide various views of midsole component 300 in accordance with some examples of this technology. FIG. 4A provides a front, top, lateral perspective view of midsole component 300; FIG. 4B provides a top view; FIG. 4C provides a bottom view; FIG. 4D provides a lateral side view; FIG. 4E provides a medial side view; FIG. 4F provides a toe view; FIG. 4G provides a heel view; FIG. 4H provides a sectional view along line H-H in FIG. 4B; FIG. 4I provides a sectional view along line I-I in FIG. 4B; FIG. 4J provides a sectional view along line J-J in FIG. 4B; FIG. 4K provides a sectional view along line K-K in FIG. 4B; FIG. 4L provides a sectional view along line L-L in FIG. 4B; and FIG. 4M provides a sectional view along line M-M in FIG. 4B. As evident from these figures, the midsole component 300 includes a plurality of protrusions, e.g., located at and/or extending from its side surfaces (e.g., lateral side 300L and medial side 300M), located at and/or extending from its rear heel area 300RH, and/or located at and/or extending from its bottom surface 300B. Any desired number and/or arrangement of protrusions may be provided, and the protrusions may be oriented to match up with and extend through corresponding openings provided in the upper component 200. In this illustrated example, midsole component 300 includes: (a) a rear heel lateral protrusion 306RHL, (b) a rear heel medial protrusion 306RHM, (c) a forward heel lateral protrusion 306FHL, (d) a forward heel medial protrusion 306FHM, (e) a midfoot lateral protrusion 306ML, (f) a midfoot medial protrusion 306MM, (g) a forefoot lateral protrusion 306FL, (h) a forefoot medial protrusion 306FM, (i) a forward toe lateral protrusion 306FTL, (j) a forward toe medial protrusion 306FTM, (k) a bottom heel protrusion 308BH (which extends upward to the rear heel side surface), (l) a bottom midfoot protrusion 308BM, and (m) a bottom forefoot protrusion 308BF. Protrusions 306RHL, 306RHM, 306FHL, 306FHM, 306ML, 306MM, 306FL, 306FM, 306FTL, 306FTM generally extend outward in a sideways direction with respect to the footwear's longitudinal length L. Recesses 304 (e.g., indentations, grooves, etc.) may be formed in the surfaces (e.g., lateral side 300L surface, medial side 300M surface, and/or bottom surface 300B) of the midsole component 300 between adjacent protrusions to define the protrusions. The recesses 304 may be elongated in that one dimension (e.g., a length dimension) is longer than another dimension (e.g., a width dimension), in some instances two times longer or more. Thus, as shown in FIGS. 1A-3, protrusions 306RHL, 306RHM, 306FHL, 306FHM, 306ML, 306MM, 306FL, 306FM, 306FTL, 306FTM, 308BH, 308BM, and 308BF fit into and extend through a corresponding opening 206RHL, 206RHM, 206FHL, 206FHM, 206ML, 206MM, 206FL, 206FM, 206FTL, 206FTM, 208BH, 208BM, and 208BF, respectively, of the upper component 202. When fit together, the upper component 202 material (e.g., the strips) fits into the recesses 304 and covers the portion of the midsole component 300 present in the recess 304.

The midsole component 300 may be made from any desired materials, including conventional midsole materials as are known and used in the footwear arts, e.g., EVA foams, polyurethane foams, other polymeric foams, etc. The midsole component 300 also may be made from one or more recycled parts (e.g., one or more parts previously used in a footwear midsole product). As a more specific example, the midsole component 300 may comprise a blow molded component filled with a gas (e.g., air). Example blow molded midsole components 300 may be formed by placing two sheets of plastic material (e.g., thermoplastic polymer sheets) into a mold. Then a gas (e.g., air) is introduced into the mold cavity between the two sheets, which blows them outward toward and to the interior surfaces of the mold cavity. As the sheets are being blown outward by the gas, an interior chamber is formed between the sheets and a sealed perimeter edge is formed. The perimeter edge seal traps gas inside the interior chamber between the sheets. Blow molding techniques are generally known. The resulting midsole component 300 structure includes: (a) a first layer 310 (formed from the first sheet (e.g., a top layer)) having an outer surface 310A and an opposite inner surface 310B and (b) a second layer 312 (formed from the second sheet (e.g., a bottom layer)) having an outer surface 312A and an opposite inner surface 312B. See FIG. 4H. A space or interior chamber 314 is defined between the first layer 310 and the second layer 312 and this interior chamber 314 contains a gas (e.g., gas introduced during the blow molding process to expand the sheets outward to the mold surfaces). Alternatively, gas could be introduced into the interior chamber 314 to inflate the midsole component 300 after the sheets 310, 312 are sealed together (e.g., through an inflation port). Such bladder formation and inflation techniques are known and used in the inflatable bladder arts.

FIGS. 2B and 4A-4C further show that the top surface 300S and bottom surface 300B of the midsole component 300 include indentations or recesses 320. At least some of these indentations 320 may be formed as an interior bond 322 where the inner surface 310B of one layer 310 of the midsole component 300 is fixed to the inner surface 312B of the other layer 312 of the midsole component. See also the cross-sectional views of FIGS. 4H-4M. Such fixing can be provided using welding techniques, such as RF welding, ultrasonic welding, laser welding, etc., as are conventionally known and used in the relevant arts. As shown in FIGS. 4A-4M, at least some of these interior bonds 322 are spaced inward from an outer perimeter edge that defines the interior chamber 314 formed by the first layer 310 and the second layer 312. These indentations or recesses 320 and interior bonds 322 may be provided at various locations around the volume of the midsole component 300 and may have various different sizes, shapes, spacings, etc., e.g., to control the final shape of the midsole component 300.

Figure 5A:
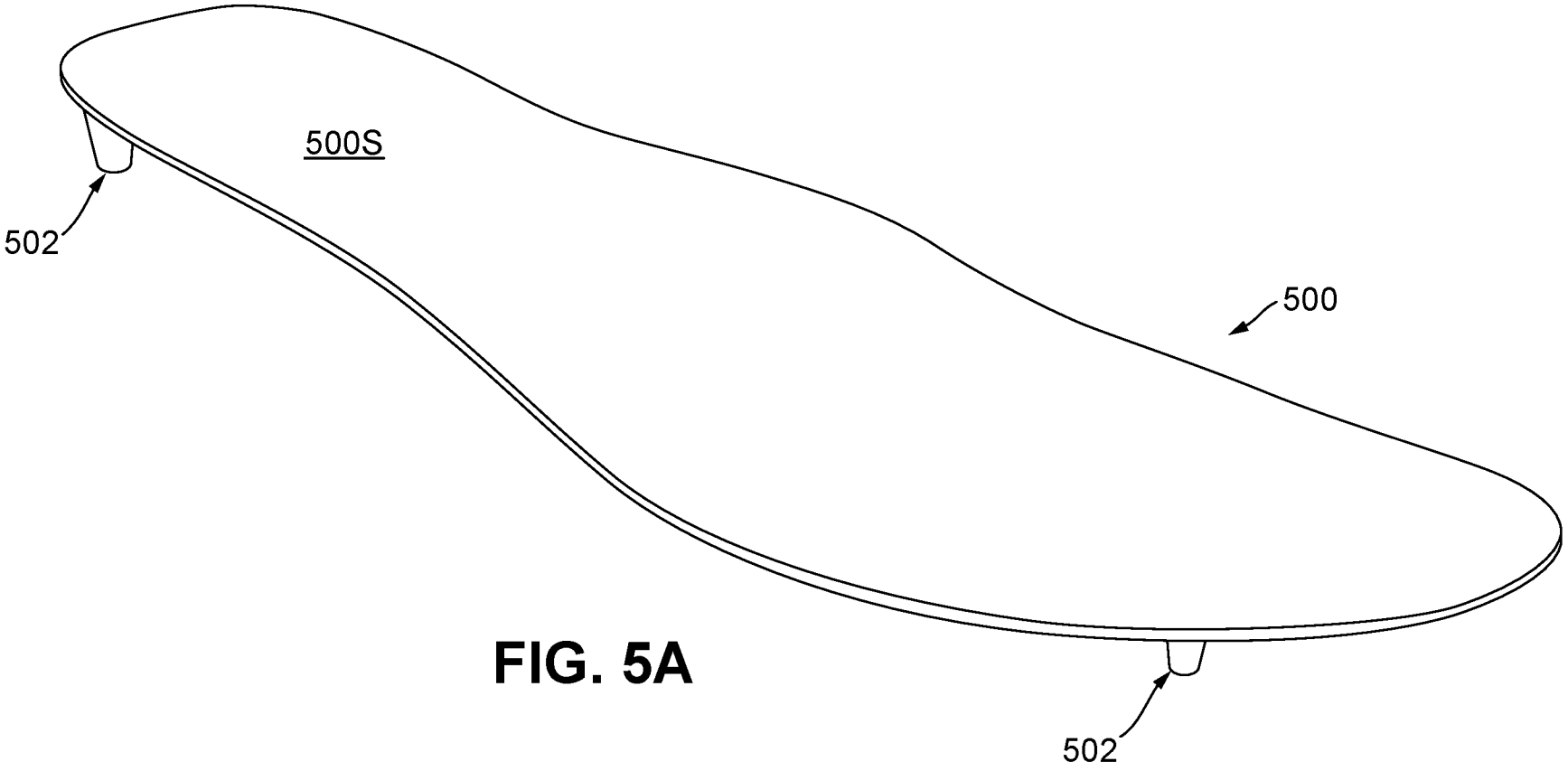
FIGS. 5A-5G provide various views of an insole component and its engagement with a midsole component in accordance with some aspects of this technology.
Figure 5B:
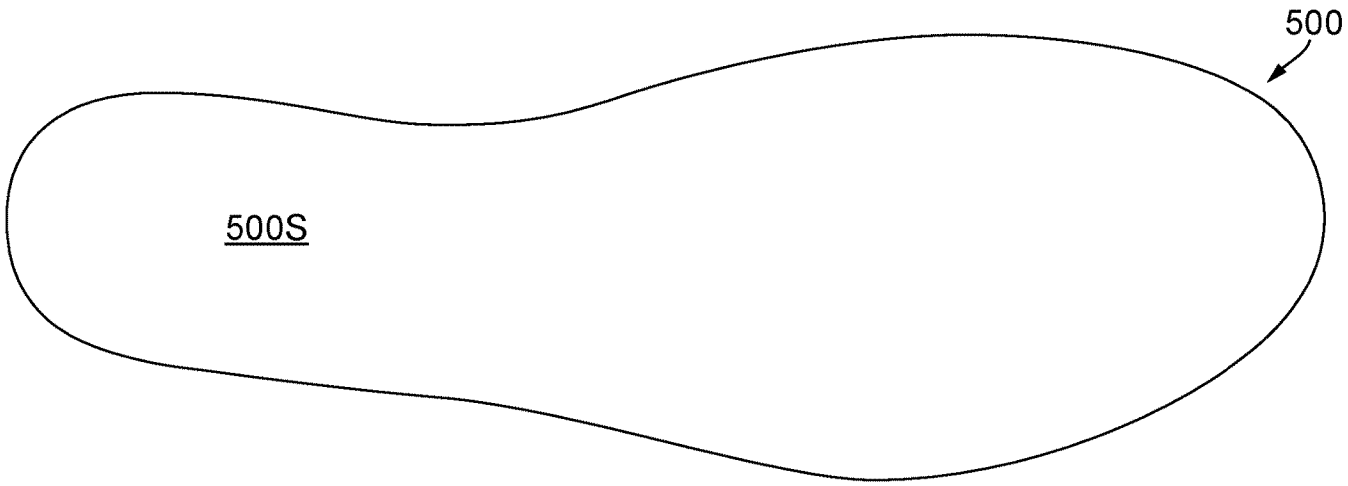
Figure 5C:
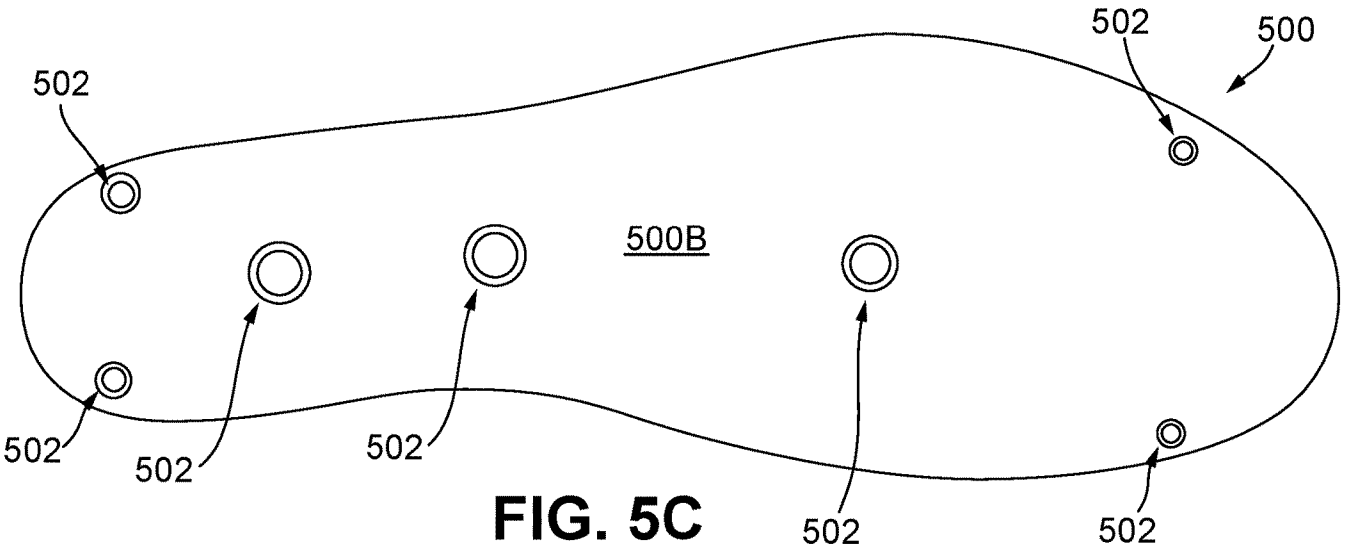
Figure 5D:
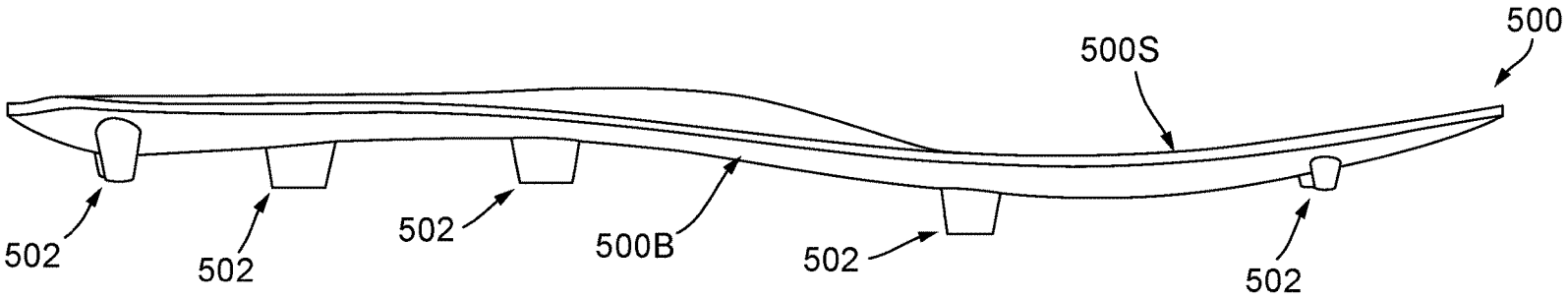
Figure 5E:
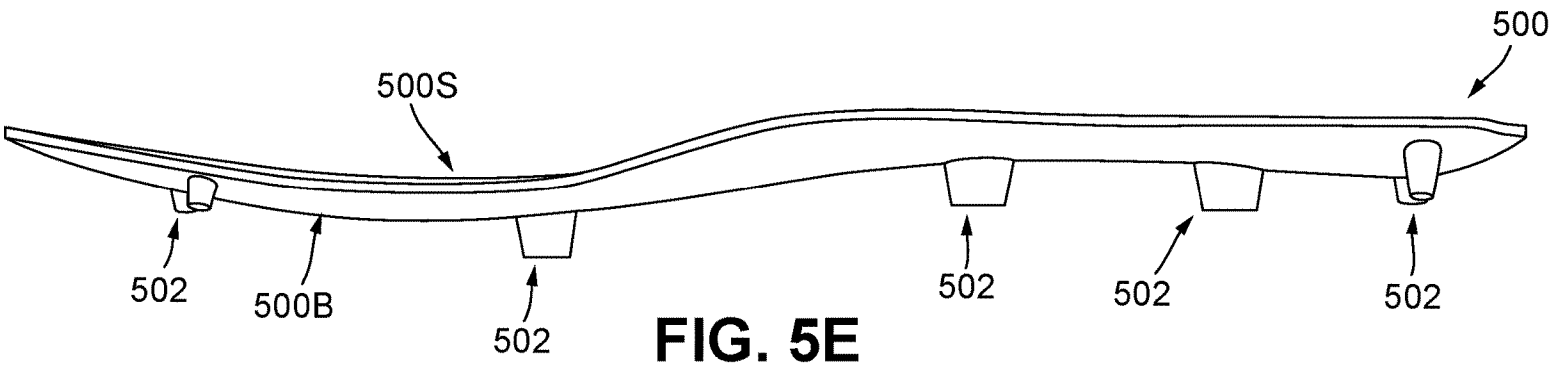
Figure 5G:
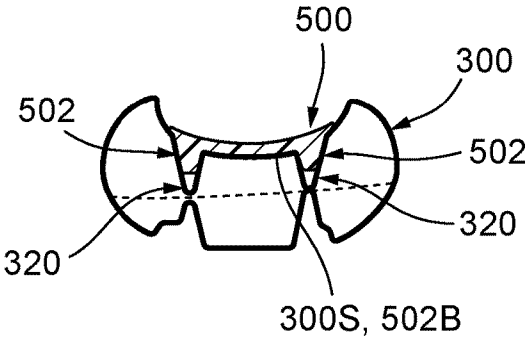
Figure 5F:
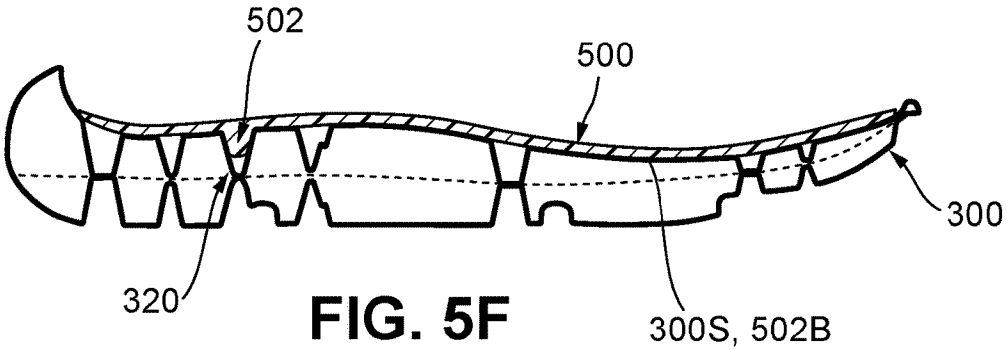

FIGS. 5A-5G provide various views of an insole component 500 that may be included in article of footwear 100 structures in accordance with at least some examples of this technology. FIG. 5A is a top, front, perspective view of the insole component 500; FIG. 5B is a top view; FIG. 5C is a bottom view; FIG. 5D is a lateral side view; and FIG. 5E is a medial side view. FIGS. 5F and 5G provide cross sectional views at locations H-H and I-I, respectively, from FIG. 4B showing the insole component 500 engaged with a midsole component 300 in accordance with some examples of this technology.

As shown in FIGS. 5A and 5B, the insole component 500 includes a top surface 500S (e.g., a contoured surface) for engaging a wearer's foot. FIGS. 5A, 5C, 5D, and 5E illustrate that the bottom surface 500B of the insole component 500 includes one or more projections 502 extending downward from the base level of the bottom surface 500B. While other numbers and/or arrangements of projections 502 are possible, this illustrated example includes two rear heel projections 502 (one on the lateral side and one on the medial side), two forefoot projections 502 (one on the lateral side and one on the medial side), and three central projections 502 located between the forefoot and heel projections 502. Two of the central projections 502 are provided in the heel area and/or midfoot area and one central projection is provided in the midfoot area and/or forefoot area (e.g., beneath the ball of the foot area). As shown in FIGS. 5F and 5G, the projections 502 on the insole component 500 may be received in corresponding recesses 320 defined in the top surface 300S of the midsole component 300. The recess(es) 320 may constitute an exterior surface of midsole component 300 at the location(s) of an interior bond 322.

The top surface 500S of the insole component 500 may include a material that assists in wicking away moisture from the wearer's foot (e.g., a fabric material, a breathable material). The bottom surface 500B of the insole component 500, or at least the projections 502, may be formed from a textile, fibrous, or plastic material having sufficient rigidity to help maintain the structural integrity of the projection 502 and help maintain the insole component 500 in place on and/or with respect to the top surface 300S of the midsole component 300.

Figure 6A:
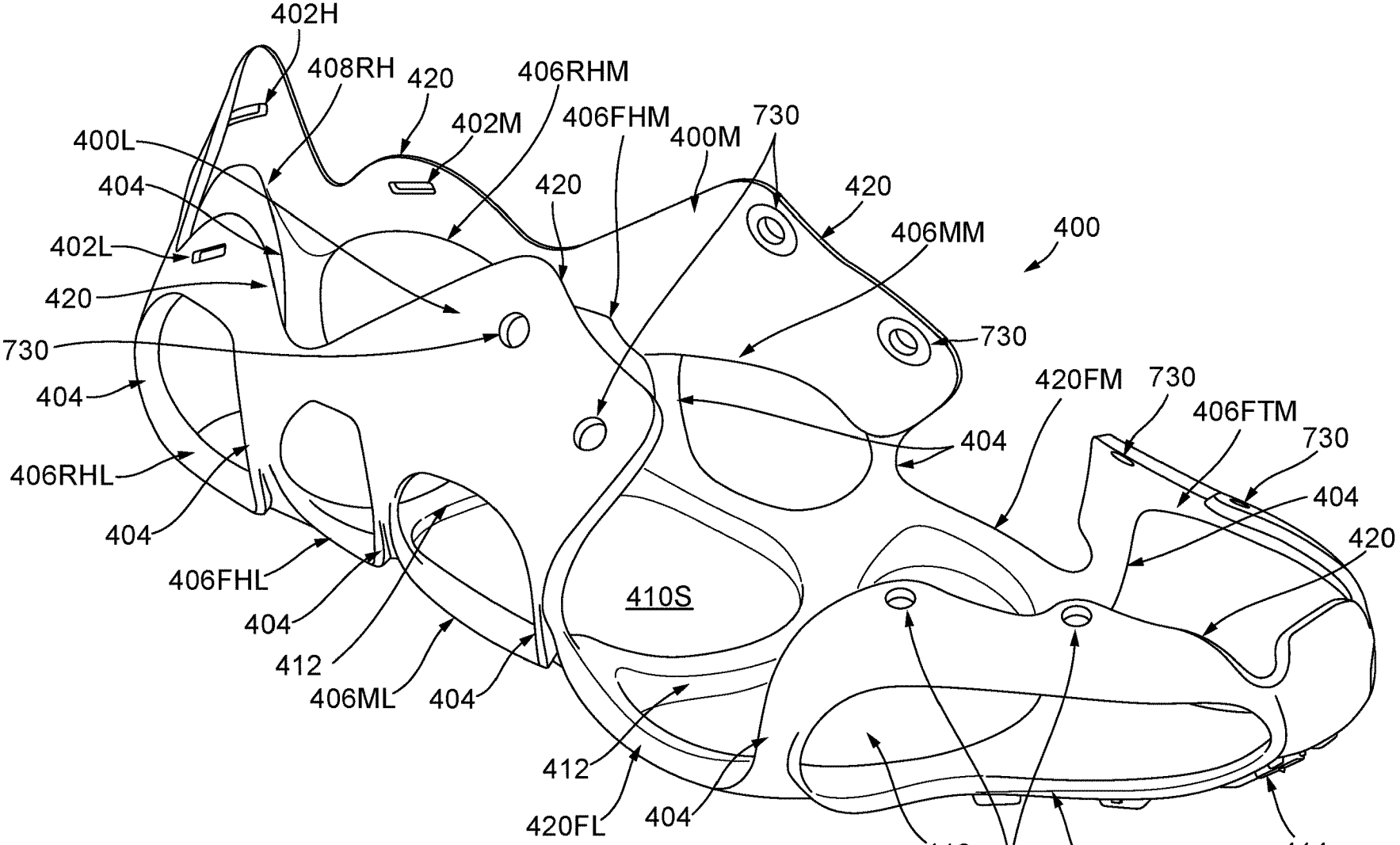
FIGS. 6A-6H provide various views of an exterior sole component in accordance with some aspects of this technology.
Figure 6B:
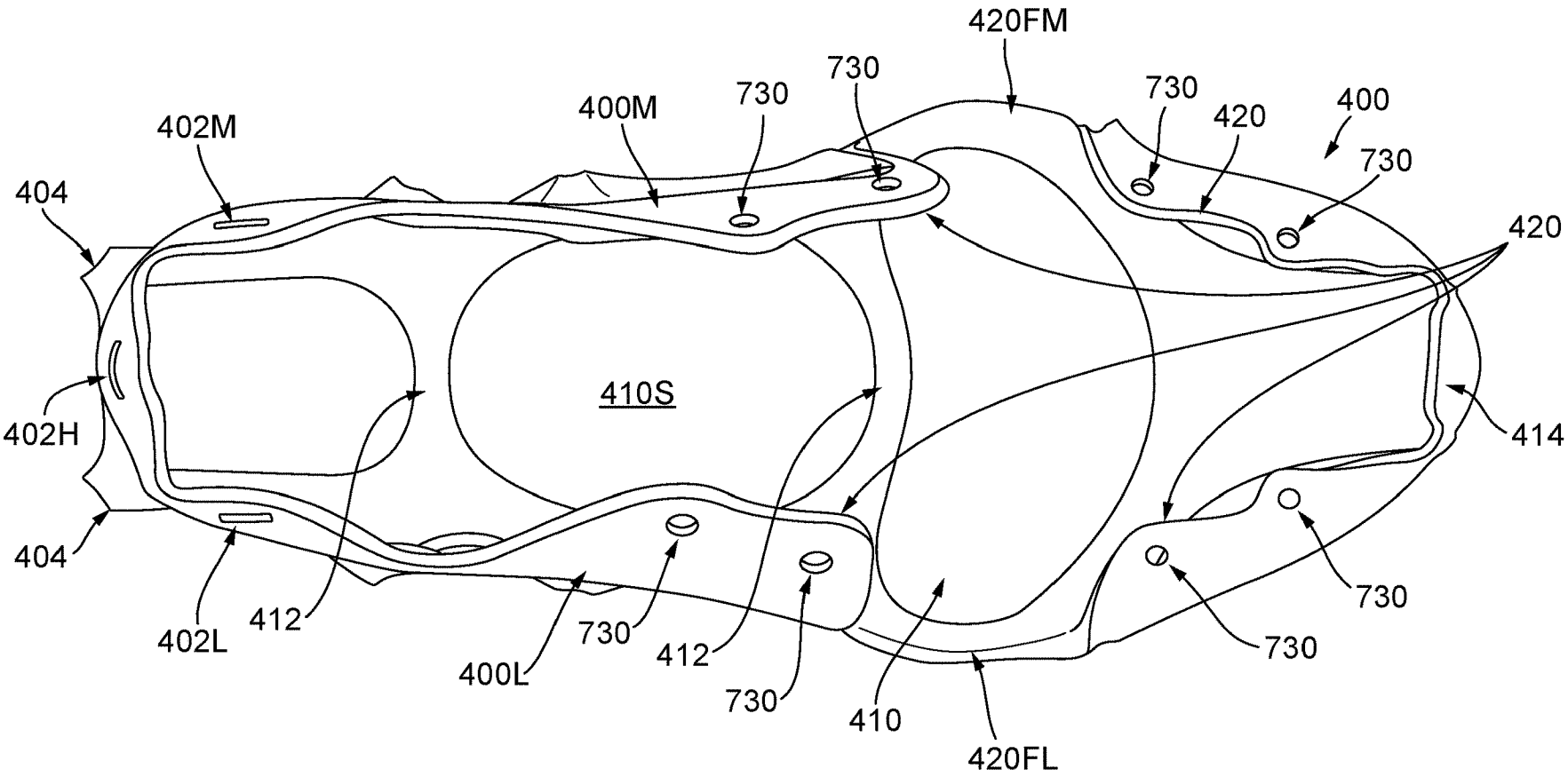
Figure 6C:
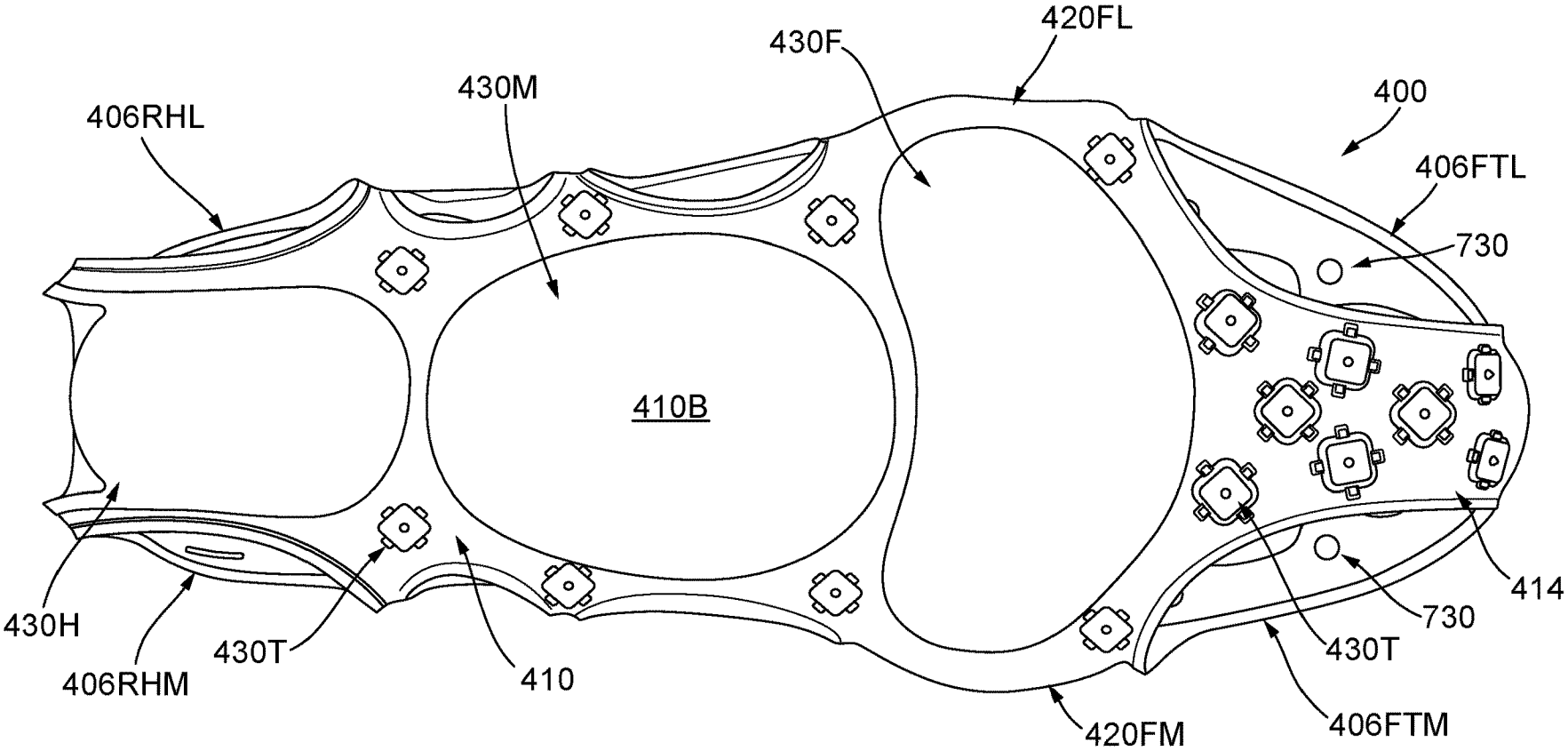
Figure 6D:
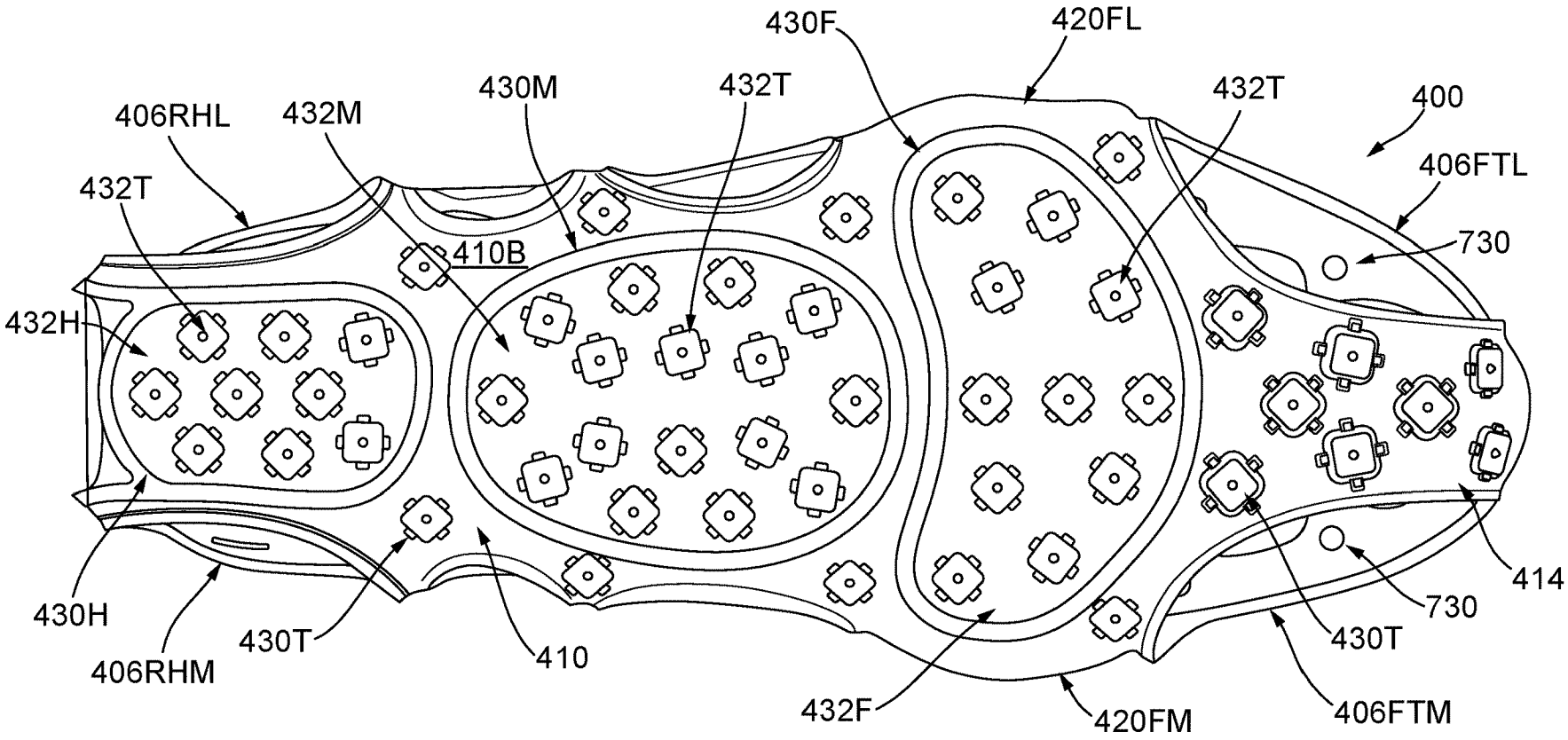
Figure 6E:
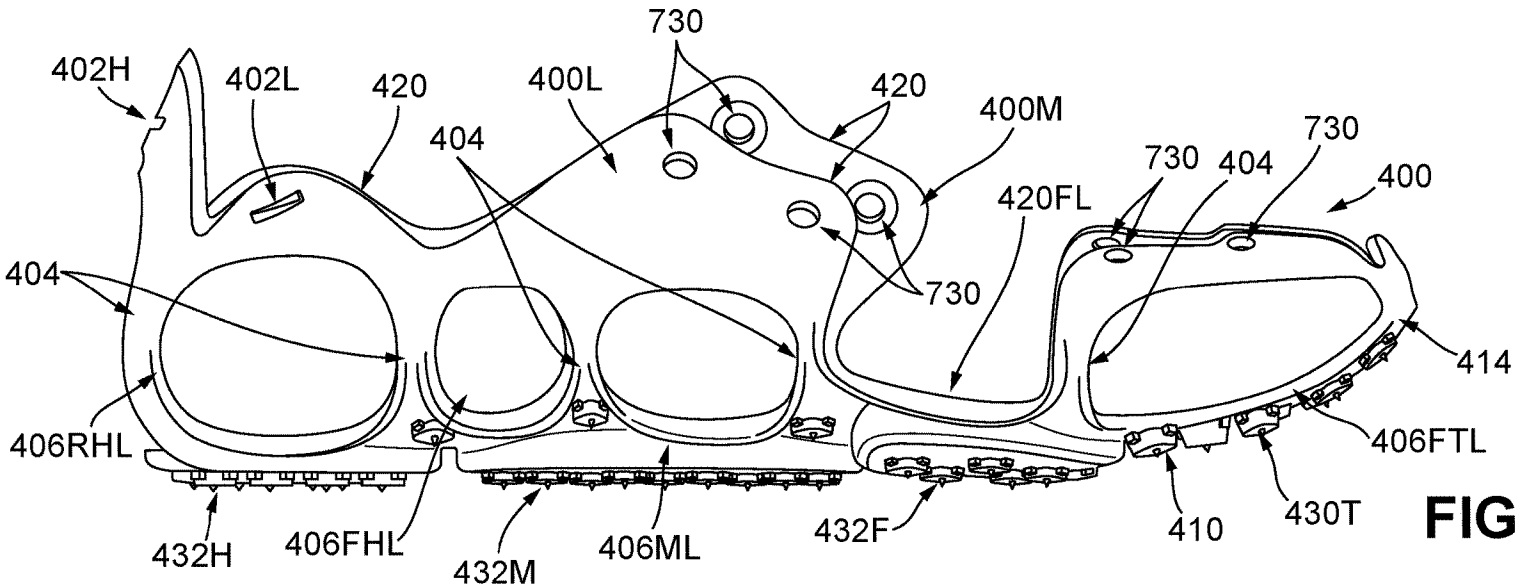
Figure 6F:
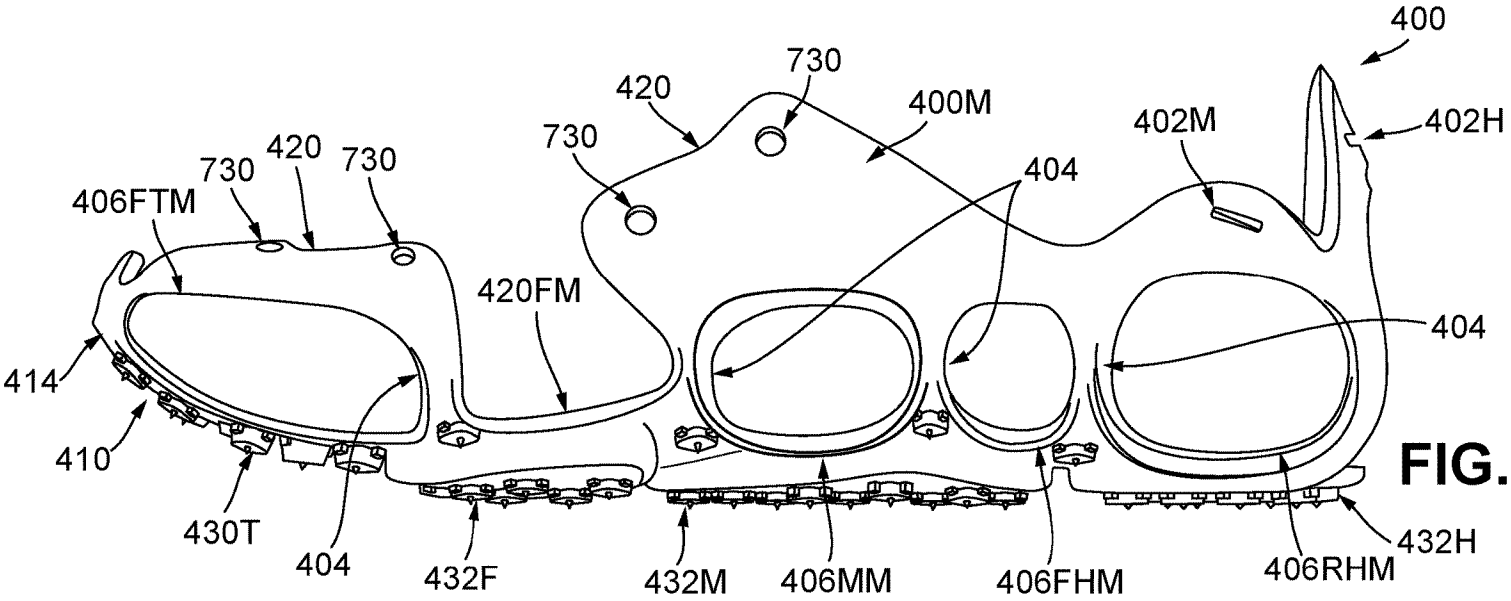
Figure 6G:
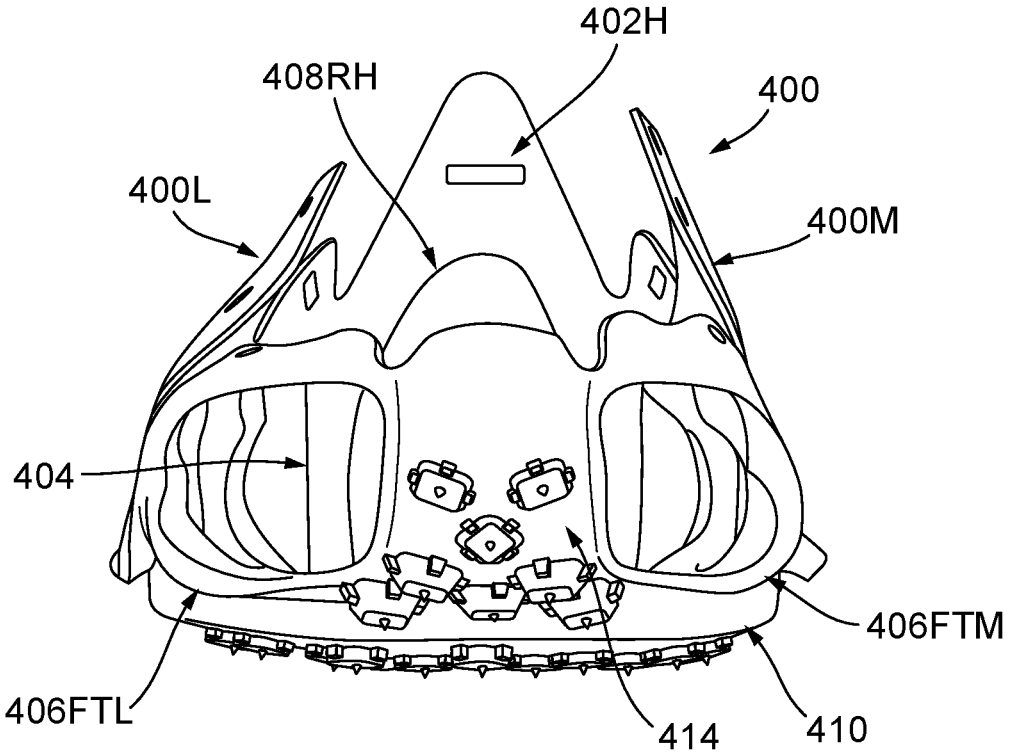
Figure 6H:
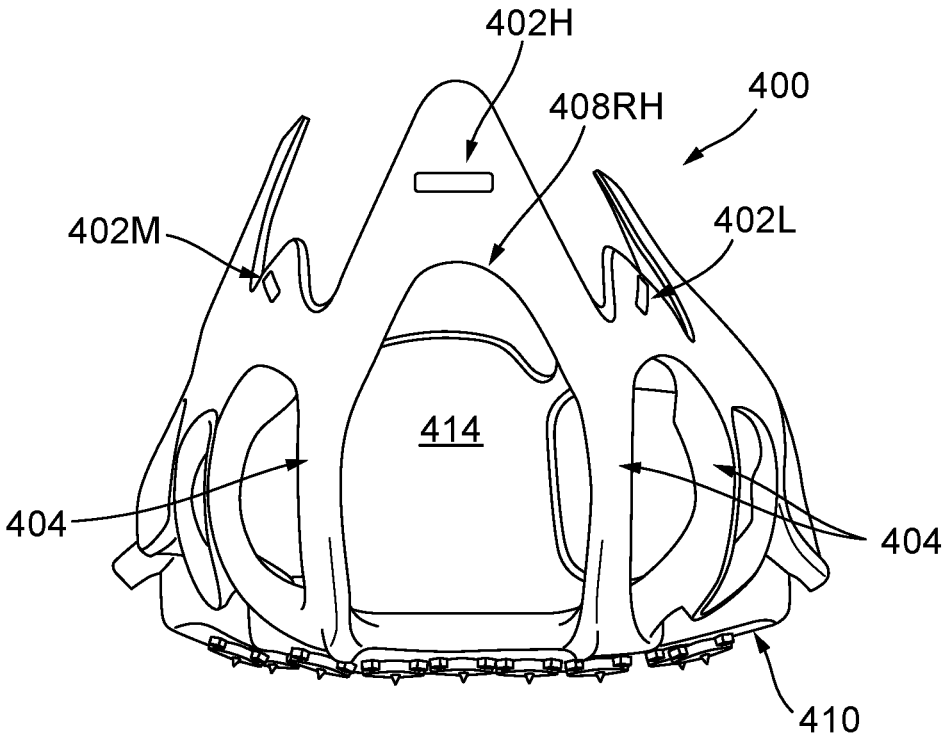

FIGS. 6A-6H provide various views of an exterior sole component 400 in accordance with some examples of this technology. The exterior sole component 400 may be formed of any suitable materials, including outsole materials as are conventionally known and used in the footwear arts (e.g., thermoplastic polyurethane materials, rubber based materials, etc.). The exterior sole component 400 also may be made from one or more recycled parts (e.g., one or more parts previously used in a footwear exterior sole product). FIG. 6A is a top, front, perspective view of the exterior sole component 400; FIG. 6B is a top view; FIG. 6C is a bottom view; FIG. 6D is a bottom view showing additional and/or different features; FIG. 6E is a lateral side view; FIG. 6F is a medial side view; FIG. 6G is a front view; and FIG. 6H is a rear view. The exterior sole component 600 of this example may be considered as a "cage" component that receives and holds the combined upper component 200 and midsole component 300, as described above and will be described in more detail below. Also, the exterior sole component 600 may be considered as a "clip" component that holds the various footwear parts together.

Similar to the upper component 200, the exterior sole component 400 of this example includes a plurality of openings defined through it. While any desired number and arrangement of openings may be used, this illustrated example includes: (a) a rear heel lateral opening 406RHL, (b) a rear heel medial opening 406RHM, (c) a forward heel lateral opening 406FHL, (d) a forward heel medial opening 406FHM, (e) a midfoot lateral opening 406ML, (f) a midfoot medial opening 406MM, (g) a forward toe lateral opening 406FTL, and (h) a forward toe medial opening 406FTM.

In at least some of the locations, strips 404 of exterior sole component 400 material extend between at least some of the adjacent openings 406RHL, 406RHM, 406FHL, 406FHM, 406ML, 406MM, 406FTL, 406FTM and define, in part, the openings 406RHL, 406RHM, 406FHL, 406FHM, 406ML, 406MM, 406FTL, 406FTM. The strips 404 of exterior sole component 400 material may be integrally formed with the main part(s) of the exterior sole component 400 (e.g., panels forming sides 400L, 400M), or they may be formed, at least in part, by separate components that are attached to the main part(s). At the forward toe location, e.g., as shown in FIGS. 6A, the lateral side forward toe opening 406FTL of the exterior sole component 400 and the medial side forward toe opening 406FTM are separated from one another by a center forward toe band 414 of exterior sole component material 400. This center forward toe band 414 may extend over the front and onto the top surface of the upper component 200. As such, the exterior sole component 400 may at least partially house or contain the forward toe portion of the upper component 200.

The openings 406RHL, 406RHM, 406FHL, 406FHM, 406ML, 406MM, 406FTL, 406FTM are arranged to align with and receive corresponding protrusions of the midsole component 300, e.g., rear heel lateral protrusion 306RHL, (b) rear heel medial protrusion 306RHM, (c) forward heel lateral protrusion 306FHL, (d) forward heel medial protrusion 306FHM, (e) midfoot lateral protrusion 306ML, (f) midfoot medial protrusion 306MM, (g) forward toe lateral protrusion 306FTL, and (h) forward toe medial protrusion 306FTM. The strips 404 of the exterior sole component 400 may be flexible components configured to fit between adjacent protrusions of the midsole component 300 in recesses 304. Thus, the strips 404 of the exterior sole component 400 may at least partially cover the strips of the upper component 200 located in the recesses 304 (e.g., cover at least 50%, at least 60%, at least 70%, at least 80%, at least 90%, or even at least 95% of the surface area of the upper component 200 located in the recesses 304). In some examples of this technology, at least some of the portions of the exterior sole component 400 adjacent and defining the openings 406RHL, 406RHM, 406FHL, 406FHM, 406ML, 406MM, 406FTL, 406FTM (e.g., at least some portion of strips 404) may be somewhat stretchable and stretched to fit over and around the perimeter edges of the corresponding projection. This may help maintain a secure fit (e.g., without the need for adhesives) between the exterior sole component 400 and the midsole component 300. Thus, in at least some examples of this technology, the exterior sole component 400 can be engaged with the protrusions of the midsole component 400 solely by a friction fit (e.g., in an adhesive-free manner).

The exterior sole component 400 of FIGS. 6A-6H differs somewhat from the exterior sole component 400 shown in FIGS. 1A and 1B in the rear heel area. The exterior sole component 400 of FIGS. 6A-6H has a rear heel opening 408RH through which rear heel projection 308BH of the midsole component 300 extends. The exterior sole component 400 of FIGS. 1A and 1B, on the other hand, includes a closed central rear heel end (i.e., the exterior sole component 400 covers the midsole component 300 at the central rear heel area). Like the example of FIGS. 1A and 1B, the example of FIGS. 6A-6H includes one or more openings 402L, 402H, 402M for engaging a pull tab 600.

Further, as shown in FIGS. 6A, 6C-6H, the bottom of this example exterior sole component 400 is largely closed off by a bottom outsole (or ground-contacting) component 410. The interior surface 410S of bottom outsole component 410 of this example includes one or more raised ridges 412 or other structures. These raised ridges 412 (or other structures) fit into recesses 304 between bottom protrusions (e.g., protrusions 308BH, 308BM, and 308BF) of the midsole component 300 and at least partially cover the portions of the upper component 200 located within the recesses 304 at the bottom surface 300B of the midsole component 300.

In this illustrated example, the exterior sole component 400 includes: (a) rear heel lateral opening 406RHL, (b) rear heel medial opening 406RHM, (c) forward heel lateral opening 406FHL, (d) forward heel medial opening 406FHM, (e) midfoot lateral opening 406ML, (f) midfoot medial opening 406MM, (g) forward toe lateral opening 406FTL, and (h) forward toe medial opening 406FTM that respectively engage with and completely surround: (a) rear heel lateral protrusion 306RHL, (b) rear heel medial protrusion 306RHM, (c) forward heel lateral protrusion 306FHL, (d) forward heel medial protrusion 306FHM, (e) midfoot lateral protrusion 306ML, (f) midfoot medial protrusion 306MM, (g) forward toe lateral protrusion 306FTL, and (h) forward toe medial protrusion 306FTM. Note also FIGS. 1A, 1B, 3, and 7F-7I. This example exterior sole component 400, however, does not include an opening that completely surrounds the forefoot lateral protrusion 306FL and/or forefoot medial protrusion 306FM of the midsole component 300. Rather, at the locations of the forefoot lateral protrusion 306FL and/or forefoot medial protrusion 306FM, the exterior sole component 400 extends downward and does not completely extend around (and does not completely surround) an outer perimeter of the lateral forefoot protrusion 306FL and/or the medial forefoot protrusion 306FM. Note regions 420FL and 420FM of the exterior sole component 400 as shown in FIGS. 1A, 3, and 6A-6F. Thus, as shown in the figures, the top edge 420 of the exterior sole component 400 extends: (i) along a bottom perimeter edge 320FL of the lateral forefoot protrusion 306FL, and (ii) along a bottom perimeter edge 320FM of the medial forefoot protrusion 306FM. In this manner, the exterior sole component 400 does not extend between: (a) the top perimeter edge 306TL of the forefoot lateral protrusion 306FL and the instep area 200I of the upper component 200 and/or (b) the top perimeter edge 306TM of the forefoot medial protrusion 306FM of the midsole component 300 and the instep area 200I of the upper component 200. While the size, shape, and positioning of the top edge 420 of the exterior sole component 400 can vary, the absence of the exterior sole component 400 at these locations (e.g., at the first and fifth metatarsal head regions of the upper component 200) can help improve the flexibility and natural motion of the article of footwear 100, e.g., when taking a step.

FIGS. 6C and 6D illustrate additional or alternative potential features of the bottom surface 410B of exterior sole component 400 in accordance with some examples of this technology. As shown in FIG. 6C, the bottom surface 410B (the ground-facing surface) of this example exterior sole component 400 is formed (e.g., by molding techniques, such as injection molding) to include one or more recesses (three recesses 430H, 430M, 430F shown in the example of FIG. 6C). Other areas of the bottom surface 410B are formed (e.g., molded) to include one or more traction elements 430T thereon. Any desired number, size, shape, and/or other features may be provided in the traction element(s) in different specific examples of this technology.

Then, as shown in FIG. 6D, additional sole element components (e.g., three sole element components 432H, 432M, and 432F) may be fit into the corresponding recesses (e.g., 430H, 430M, 430F). The bottom surface(s) of the additional sole element components (e.g., 432H, 432M, and 432F) may include additional traction elements 432T, e.g., of the same or different type from the traction element(s) 430T on the main exterior sole component 400. In this manner, if desired, the additional sole element components 432H, 432M, 432F may be formed from a harder and/or more durable material, e.g., to improve wear resistance, abrasion resistance, etc. while not adversely affecting the overall flexibility and/or stretchability of the exterior sole component 400 (e.g., around its openings 406RHL, 406RHM, 406FHL, 406FHM, 406ML, 406MM, 406FTL, 406FTM). Additionally or alternatively, as part of potential modular construction features, different sole element components 432H, 432M, 432F may be selected to provide different traction element 432T types and/or arrangements (e.g., different traction element 432T types and/or arrangements depending on the intended end use of the article of footwear 100 (e.g., sport or use specific traction element 432T patterns or types), etc.).

Alternatively, if desired, separate additional sole element components 432H, 432M, 432F may be omitted, and the bottom surface 410B of the main exterior sole component 400 may be directly formed to include the additional traction elements 432T (e.g., as a single material component) and/or may be formed to include harder and/or more durable portions. For example, if desired, sole elements 432H, 432M, 432F may be co-molded with the material forming the remainder of exterior sole component 400 such that sole elements 432H, 432M, 432F fuse or otherwise bond to the remainder of the exterior sole component 400 during the co-molding process. The exterior sole component 400 may comprise a thermoplastic polyurethane component (even if made with different TPU materials during a co-molding process). The exterior sole component 400 (or at least a ground-contacting surface thereof) may have sufficient durability, hardness, and/or other properties to function as a footwear outsole component.

Figure 7A:
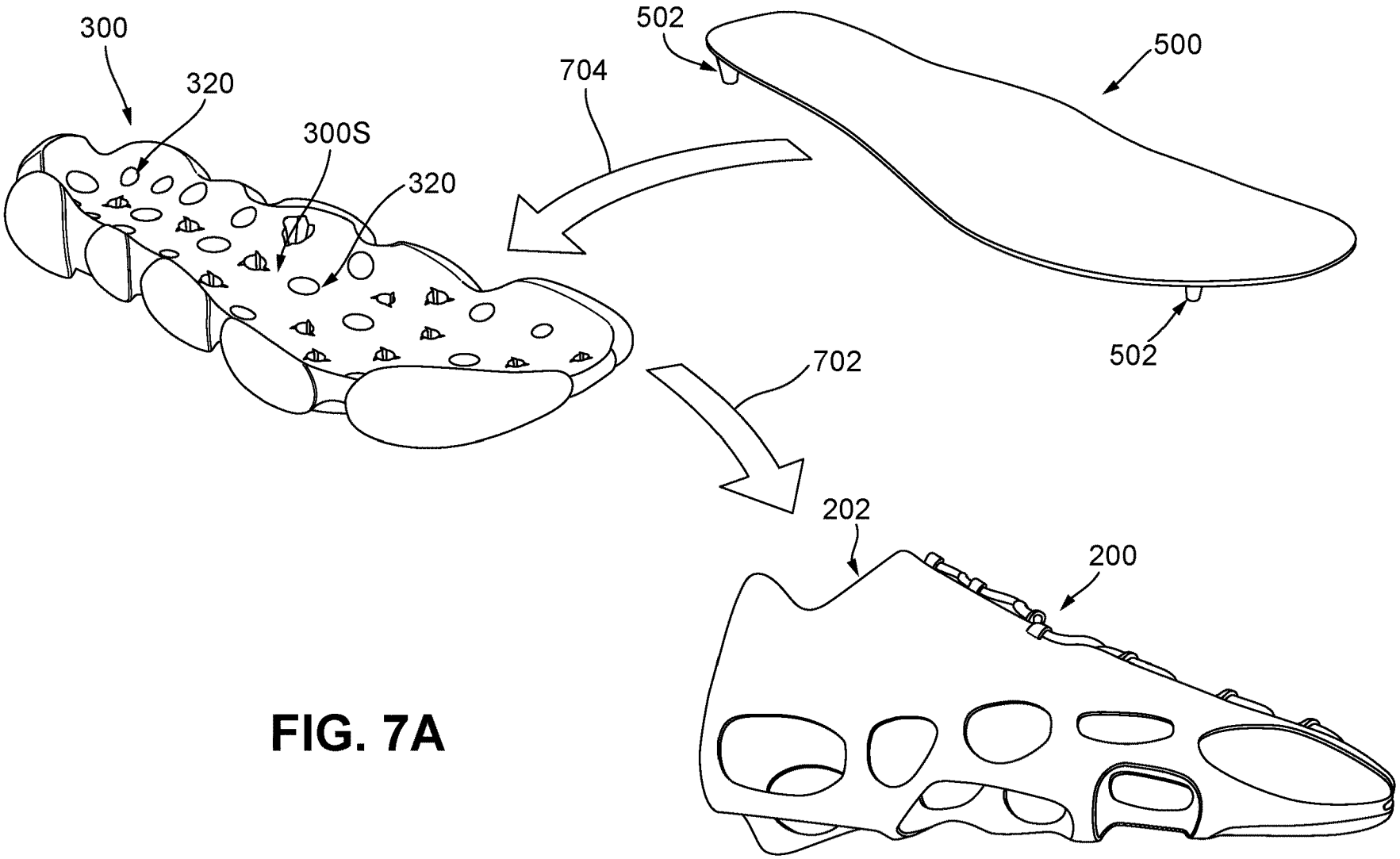
FIGS. 7A-7K provide various views showing assembly of articles of footwear in accordance with some aspects of this technology.
Figure 7B:
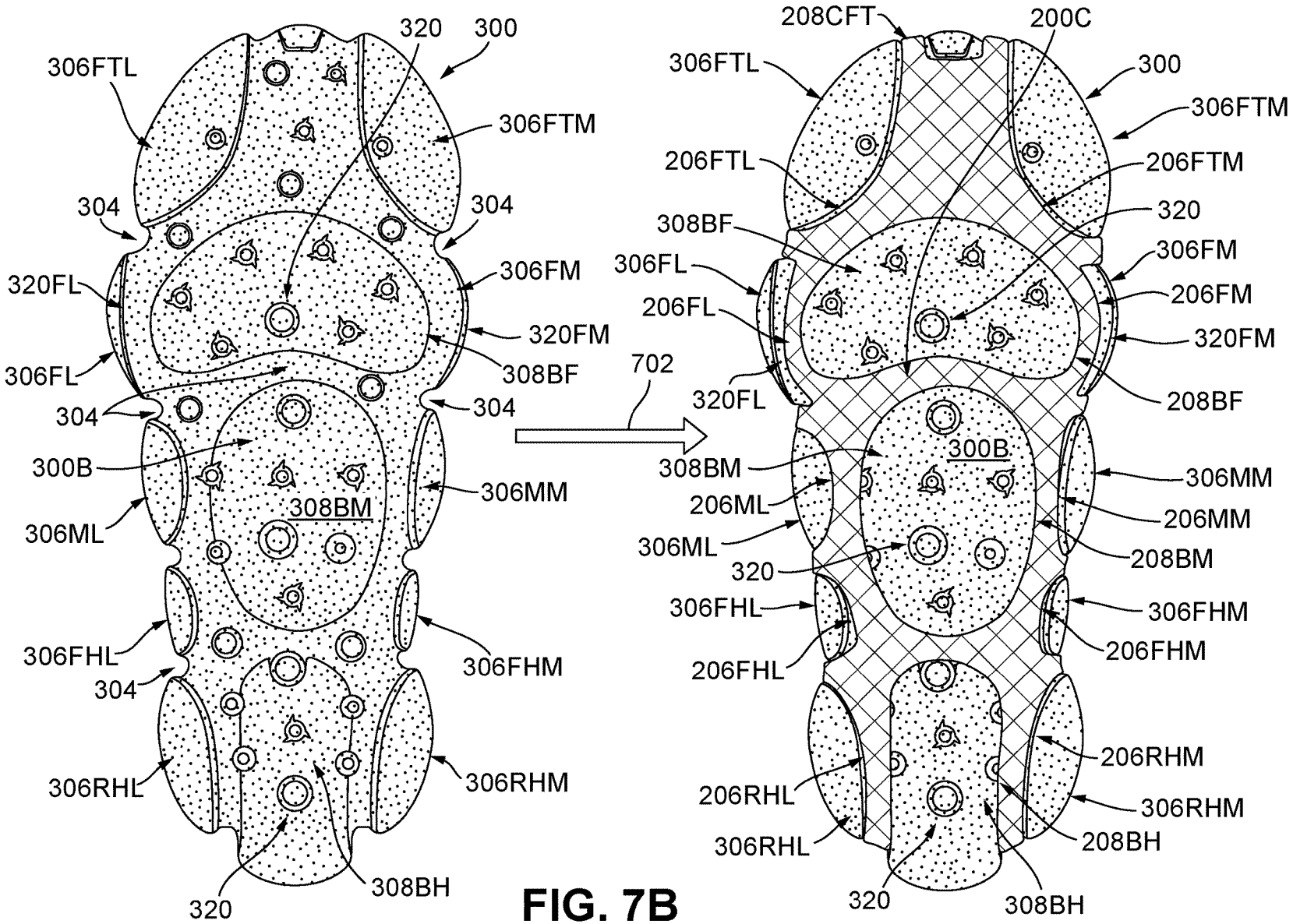

Assembly of articles of footwear 100 in accordance with some examples of this technology now will be described in conjunction with FIGS. 7A-8C. To avoid obscuring the information being conveyed, not all reference numbers referred to with respect to FIGS. 1A-6H are included in FIGS. 7A-8C. As one part of the process, the overall upper for the article of footwear 100 will be assembled. To do so, the midsole component 300 is inserted into the interior chamber 202 of the upper component 200 and arranged so that the various projections of the midsole component 300 extend through corresponding openings of the upper component 200. This assembly step is shown in FIGS. 7A and 7B by arrow 702. While any number and/or arrangement of midsole component 300 projections and upper component 200 openings may be used, in this specifically illustrated example: (a) rear heel lateral protrusion 306RHL will extend through rear heel lateral opening 206RHL, (b) rear heel medial protrusion 306RHM will extend through rear heel medial opening 206RHM, (c) forward heel lateral protrusion 306FHL will extend through forward heel lateral opening 206FHL, (d) forward heel medial protrusion 306FHM will extend through forward heel medial opening 206FHM, (e) midfoot lateral protrusion 306ML will extend through midfoot lateral opening 206ML, (f) midfoot medial protrusion 306MM will extend through midfoot medial opening 206MM, (g) forefoot lateral protrusion 306FL will extend through forefoot lateral opening 206FL, (h) forefoot medial protrusion 306FM will extend through forefoot medial opening 206FM, (i) forward toe lateral protrusion 306FTL will extend through forward toe lateral opening 206FTL, (j) forward toe medial protrusion 306FTM will extend through forward toe medial opening 206FTM, (k) bottom heel protrusion 308BH will extend through bottom heel opening 208BH, (l) bottom midfoot protrusion 308BM will extend through bottom midfoot opening 208BM, and (m) bottom forefoot protrusion 308BF will extend through bottom forefoot opening 208BF. Note also the engaged upper component 200 and midsole component 300 features shown in FIGS. 1A and 2A-3. FIG. 7B also illustrates this step 702, showing a bottom view of the midsole component 300 outside of the upper component 200 on the left side of FIG. 7B and inside the upper component 200 on the right side of FIG. 7B.

In some examples of this technology, an insole component 500 may be engaged with the top surface 300S of the midsole component 300, e.g., as shown by arrow 704 in FIG. 7A. As described above in conjunction with FIGS. 5A-5G, the bottom surface 500B of the insole component 500 may include one or more projections 502 that fit into corresponding recesses 320 (e.g., forming interior bonds 322) formed in the top surface 300S of midsole component 300. Such projections 502, when present, may help prevent the insole component 500 from moving with respect to the midsole component 300 within the interior chamber 202 of the article of footwear 100. Thus, in some examples of this technology, the insole component 500 may be incorporated into the article of footwear 100 structure in an adhesive-free manner (and may be removably engaged with the midsole component 300). The insole component 500, when present, may be engaged with the top surface 300S of the midsole component 300 before or after the midsole component 300 is placed inside the interior chamber 202 of the upper component 200 (and before or after the exterior sole component 400 is attached).

Figure 7C:
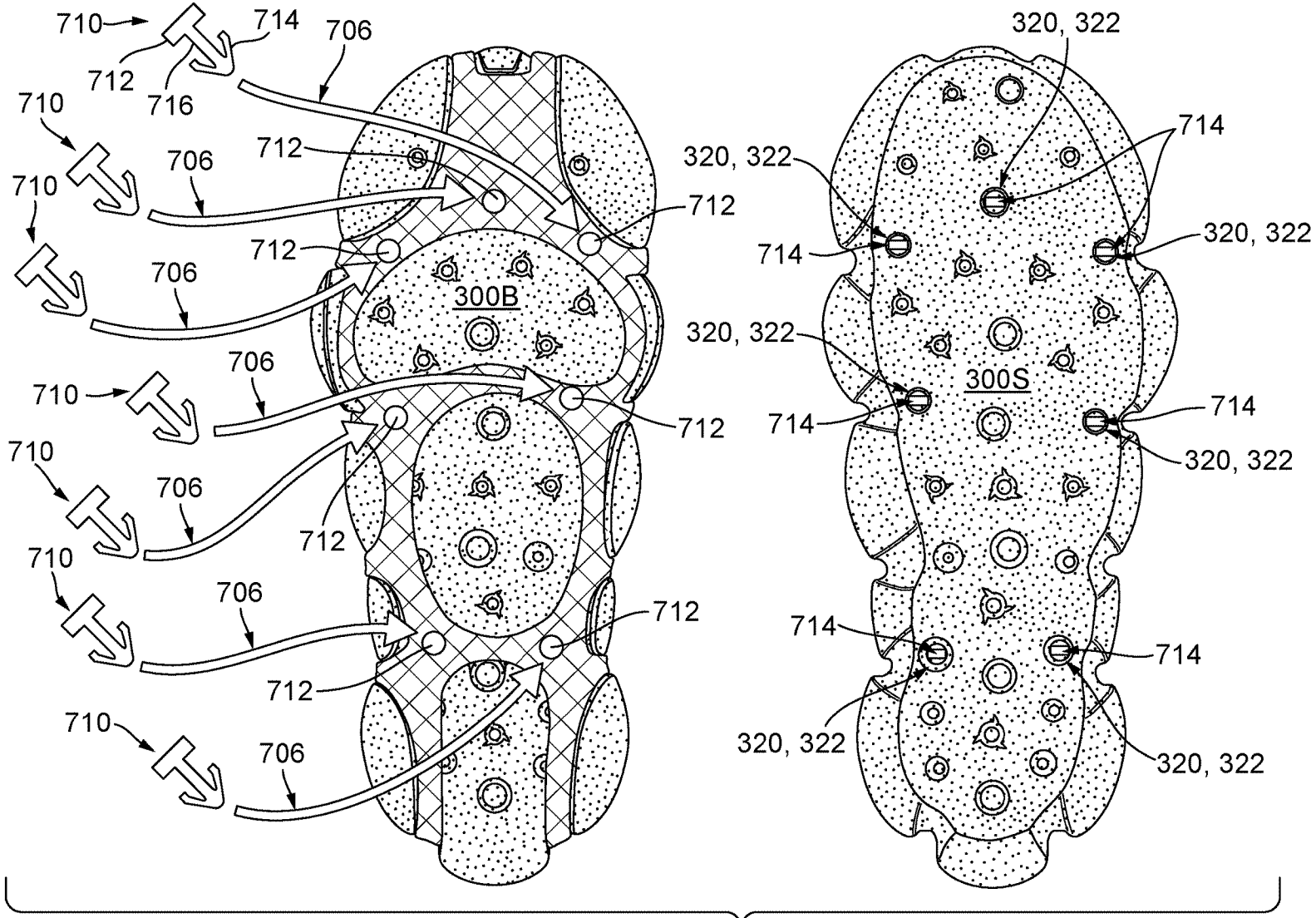

Next, as shown in FIG. 7C, the upper component 200 (e.g., a fabric component) may be fixed to the midsole component 300. As described above, in some examples of this technology, the midsole component 300 may be filled with a gas and interior bonds 322 (e.g., welded bonds) may be provided, e.g., to control the shape of the midsole component 300. These interior bonds 322 constitute locations where interior surfaces 310B and 312B of midsole layers 310 and 312, respectively, are bonded to one another. Note the interior bonds 322 shown and described above in conjunction with FIGS. 4H to 4M. Openings can be formed (e.g., drilled, punched, cut, etc.) through the upper component 200 (e.g., its connecting structure 200C) and the interior bonds 322, and retaining connector components 710 can be pushed through the openings. See arrows 706 in FIG. 7C. While any desired number and/or types of connector structures may be provided, the illustrated example includes seven total connector components 710—two in the heel area (one on each side), two in the midfoot to forefoot area (one on each side), and three spaced across the forefoot area.

These illustrated connector components 710 may be formed from a plastic material (e.g., a TPU) and may include a head end 712 and a retaining end 714 opposite the head end 712, connected by a shaft 716. In this example assembled combination, the head end 712 is located at the bottom surface 300B of the midsole component 300 and outside the connecting structure 200C of the upper component 200. When inserted through upper component 200 and the midsole component 300 (through the interior bond 322), the retaining end 714 draws together until it passes through the opening at the top surface 300S of the midsole component 300. Once the retaining end 714 moves completely through the midsole component 300, the retaining end 714 re-expands outward again (e.g., to the configuration shown in FIG. 7C). The shaft 716 extends through the upper component 200 and the interior bond 322, and the head end 712 and retaining end 714 are located at opposite surfaces of the combined upper component 200 and midsole component 300 structure. In this manner, the head end 712 and the retaining end 714 prevent the connector component 710 from pulling through the midsole component 300 and upper component 200 in either direction to thereby retain the connector component 710 within the upper component 200 and the midsole component 300. The left and center of FIG. 7C shows the bottom surface 300B of the midsole component 300 with the upper component 200 attached by connector components 710 (with the connector component 710 head end 712 visible and exposed at the bottom). The right side of FIG. 7C shows the top surface 300S of the midsole component 300 with the retaining ends 714 extending through the interior bonds 322. The upper component 200 and the insole component 500 are not shown in the right side of FIG. 7C so that the retaining end 714 is visible. Alternatively, if desired, one or more connector components 710 may be inserted through the midsole component 300 and the upper component 200 in the opposite direction (with the head end 712 located at top surface 300S and the retaining end 714 located at the bottom surface 300B and at the connecting structure 200C). Additionally or alternatively, other connector component 710 structures may be used, including nuts and bolts, snaps, pins, rivets, etc.

Figure 7D:
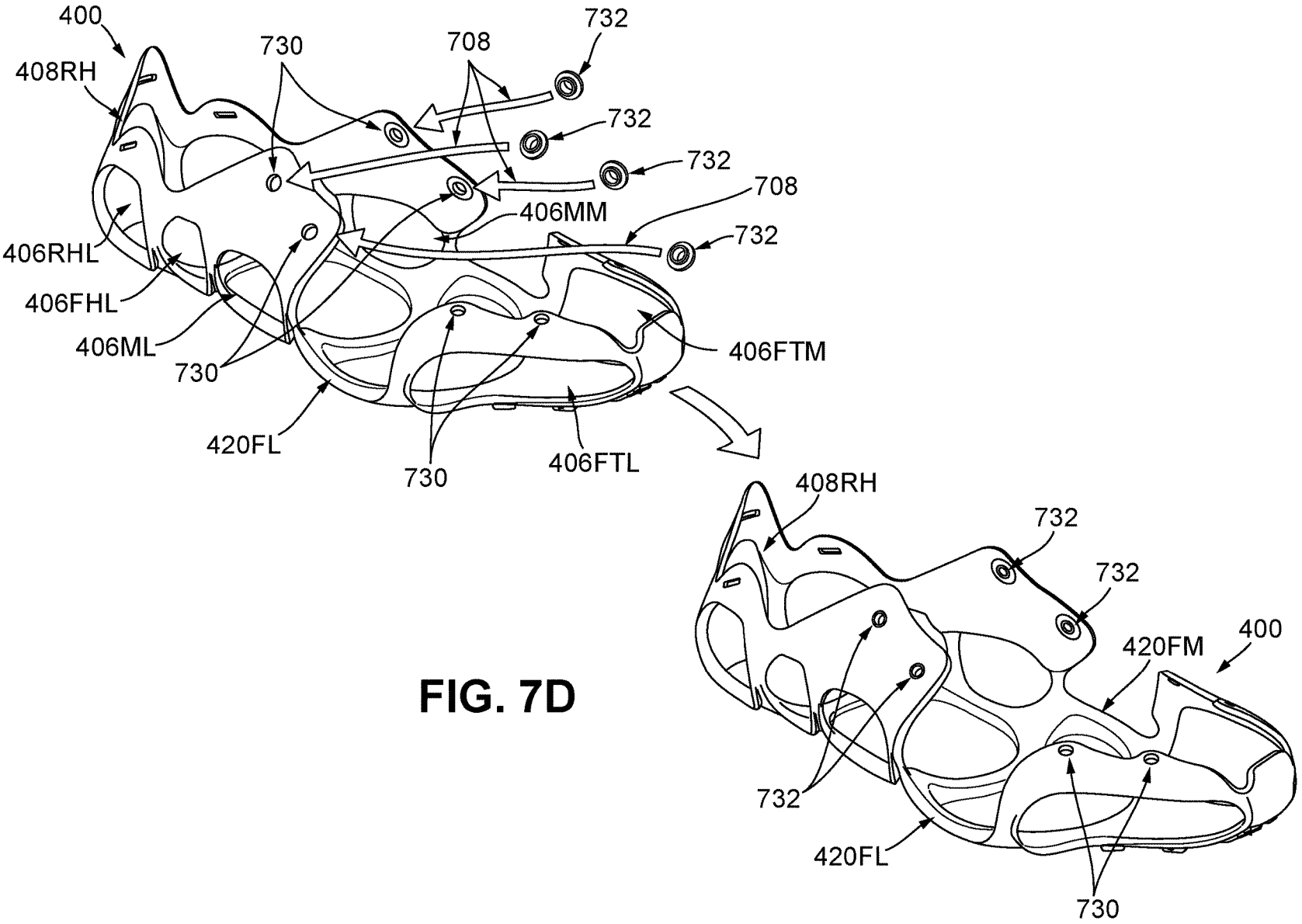

FIG. 7D shows a step in creating the exterior sole component 400 in accordance with some examples of this technology. As noted above, the exterior sole component 400 may be made by molding techniques, such as injection molding, co-molding to form exterior sole component 400 with bottom elements 432H, 432M, 432F, etc. FIG. 7D and other figures described above show lace-engaging elements 730 provided on the lateral side 400L and the medial side 400M of the exterior sole component 400. The specific example of FIG. 7D shows two lace-engaging elements 730 in the lateral instep region located near the top edge 420 of the exterior sole component 400 and upward (and/or inward) from forward heel lateral opening 406FHL and/or midfoot lateral opening 406ML. One or more similar lace-engaging elements 730 may be provided on the medial side 400M, e.g., in the medial instep region located near the top edge 420 of the exterior sole component 400 and upward (and/or inward) from forward heel medial opening 406FHM and/or midfoot medial opening 406MM. Additionally or alternatively, one or more lace-engaging elements 730 may be provided on the lateral side 400L, e.g., near the top edge 420 of the exterior sole component 400 and upward (and/or inward) from the forward toe lateral opening 406FTL, and/or one or more lace-engaging elements 730 may be provided on the medial side 400M, e.g., near the top edge 420 of the exterior sole component 400 and upward (and/or inward) from forward toe medial opening 406FTM. While the figures show lace-engaging elements 730 as holes formed through the exterior sole component 400, other types of lace-engaging elements could be used, such as hardware parts, loop elements, etc.

If necessary, eye stay reinforcing elements 732 may be provided in one or more of the lace-engaging elements 730 of the exterior sole component 400. FIG. 7D shows engagement of eye stay reinforcing elements 732 with the exterior sole component 400 as arrows 708. In this illustrated example, the separate eye stay reinforcements 732 are provided only with the rearward instep based lace-engaging elements 730 (and not with the more forward forefoot based lace-engaging elements 730). Any desired type of eye stay reinforcement(s) 732 may be provided. In this illustrated example, the eye stay reinforcements 732 are provided as metal or plastic rings applied within holes in the exterior sole component 400 used as lace-engaging elements 730. The eye stay reinforcements 732 may be attached, e.g., by crimping the metal or plastic in the hole 730, by clips, by other mechanical fastening structures, by adhesives, etc.

Figure 7E:
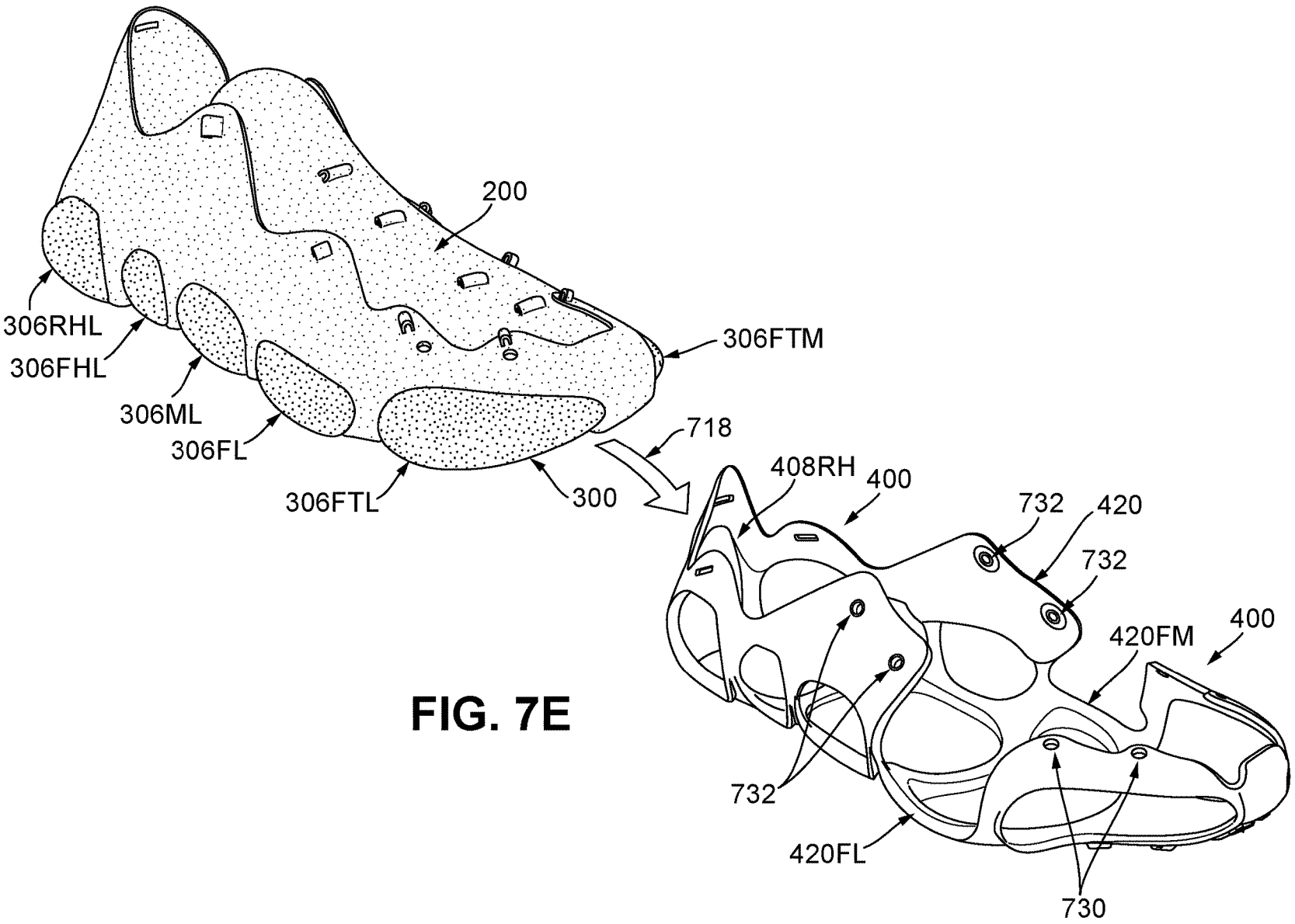
Figure 7F:
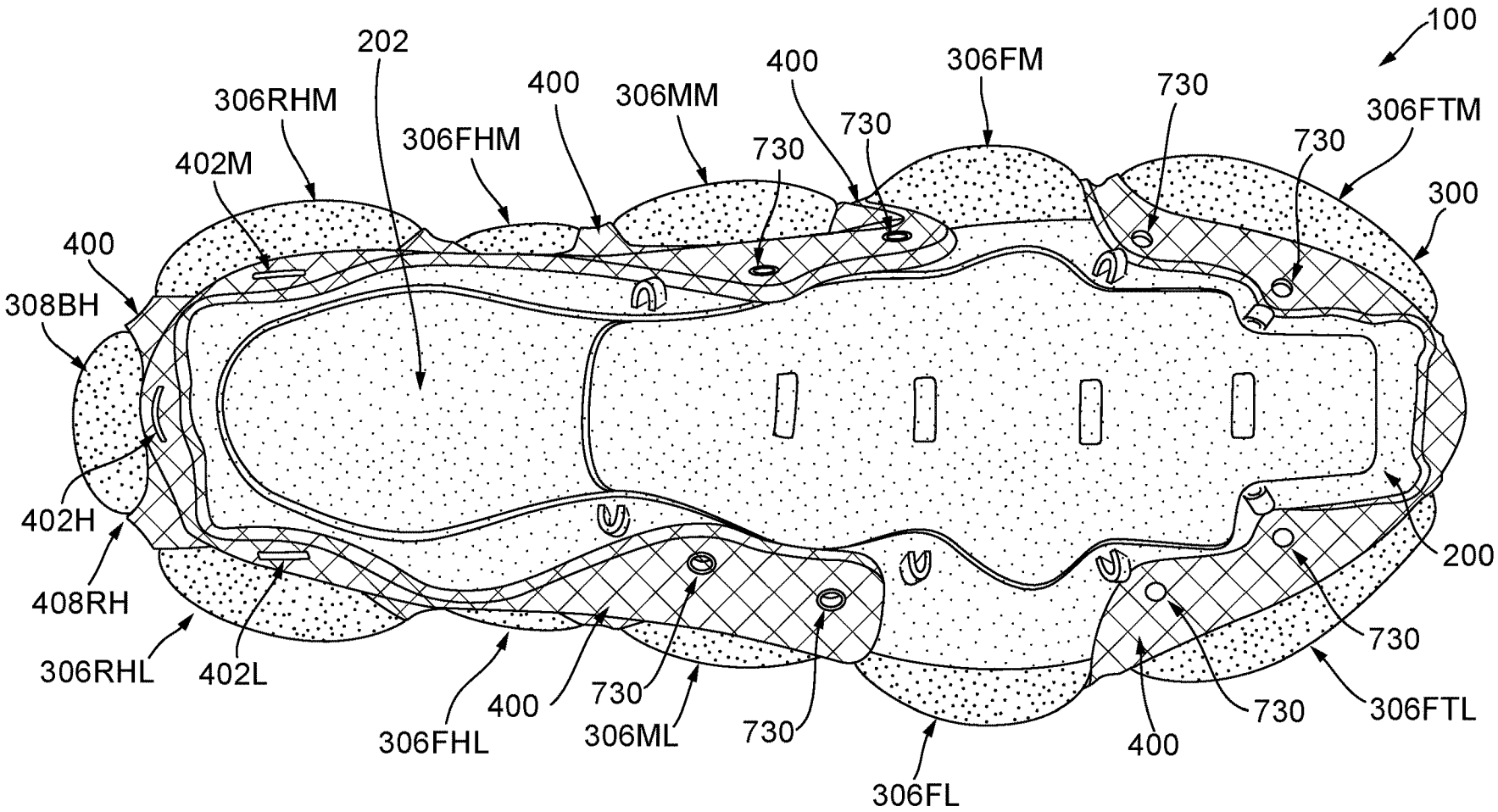
Figure 7G:
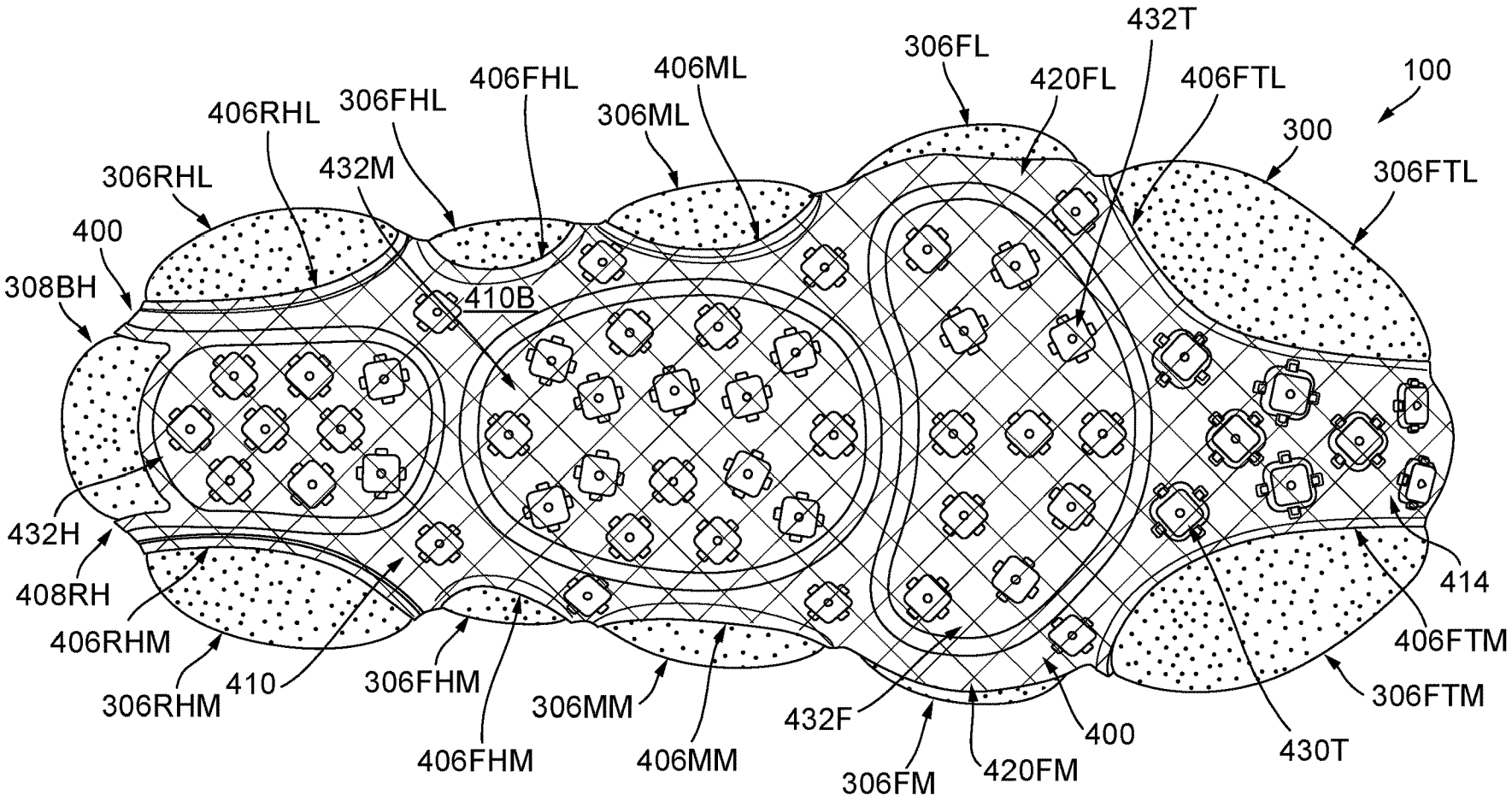

Once the exterior sole component 400 is ready, the combined upper component 200 and midsole component 300 (optionally with insole component 500 engaged therewith) may be inserted into the exterior sole component 400, as shown by arrow 718 in FIG. 7E. The projection(s) of the midsole component 300 can be inserted into and through corresponding opening(s) of the exterior sole component 400. In this illustrated example: (a) rear heel lateral protrusion 306RHL will extend through rear heel lateral opening 406RHL, (b) rear heel medial protrusion 306RHM will extend through rear heel medial opening 406RHM, (c) forward heel lateral protrusion 306FHL will extend through forward heel lateral opening 406FHL, (d) forward heel medial protrusion 306FHM will extend through forward heel medial opening 406FHM, (e) midfoot lateral protrusion 306ML will extend through midfoot lateral opening 406ML, (f) midfoot medial protrusion 306MM will extend through midfoot medial opening 406MM, (g) forward toe lateral protrusion 306FTL will extend through forward toe lateral opening 406FTL, (h) forward toe medial protrusion 306FTM will extend through forward toe medial opening 406FTM, and (i) bottom heel protrusion 408BH will extend through rear heel opening 408RH. As mentioned above, the exterior sole component 400 of this example does not include an opening that completely surrounds the forefoot lateral protrusion 306FL and/or the forefoot medial protrusion 306FM. Rather, the exterior sole component 400 includes open space above the top edge 420 of the exterior sole component 400 at regions 420FL and 420FM, which extend beneath forefoot lateral protrusion 306FL and forefoot medial protrusion 306FM, respectively. See FIGS. 7F-7K.

Further, in the example of FIGS. 1A-7K, the bottom surface 410B of the exterior sole component 400 covers at least 50% of the surface area of the bottom heel protrusion 308BH, the bottom midfoot protrusion 308BM, and/or the bottom forefoot protrusion 308BF located at the bottom surface 300B of the midsole component 300. In this manner, the exterior sole component 400 also will cover at least 50% of the surface area of the upper component 200 located at the bottom surface of the upper component 200 (e.g., the portion(s) of the upper component 200 located in recesses 304 between and around the bottom heel protrusion 308BH, the bottom midfoot protrusion 308BM, and/or the bottom forefoot protrusion 308BF. In some examples, even more than 50% of the surface areas of the bottom surface 300S of the midsole component 300 and/or the bottom surface of the upper component 200 may be covered by the bottom of the exterior sole component 400, such as at least 60%, at least 70%, at least 80%, at least 90%, or even at least 95% of either surface area.

Figure 7H:
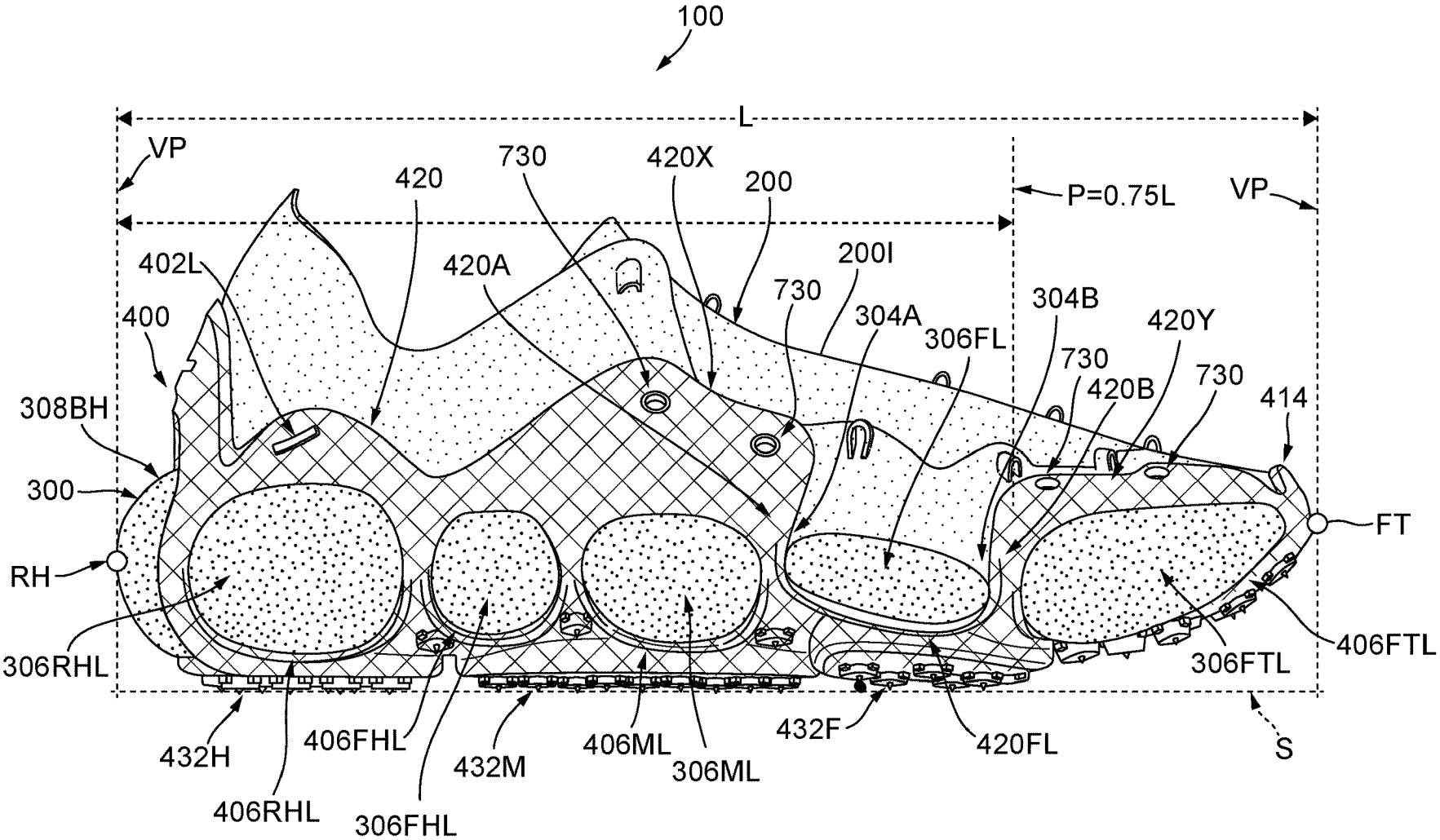

FIGS. 7F-7K provide a top view, bottom view, lateral side view, medial side view, toe view, and heel view, respectively, of an assembled article of footwear 100 in accordance with some examples of this technology. As shown in these figures, the exterior sole component 400 of this example does not include an opening that completely surrounds the forefoot lateral protrusion 306FL and/or the forefoot medial protrusion 306FM. For example, looking at the lateral side view of FIG. 7H, one can see that the article of footwear 100 includes a first protrusion 306ML, a second protrusion 306FL adjacent the first protrusion 306ML and separated from it by a first recess 304A of the midsole component 300, and a third protrusion 306FTL adjacent the second protrusion 306FL and separated from it by a second recess 304B of the midsole component 300. Thus, this example exterior sole component 400 includes: (i) a first hole (e.g., opening 406ML) through which the first protrusion 306ML extends, (ii) a second hole (e.g., opening 406FTL) through which the third protrusion 306FTL extends, and (iii) a first continuous sole portion extending from the first protrusion 306ML to the third protrusion 306FTL and including a portion 420A extending into the first recess 304A, a portion 420FL extending beneath the second protrusion 306FL, and a portion 420B extending through the second recess 304B. Thus, as further shown in FIG. 7H, the exterior sole component 400 does not extend between the top perimeter of the second protrusion 306FL and the instep region 200I of the upper component 200. Further, as shown in FIG. 7H, a continuous perimeter edge (e.g., top edge) of the exterior sole component 400 includes:

(i) a first top edge portion 420X located above the first protrusion 306ML and along the instep region 200I of the upper component 200 (this first top edge portion 420X may include one or more lace-engaging components 730), (ii) a first intermediate portion including: (a) portion 420A extending into the first recess 304A between the first protrusion 306ML and the second protrusion 306FL (rearward of a rearward edge of the second protrusion 306FL), (b) portion 420FL extending along a bottom surface of the second protrusion 306FL, and (c) a portion 420B extending into second recess 304A between second protrusion 306FL and third protrusion 306FTL (forward of a forward edge of the second protrusion 306FL), and (iii) a second top edge portion 420Y extending to a forward toe region of the upper component 200 (this second top edge portion 420Y may include one or more lace-engaging components 730).

Figure 7I:
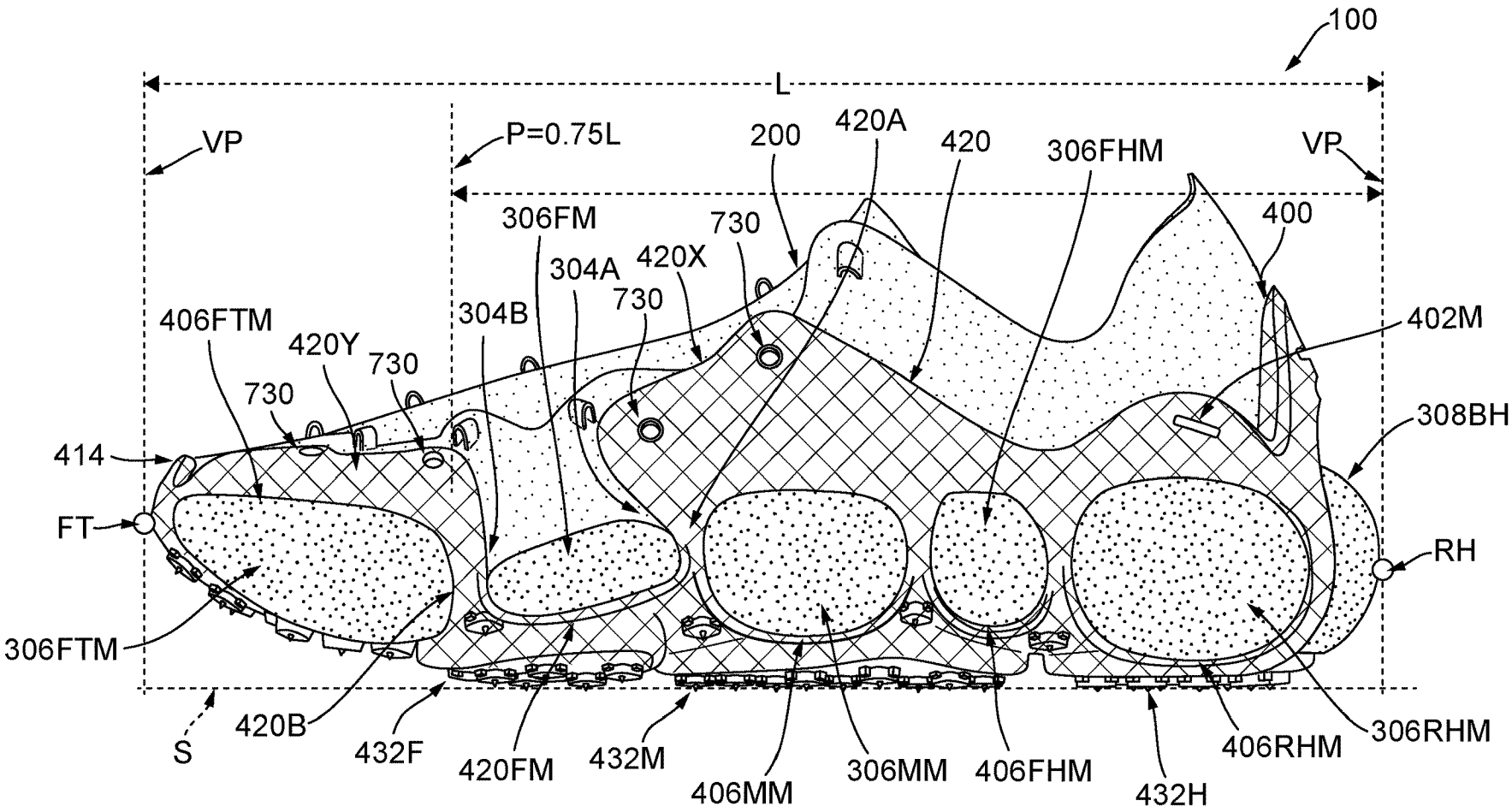
Figure 7K:
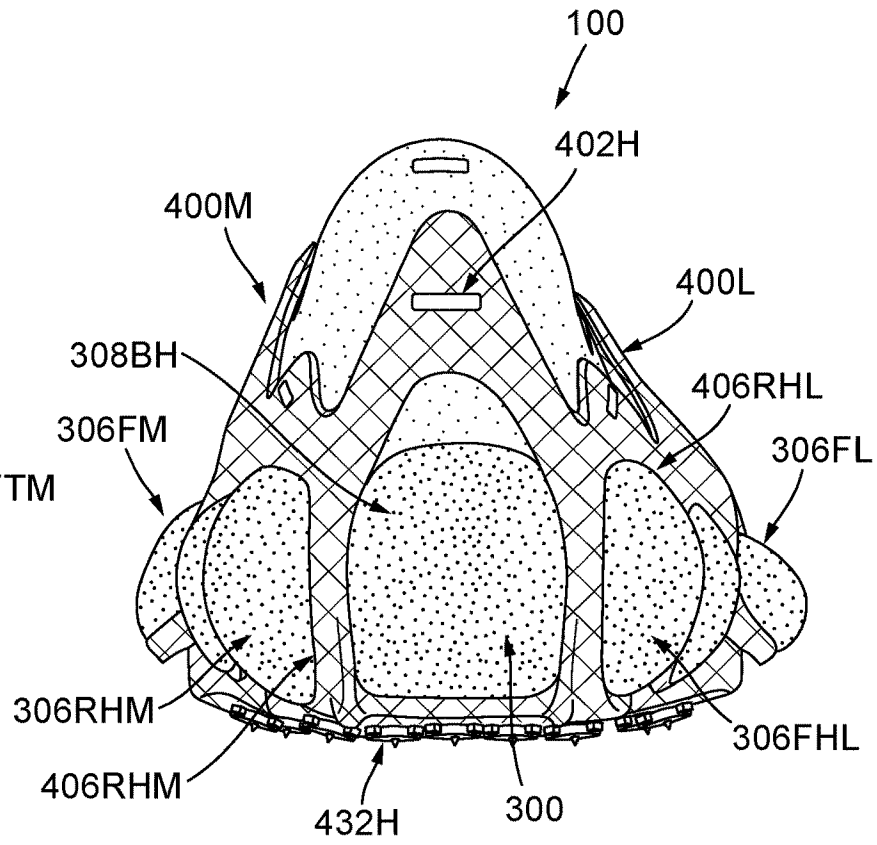
Figure 7J:
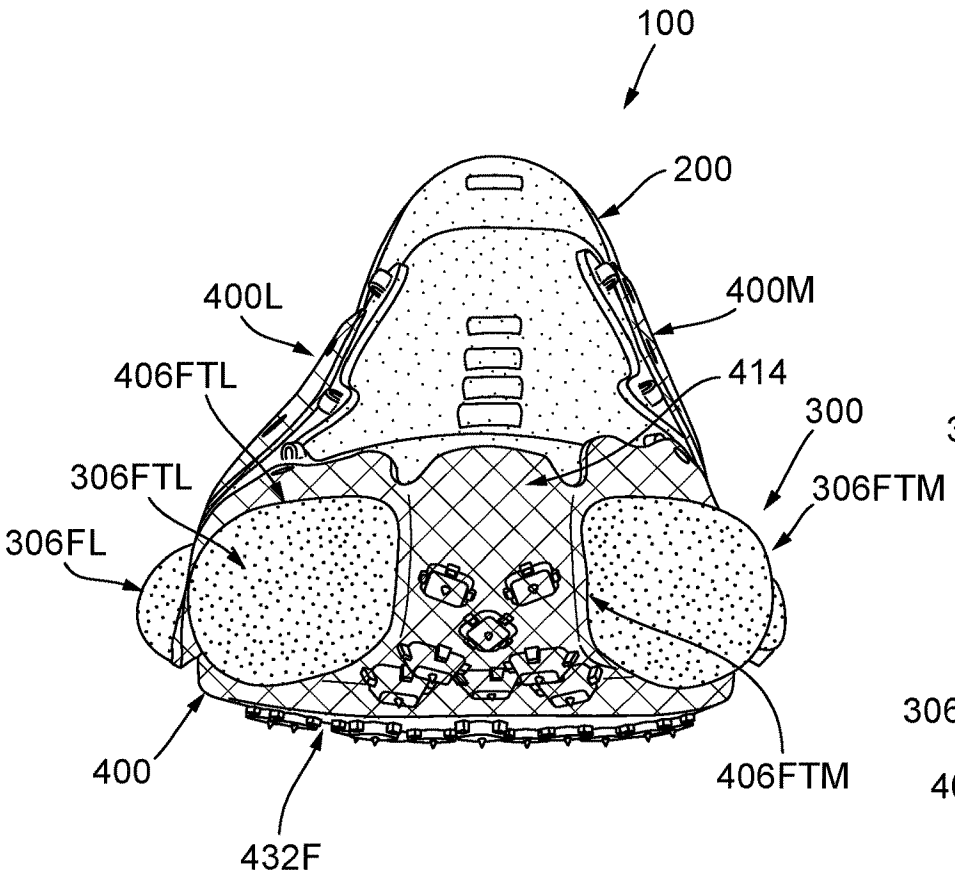

Similarly, looking at the medial side view of FIG. 7I, one can see that the medial side of the article of footwear 100 includes a first protrusion 306MM, a second protrusion 306FM adjacent the first protrusion 306MM and separated from it by a first recess 304A of the midsole component 300, and a third protrusion 306FTM adjacent the second protrusion 306FM and separated from it by a second recess 304B of the midsole component 300. Thus, the medial side of this example exterior sole component 400 includes: (i) a first hole (e.g., opening 406MM) through which the first protrusion 306MM extends, (ii) a second hole (e.g., opening 406FTM) through which the third protrusion 306FTM extends, and (iii) a first continuous sole portion extending from the first protrusion 306MM to the third protrusion 306FTM and including a portion 420A extending into the first recess 304A, a portion 420FM extending beneath the second protrusion 306FM, and a portion 420B extending through the second recess 304B. Thus, as further shown in FIG. 7I, the exterior sole component 400 does not extend between the top perimeter of the second protrusion 306FM and the instep region 200I of the upper component 200. Further, as shown in FIG. 7I, a continuous perimeter edge (e.g., top edge) of the exterior sole component 400 on the medial side includes:

(i) a first top edge portion 420X located above the first protrusion 306MM and along the instep region 200I of the upper component 200 (this first top edge portion 420X may include one or more lace-engaging components 730), (ii) a first intermediate portion including: (a) portion 420A extending into the first recess 304A between the first protrusion 306MM and the second protrusion 306FM (rearward of a rearward edge of the second protrusion 306FM), (b) portion 420FM extending along a bottom surface of the second protrusion 306FM, and (c) a portion 420B extending into second recess 304A between second protrusion 306FM and third protrusion 306FTM (forward of a forward edge of the second protrusion 306FM), and (iii) a second top edge portion 420Y extending to a forward toe region of the upper component 200 (this second top edge portion 420Y may include one or more lace-engaging components 730).

In at least some examples of this technology, the second top edge portion 420Y on the lateral side of the exterior sole component 400 may meet up with the second top edge portion 420Y on the medial side of the exterior sole component 400 such that the top edge portions 420Y meet at the forward toe region of the upper component 200 and form a continuous edge of the exterior sole component 400. This front portion of the exterior sole component 400 may form an interior recess into which the front and top (e.g., the forward toe portion) of the upper component 200 extends.

In the example structure shown in FIG. 7H, one or more lace-engaging components 730 are provided with the exterior sole component 400 both rearward of protrusion 306FL and forward of protrusion 306FL. Additionally or alternatively, in the example structure shown in FIG. 7I, one or more lace-engaging components 730 are provided with the exterior sole component 400 both rearward of protrusion 306FM and forward of protrusion 306FM. Also, in at least some examples of this technology, the forwardmost lace-engaging components 730 (e.g., those located forward of protrusions 306FL and 306FM on upper component portion 420Y) may be located forward of a parallel plane located at P=0.7L, and in some examples, forward of a parallel plane located at P=0.75L, forward of a parallel plane located at P=0.8L, or even forward of a parallel plane located at 0.84L.

As described above, the exterior sole component 400 of this example does not include an opening that completely surrounds the forefoot lateral protrusion 306FL and/or the forefoot medial protrusion 306FM. Thus, as shown in FIGS. 7H and 7I there is a lateral gap and a medial gap in the exterior sole component 400 between the rearward portion 420X of the exterior sole component 400 and the forward portion 420Y of the exterior sole component 400, and the tops of protrusions 306FL and 306FM are exposed in these respective gaps. The rearwardmost extent of these gaps (e.g., the location of the edge of portion 420A) may be located forward of a parallel plane located at 0.52L and rearward of a parallel plane located at 0.65L. The forwardmost extent of these gaps (e.g., the location of the edge of portion 420B) may be located forward of a parallel plane located at 0.7L and rearward of a parallel plane located at 0.8L. These gaps also may extend in the longitudinal direction L of the article of footwear 100 for a distance of at least 0.1L and/or less than 0.25L.

Figure 8A:
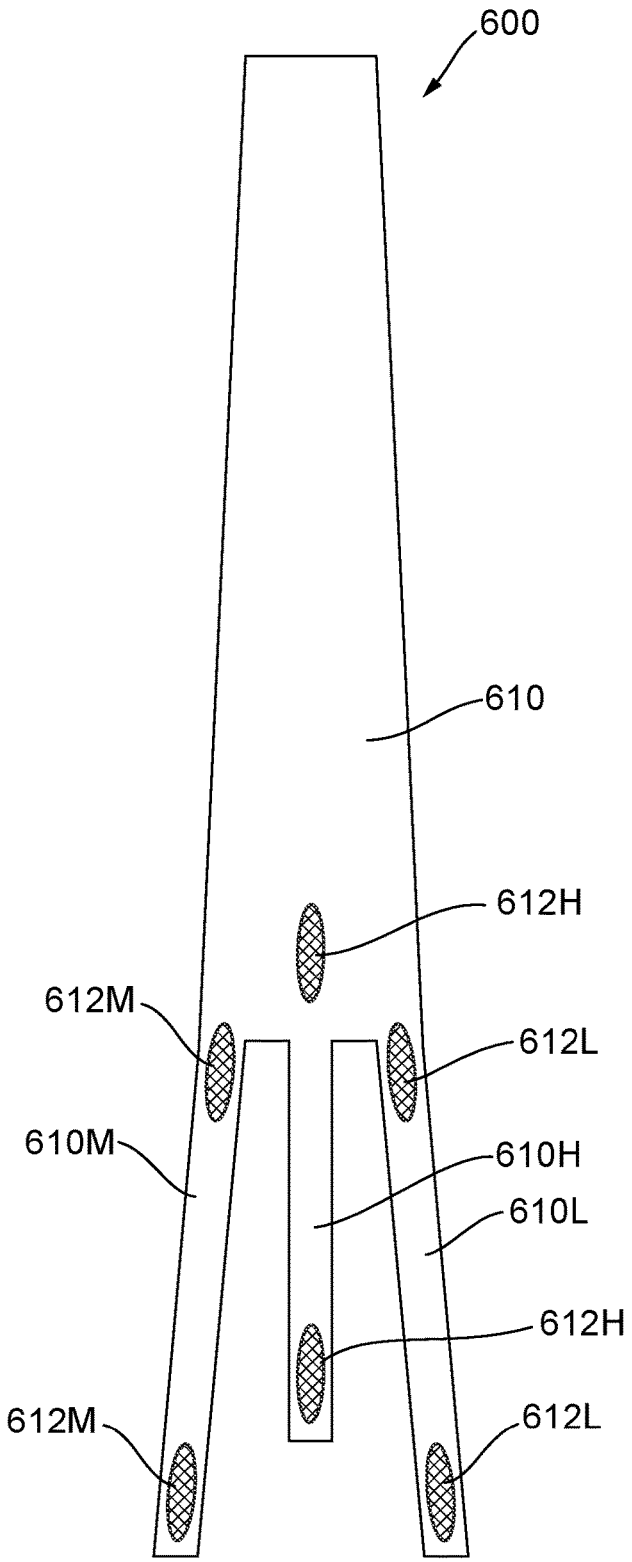
FIGS. 8A-8C illustrate a pull tab component and its engagement with an article of footwear in accordance with some aspects of this technology.
Figure 8B:
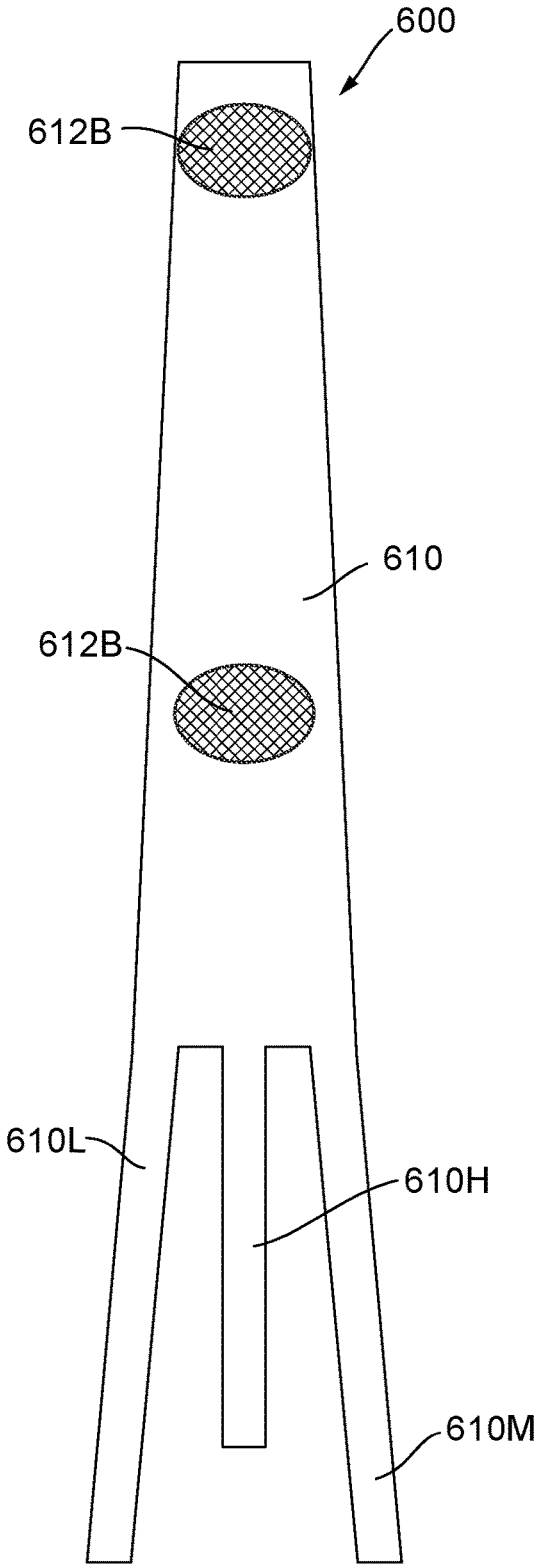
Figure 8C:
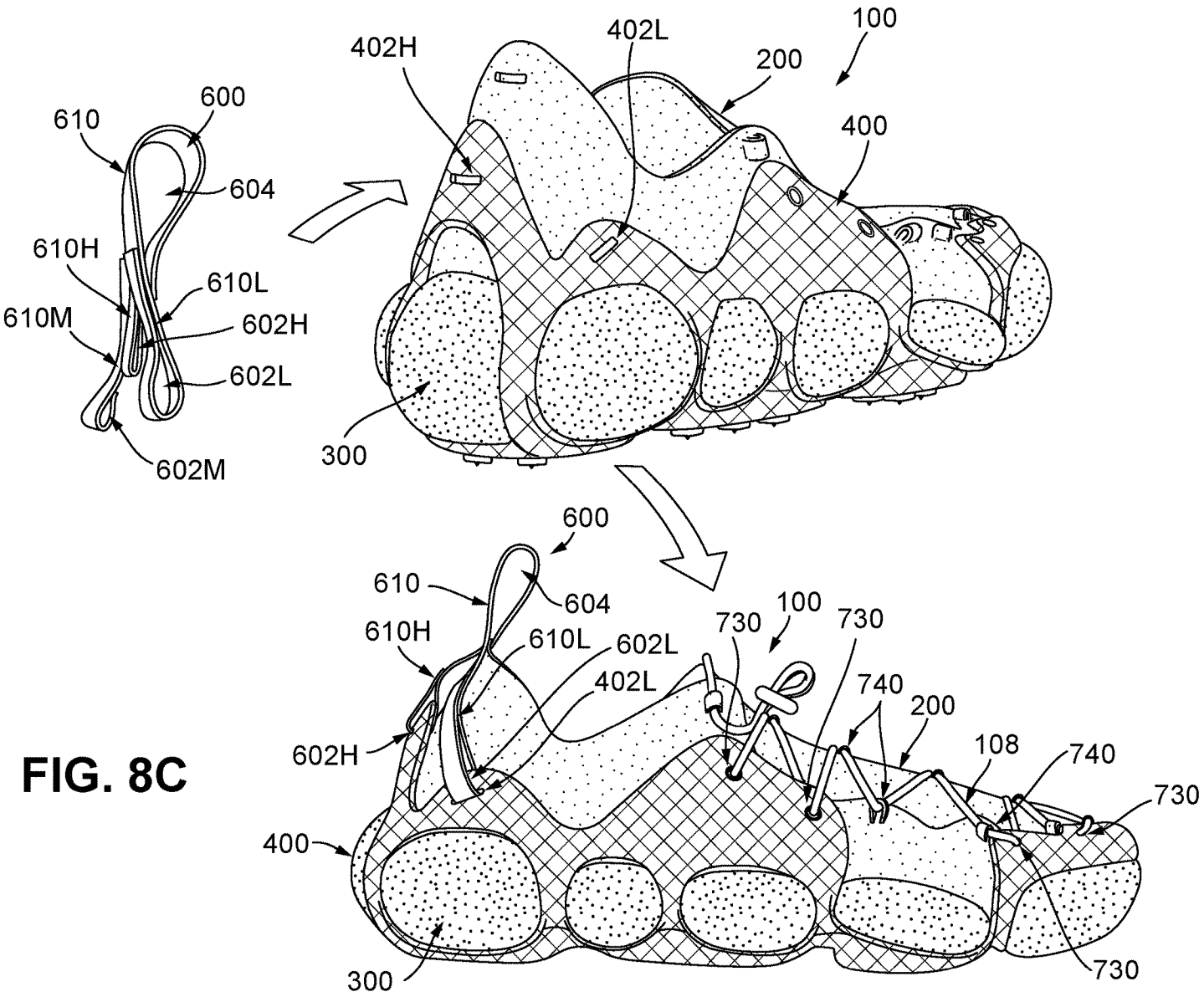

Other potential features of assembly of articles of footwear 100 in accordance with some examples of this technology will be described with reference to FIGS. 8A-8C. FIGS. 8A and 8B illustrate opposite sides of a pull tab 600 that may be provided at a rear heel area of an article of footwear 100. This example pull tab 600 includes a base portion 610 and three straps 610L, 610H, and 610M extending from the base portion 610 at one end. This illustrated example includes releasable fasteners, such as hook-and-loop fasteners, snap fasteners, button fasteners, etc. In use, as also shown in FIG. 8C, strap 610L is placed through opening 402L of the exterior sole component 400 and fasteners 612L are engaged to form loop 602L. Similarly, strap 610M is placed through opening 402M of the exterior sole component 400 and fasteners 612M are engaged to form loop 602M and strap 610H is placed through opening 402H of the exterior sole component 400 and fasteners 612H are engaged to form loop 602H. The base fasteners 612B also are engaged to form the main loop 604. The pull tab 600 allows the wearer to pull the article of footwear 100 onto his or her foot as the pull tab 600 is connected to the exterior sole component 400, which in turn is connected to the other footwear components. Alternatively, rather than releasable engagements via the noted fasteners, one or more of the fastener sets may be replaced with a sewn seam, an adhesive engagement, or other engaging component structure.

The fastener sets 612L, 612H, 612M, 612B may be arranged to make the resulting loops 602L, 602H, 602M, and 604 of any desired size. Also, while FIGS. 8A and 8B show the exterior sole component 400 engaging straps 610L, 610H, 610M having fasteners on one side (the FIG. 8A side) and the base 610 having its fasteners 612B on the other side (the FIG. 8B side), any arrangement of the fasteners on the strap portions may be utilized.

FIG. 8C further illustrates a lace 108 engaged with the lace-engaging components 730 of the exterior sole component 400. In addition to the lace-engaging components 730 of the exterior sole component 400, this illustrated example article of footwear 100 includes one or more lace-engaging components 740 integrally formed in or engaged with the upper component 200.

Figure 9A:
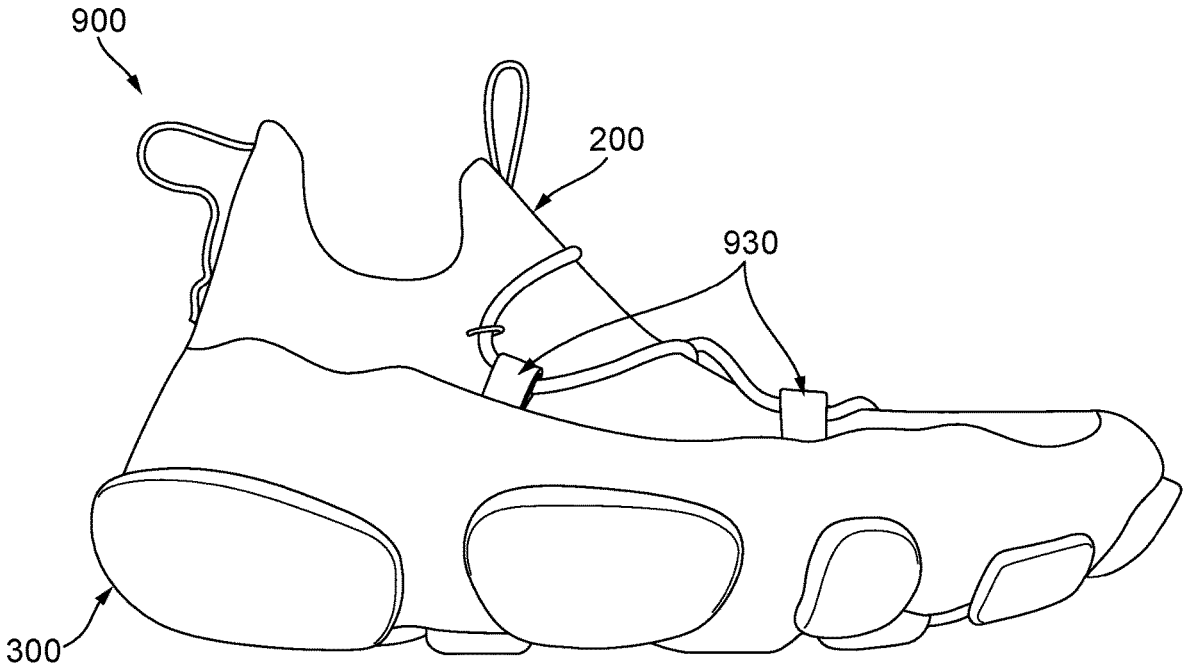
FIGS. 9A-9C illustrate features of additional example articles of footwear in accordance with aspects of this technology.
Figure 9B:
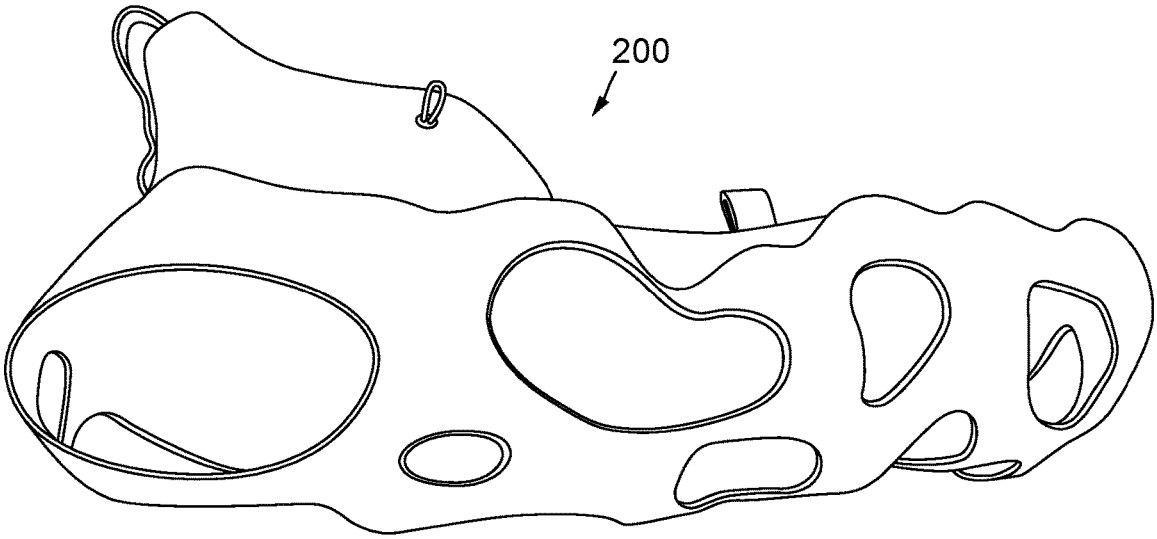
Figure 9C:
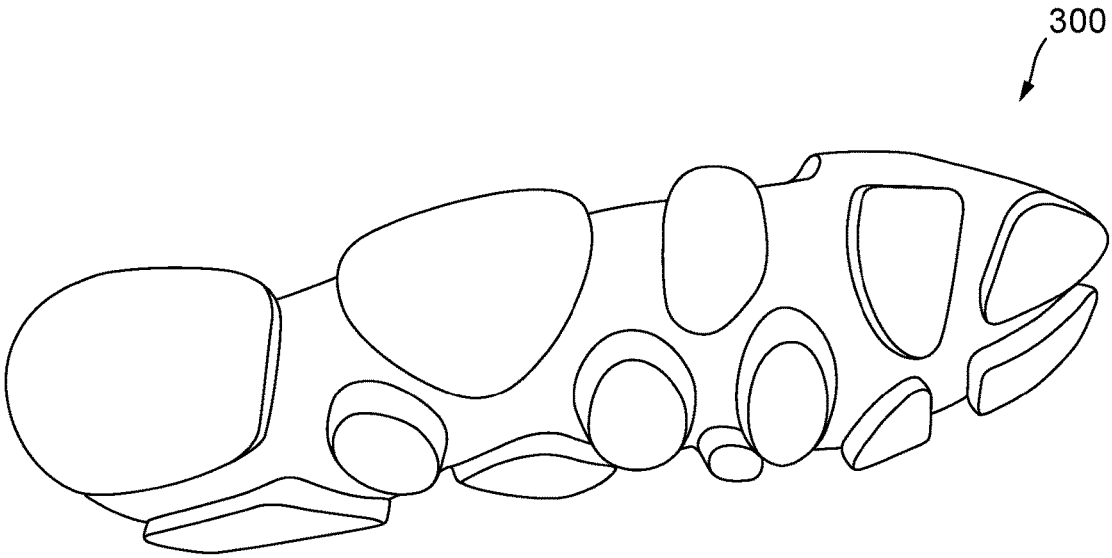

FIGS. 9A-9C illustrate other example articles of footwear 900 and components thereof in accordance with some aspects of this technology. FIG. 9A shows an assembled article of footwear 900, while FIGS. 9B and 9C show example upper components 200 and midsole components 300, respectively. The articles of footwear 900 of FIGS. 9A-9C can have any of the various features or options described above for FIGS. 1A-8C, including, for example, connection of the upper component with the midsole component by connectors 710, a pull tab 600 structure, etc. Where the same reference numbers are used in FIGS. 9A-9C as used in FIGS. 1A-8C, the same or similar parts are being referenced, and much of the repetitive description may be omitted. Those common reference number components, when present in the example structures of FIGS. 9A-9C, may have any of the features, alternatives, and/or options described for those components above with respect to FIGS. 1A-8C.

FIGS. 9A-9C show midsole components 300 having different arrangements of protrusions and upper components 200 having different arrangements of openings. The specific protrusion and/or upper opening arrangements shown in FIGS. 9A-9C may be used in any of the examples described above for FIGS. 1A-8C and/or the specific protrusion and/or upper opening arrangements shown in any of FIGS. 1A-8C may be used in the footwear structures 900 of FIGS. 9A-9C.

One difference of the example footwear structures of FIGS. 9A-9C as compared to the examples of FIGS. 1A-8C relates to the absence of an exterior sole component 400 in the article of footwear 900 structures of FIGS. 9A-9C.

Rather, the bottom and other portions of the upper component 200 and the midsole component 300 are exposed in the example articles of footwear 900 in FIGS. 9A-9C. If needed, the connecting structure 200C of the upper component 200 in FIGS. 9A and 9B may be reinforced and/or formed from a more durable material to prevent excessive wear and/or to prolong useful life.

The upper component 200 of the examples of FIGS. 9A and 9B may have a knit construction, e.g., an engineered knit to provide desired properties at desired locations. Knit structures also may be used for the upper components 200 in the example structures described above for FIGS. 1A-8C. Different lace-engaging structures also are shown in the example of FIG. 9A, i.e., lace-engaging loops 930 provided with the upper component 200.

Also, the specific example midsole components 300 shown in FIGS. 9A and 9C are foam components, e.g., formed from EVA foam, polyurethane foam, and/or other foams known and used in the footwear arts. But, if desired, the articles of footwear 900 of FIGS. 9A-9C may have gas-filled midsole component 300 structures of the types described above and/or the articles of footwear 100 described above in conjunction with FIGS. 1A-8C may have a foam midsole component 300.

As used herein, a "strip" of material (e.g., material of the upper component 200 and/or material of the exterior sole component 400) comprises a piece of material or a portion of a piece of material generally having a greater longitudinal length than width (e.g., having a length dimension at least 2 times its width dimension over some portion of its length). A "strip" of material may have a varying width over its length. Also, a "strip" of material may form just a portion of a larger piece of material. The upper component 200 and exterior sole component 400 illustrated in this application generally show "strips" of material extending into recesses 304 between adjacent protrusions of the midsole component 300 and defining at least portions of the various openings in the upper component 200 and the exterior sole component 400.

As described above, advantageously, in accordance with some aspects of this technology, one or more of the upper component 200, the midsole component 300, and/or the exterior sole component 400 may be formed from a single material and/or as a unitary, one-piece construction. Additionally or alternatively, in at least some examples of this technology: (a) the entire article of footwear 100 may be assembled in an adhesive-free manner; (b) the individual upper component 200, midsole component 300, and/or exterior sole component 400 may be made without using adhesives and in an adhesive-free manner; and/or (c) the components 200, 300, 400, 500, and/or 600, etc. (as well as the other components described herein) may be releasably engaged with one another and/or non-destructibly removable and/or releasable from one another (e.g., the exterior sole component 400 may be releasably engaged with and/or non-destructibly removable from the midsole component 300; the midsole component 300 may be releasably engaged with and/or non-destructibly removable from the upper component 200; the exterior sole component 400 may be releasably engaged with and/or non-destructibly removable from the upper component 200; etc.). One or more of these features, when present: may improve the environmentally "friendliness" of the article of footwear 100; may enhance recyclability of the individual component parts 200, 300, 400; may allow for interchangeability of component parts (e.g., as a "modular" construction used by a manufacturer or by an individual user); and/or may allow for customization to an individual user's needs and/or tastes. Alternatively, some advantageous features of this technology still may be realized with upper components 200, midsole components 300, and/or exterior sole components 400 formed from multiple parts and/or constructed using adhesives and/or other permanent connections. While such modifications may adversely impact the ability to recycle some components and/or the overall structure, a useful article of footwear product still may be produced. Thus, not all aspects of this technology need have improved recyclability and/or improved environmentally friendly features described herein for some aspects of this technology.

III. Conclusion

The present technology is disclosed above and in the accompanying drawings with reference to a variety of embodiments. The purpose served by the disclosure, however, is to provide an example of the various features and concepts related to the technology, not to limit its scope. One skilled in the relevant art will recognize that numerous variations and modifications may be made to the embodiments described above without departing from the scope of the present invention, as defined by the appended claims.

For the avoidance of doubt, the present application includes at least the subject matter described in the following numbered Clauses:

Clause 1. An article of footwear, comprising:

an upper component including a first side defining a first plurality of openings extending through a material of the upper component, the first plurality of openings including: (i) a first opening, (ii) a second opening separated from the first opening by a first strip of upper component material, and (iii) a third opening separated from the second opening by a second strip of upper component material, wherein the upper component at least partially defines an interior chamber configured to receive a wearer's foot;

a midsole component received in the interior chamber of the upper component, the midsole component having a plurality of protrusions including (i) a first protrusion extending through the first opening, (ii) a second protrusion extending through the second opening, and (iii) a third protrusion extending through the third opening, wherein the first strip of upper component material covers a first portion of the midsole component located in a first recess between the first protrusion and the second protrusion, and wherein the second strip of upper component material covers a second portion of the midsole component located in a second recess between the second protrusion and the third protrusion; and an exterior sole component engaged with the midsole component, the exterior sole component including a second plurality of openings extending through a material of the exterior sole component, the second plurality of openings including: (i) a fourth opening, wherein the first protrusion extends through the fourth opening, (ii) a fifth opening separated from the fourth opening by a first strip of exterior sole component material, wherein the second protrusion extends through the fifth opening and the first strip of exterior sole component material at least partially covers the first strip of upper component material, and (iii) a sixth opening separated from the fifth opening by a second strip of exterior sole component material, wherein the third protrusion extends through the sixth opening and the second strip of exterior sole component material at least partially covers the second strip of upper component material.

Clause 2. The article of footwear according to Clause 1, further comprising: an insole component releasably engaged with an upper surface of the midsole component, the insole component including a first projection that extends into a first upper midsole recess defined in the upper surface of the midsole component.

Clause 3. The article of footwear according to Clause 1, further comprising: an insole component releasably engaged with an upper surface of the midsole component, the insole component including a plurality of projections that extend into a corresponding plurality of upper midsole recesses defined in the upper surface of the midsole component.

Clause 4. The article of footwear according to any one of Clauses 1 to 3, wherein the midsole component includes: (a) a first layer having a first outer surface and a first inner surface and (b) a second layer having a second outer surface and a second inner surface, wherein the first layer and the second layer form an interior chamber containing a gas.

Clause 5. The article of footwear according to Clause 4, wherein the midsole component further includes a first interior bond where the first inner surface is fixed to the second inner surface, and wherein the first interior bond is spaced inward from an outer perimeter edge that defines the interior chamber formed by the first layer and the second layer.

Clause 6. The article of footwear according to Clause 5, further comprising a connector component extending through: (a) the upper component, and (b) the midsole component at the first interior bond from the first outer surface to the second outer surface, the connector component connecting the upper component with the midsole component.

Clause 7. The article of footwear according to Clause 4, wherein the midsole component further includes a plurality of interior bonds where the first inner surface is fixed to the second inner surface, wherein the plurality of interior bonds are spaced inward from an outer perimeter edge that defines the interior chamber formed by the first layer and the second layer.

Clause 8. The article of footwear according to Clause 7, further comprising a plurality of connector components extending through: (a) the upper component, and (b) the midsole component at the plurality of interior bonds, the plurality of connector components connecting the upper component with the midsole component.

Clause 9. The article of footwear according to any one of Clauses 1 to 8, wherein the upper component includes a bottom portion that extends across a first portion of a ground-facing surface of the midsole component and forms a portion of a bottom surface of the upper component, and wherein a bottom surface of the exterior sole component covers the bottom portion of the upper component located at the bottom surface of the upper component.

Clause 10. The article of footwear according to any one of Clauses 1 to 9, wherein the first protrusion, the second protrusion, and the third protrusion extend outward at a lateral side of the midsole component.

Clause 11. The article of footwear according to any one of Clauses 1 to 9, wherein the first protrusion, the second protrusion, and the third protrusion extend outward at a medial side of the midsole component.

Clause 12. The article of footwear according to any one of Clauses 1 to 9, wherein the first opening, the second opening, the third opening, the fourth opening, the fifth opening, the sixth opening, the first protrusion, the second protrusion, and the third protrusion are located on a lateral side of the article of footwear, wherein the first plurality of openings of the upper component further includes: (i) a seventh opening, (ii) an eighth opening separated from the seventh opening by a third strip of upper component material, and (iii) a ninth opening separated from the eighth opening by a fourth strip of upper component material, wherein the seventh opening, the eighth opening, and the ninth opening are located on a medial side of the article of footwear, wherein the plurality of protrusions of the midsole component further includes: (i) a fourth protrusion extending through the seventh opening, (ii) a fifth protrusion extending through the eighth opening, and (iii) a sixth protrusion extending through the ninth opening, wherein the third strip of upper component material covers a third portion of the midsole component located in a third recess between the fourth protrusion and the fifth protrusion, and wherein the fourth strip of upper component material covers a fourth portion of the midsole component located in a fourth recess between the fifth protrusion and the sixth protrusion, and wherein the second plurality of openings of the exterior sole component further includes: (i) a tenth opening, wherein the fourth protrusion extends through the tenth opening, (ii) an eleventh opening separated from the tenth opening by a third strip of exterior sole component material, wherein the fifth protrusion extends through the eleventh opening and the third strip of exterior sole component material at least partially covers the third strip of upper component material, and (iii) a twelfth opening separated from the eleventh opening by a fourth strip of exterior sole component material, wherein the sixth protrusion extends through the twelfth opening and the fourth strip of exterior sole component material at least partially covers the fourth strip of upper component material.

Clause 13. The article of footwear according to any one of Clauses 1 to 12, wherein the exterior sole component covers at least 90% of a surface area of a bottom surface of the upper component.

Clause 14. The article of footwear according to any one of Clauses 1 to 13, wherein the upper component further includes a first rear heel opening, wherein the midsole component further includes a rear heel protrusion that extends through the first rear heel opening, and wherein the exterior sole component further includes a second rear heel opening, wherein the rear heel protrusion extends through the second rear heel opening.

Clause 15. The article of footwear according to any one of Clauses 1 to 13, wherein the upper component further includes a first center rear heel opening, wherein the midsole component further includes a center rear heel protrusion that extends through the first center rear heel opening, and wherein the exterior sole component further includes a second center rear heel opening, wherein the center rear heel protrusion extends through the second center rear heel opening.

Clause 16. The article of footwear according to any one of Clauses 1 to 15, wherein the upper component further includes a first lateral side forward toe opening and a first medial side forward toe opening separated from the first lateral side forward toe opening by a first center forward toe band, wherein the midsole component further includes a lateral side forward toe projection extending through the first lateral side forward toe opening and a medial side forward toe projection extending through first medial side forward toe opening, and wherein the exterior sole component further includes a second lateral side forward toe opening and a second medial side forward toe opening separated from the second lateral side forward toe opening by a second center forward toe band, wherein the lateral side forward toe projection extends through the second lateral side forward toe opening, wherein the medial side forward toe projection extends through the second medial side forward toe opening, and wherein the second center forward toe band at least partially covers the first center forward toe band.

Clause 17. The article of footwear according to any one of Clauses 1 to 16, wherein the plurality of protrusions includes a lateral forefoot protrusion and a medial forefoot protrusion, and wherein the exterior sole component does not completely extend around an outer perimeter of the lateral forefoot protrusion or the medial forefoot protrusion.

Clause 18. The article of footwear according to any one of Clauses 1 to 16, wherein the plurality of protrusions includes a lateral forefoot protrusion and a medial forefoot protrusion, and wherein a top edge of the exterior sole component extends along a bottom perimeter edge of the lateral forefoot protrusion and along a bottom perimeter edge of the medial forefoot protrusion.

Clause 19. The article of footwear according to any one of Clauses 1 to 18, wherein the exterior sole component includes at least one lace-engaging element located above the sixth opening.

Clause 20. The article of footwear according to any one of Clauses 1 to 19, wherein the article of footwear is assembled in an adhesive-free manner.

Clause 21. The article of footwear according to any one of Clauses 1 to 20, wherein the upper component is formed from a single material and/or as a unitary, one-piece construction and/or from recycled materials.

Clause 22. The article of footwear according to any one of Clauses 1 to 21, wherein the midsole component is formed from a single material and/or as a unitary, one-piece construction and/or from recycled materials.

Clause 23. The article of footwear according to any one of Clauses 1 to 22, wherein the exterior sole component is formed from a single material and/or as a unitary, one-piece construction and/or from recycled materials.

Clause 24. The article of footwear according to any one of Clauses 1 to 23, wherein the exterior sole component is releasably engaged with the midsole component and/or wherein the midsole component is releasably engaged with the upper component.

Clause 25. An article of footwear, comprising:

an upper component including a first side defining a first plurality of openings extending through a material of the upper component, the first plurality of openings including: (i) a first opening and (ii) a second opening separated from the first opening by a first strip of upper component material, wherein the upper component at least partially defines an interior chamber configured to receive a wearer's foot;

a midsole component received in the interior chamber of the upper component, the midsole component having a plurality of protrusions including (i) a first protrusion extending through the first opening and (ii) a second protrusion extending through the second opening, wherein the first strip of upper component material covers a first portion of the midsole component located in a first recess between the first protrusion and the second protrusion; and an exterior sole component engaged with the midsole component, the exterior sole component including a second plurality of openings extending through a material of the exterior sole component, the second plurality of openings including: (i) a third opening, wherein the first protrusion extends through the third opening and (ii) a fourth opening separated from the third opening by a first strip of exterior sole component material, wherein the second protrusion extends through the fourth opening and the first strip of exterior sole component material at least partially covers the first strip of upper component material.

Clause 26. The article of footwear according to Clause 25, wherein the first opening, the second opening, the third opening, the fourth opening, the first protrusion, and the second protrusion are located on a lateral side of the article of footwear, wherein the first plurality of openings of the upper component further includes: (i) a fifth opening and (ii) a sixth opening separated from the fifth opening by a second strip of upper component material, wherein the fifth opening and the sixth opening are located on a medial side of the article of footwear, wherein the plurality of protrusions of the midsole component further includes: (i) a third protrusion extending through the fifth opening and (ii) a fourth protrusion extending through the sixth opening, wherein the second strip of upper component material covers a second portion of the midsole component located in a second recess between the third protrusion and the fourth protrusion, and wherein the second plurality of openings of the exterior sole component further includes: (i) a seventh opening, wherein the third protrusion extends through the seventh opening and (ii) an eighth opening separated from the seventh opening by a second strip of exterior sole component material, wherein the fourth protrusion extends through the eighth opening and the second strip of exterior sole component material at least partially covers the second strip of upper component material.

Clause 27. The article of footwear according to Clause 25 or 26 having any of the features and/or options described above in Clauses 1 to 24.

Clause 28. An article of footwear, comprising:

an upper component including a first side defining a first plurality of openings extending through a material of the upper component, the first plurality of openings including a first opening and a second opening separated from the first opening by a first strip of upper component material, wherein the upper component at least partially defines an interior chamber configured to receive a wearer's foot;

a midsole component received in the interior chamber of the upper component, the midsole component having a plurality of protrusions including a first protrusion extending through the first opening and a second protrusion extending through the second opening, wherein the first strip of upper component material covers a first portion of the midsole component located in a first recess between the first protrusion and the second protrusion, and wherein a first portion of the upper component extends across and contacts a ground-facing surface of the midsole component; and an exterior sole component engaged with the midsole component, the exterior sole component including a second plurality of openings extending through a material of the exterior sole component, the second plurality of openings including: (i) a third opening, wherein the first protrusion extends through the third opening and (ii) a fourth opening separated from the third opening by a first strip of exterior sole component material, wherein the second protrusion extends through the fourth opening and the first strip of exterior sole component material at least partially covers the first strip of upper component material, and wherein a bottom surface of the exterior sole component covers the first portion of the upper component extending across the ground-facing surface of the midsole component.

Clause 29. The article of footwear according to Clause 28 having any of the features and/or options described above in Clauses 1 to 24.

Clause 30. An article of footwear, comprising:

an upper component including a lateral side, a medial side, and a connecting structure extending from the lateral side to the medial side and forming a bottom surface of the upper component;

a midsole component including: (a) a first layer having a first outer surface and a first inner surface and (b) a second layer having a second outer surface and a second inner surface, wherein the first layer and the second layer form a sealed interior chamber containing a gas, wherein the midsole component includes a first interior bond where the first inner surface is fixed to the second inner surface, and wherein the first interior bond is spaced inward from an outer perimeter edge that defines the sealed interior chamber; and a connector component extending through: (a) the upper component, and (b) the midsole component at the first interior bond from the first outer surface to the second outer surface, the connector component connecting the upper component with the midsole component.

Clause 31. The article of footwear according to Clause 30, wherein the midsole component further includes a plurality of additional interior bonds where the first inner surface is fixed to the second inner surface at locations spaced inward from the outer perimeter edge that defines the sealed interior chamber, and wherein the article of footwear further includes a plurality of additional connector components extending through: (a) the upper component, and (b) the midsole component at the plurality of additional interior bonds.

Clause 32. The article of footwear according to Clause 30 or 31 having any of the features and/or options described above in Clauses 1 to 24.

Clause 33. An article of footwear, comprising:

an upper component including an instep region;

a midsole component having a plurality of protrusions including: (i) a first protrusion, (ii) a second protrusion separated from the first protrusion by a first recess, and (iii) a third protrusion separated from the second protrusion by a second recess; and an exterior sole component engaged with the midsole component, the exterior sole component including: (i) a first hole through which the first protrusion extends, (ii) a second hole through which the third protrusion extends, and (iii) a first continuous sole portion extending through the first recess, beneath the second protrusion, and through the second recess, wherein the exterior sole component does not extend between the second protrusion and the instep region of the upper component.

Clause 34. The article of footwear according to Clause 33, wherein the exterior sole component includes a first lace-engaging component located rearward of the second protrusion and a second lace-engaging component located forward of the second protrusion.

Clause 35. The article of footwear according to Clause 33, wherein the plurality of protrusions of the midsole component further includes: (i) a fourth protrusion, (ii) a fifth protrusion separated from the fourth protrusion by a third recess, and (iii) a sixth protrusion separated from the fifth protrusion by a fourth recess, and wherein the exterior sole component further includes: (i) a third hole through which the fourth protrusion extends, (ii) a fourth hole through which the sixth protrusion extends, and (iii) a second continuous sole portion extending through the third recess, beneath the fifth protrusion, and through the fourth recess, and wherein the exterior sole component does not extend between the fifth protrusion and the instep region of the upper component.

Clause 36. The article of footwear according to Clause 35, wherein the first hole, the second hole, and the first continuous sole portion are located on a lateral side of the article of footwear, and the third hole, the fourth hole, and the second continuous sole portion are located on a medial side of the article of footwear.

Clause 37. The article of footwear according to Clause 35 or 36, wherein the exterior sole component includes: (i) a first lace-engaging component located rearward of the second protrusion, (ii) a second lace-engaging component located forward of the second protrusion, (iii) a third lace-engaging component located rearward of the fifth protrusion, and (iv) a fourth lace-engaging component located forward of the fifth protrusion.

Clause 38. The article of footwear according to any one of Clauses 33 to 37 having any of the features and/or options described above in Clauses 1 to 24.

Clause 39. An article of footwear, comprising:

an upper component including an instep region;

a midsole component having a plurality of protrusions including: (i) a first protrusion and (ii) a second protrusion separated from the first protrusion by a first recess; and an exterior sole component engaged with the midsole component, the exterior sole component including a first continuous perimeter edge that includes: (i) a first top edge portion located above the first protrusion and along the instep region of the upper component, the first top edge portion including a first lace-engaging component, (ii) a first intermediate portion extending through the first recess, along a bottom surface of the second protrusion, and upward forward of a forward edge of the second protrusion, and (iii) a second top edge portion extending to a forward toe region of the upper component, the second top edge portion including a second lace-engaging component.

Clause 40. The article of footwear according to Clause 39, wherein the midsole component further includes: (i) a third protrusion and (ii) a fourth protrusion separated from the third protrusion by a second recess, and wherein the exterior sole component further includes a second continuous perimeter edge that includes: (i) a third top edge portion located above the third protrusion and along the instep region of the upper component, the third top edge portion including a third lace-engaging component, (ii) a second intermediate portion extending through the second recess, along a bottom surface of the fourth protrusion, and upward forward of a forward edge of the fourth protrusion, and (iii) a fourth top edge portion extending to the forward toe region of the upper component, the fourth top edge portion including a fourth lace-engaging component.

Clause 41. The article of footwear according to Clause 40, wherein the second top edge portion and the fourth top edge portion meet at the forward toe region of the upper component.

Clause 42. The article of footwear according to any one of Clauses 39 to 41 having any of the features and/or options described above in Clauses 1 to 24.

Clause 43. The article of footwear according to any one of Clauses 1 to 42, wherein the exterior sole component includes a first heel opening and a second heel opening defined therein, and wherein the article of footwear further comprises a pull tab engaged with the first heel opening and the second heel opening.

Clause 44. The article of footwear according to Clause 43, wherein the pull tab includes a first strap portion extending through the first heel opening, a second strap portion extending through the second heel opening, and a base portion from which the first strap portion and the second strap portion extend.

Clause 45. The article of footwear according to Clause 44, wherein the base portion forms a first loop.

Clause 46. The article of footwear according to Clause 44, wherein the base portion forms a first loop, the first strap portion forms a second loop that extends through the first heel opening, and the second strap portion forms a third loop that extends through the second heel opening.

Clause 47. The article of footwear according to Clause 46, wherein each of the second loop and the third loop is releasably engaged with the exterior sole component.

Clause 48. The article of footwear according to Clause 43, wherein the exterior sole component includes a third heel opening located between the first heel opening and the second heel opening, and wherein the pull tab is engaged with the third heel opening.

Clause 49. The article of footwear according to Clause 48, wherein the pull tab includes a first strap portion extending through the first heel opening, a second strap portion extending through the second heel opening, a third strap portion extending through the third heel opening, and a base portion from which the first strap portion, the second strap portion, and the third strap portion extend.

Clause 50. The article of footwear according to Clause 49, wherein the base portion forms a first loop.

Clause 51. The article of footwear according to Clause 49, wherein the base portion forms a first loop, the first strap portion forms a second loop that extends through the first heel opening, the second strap portion forms a third loop that extends through the second heel opening, and the third strap portion forms a fourth loop that extends through the third heel opening.

Clause 52. The article of footwear according to Clause 51, wherein each of the second loop, the third loop, and the fourth loop is releasably engaged with the exterior sole component.

What is claimed is:

1. An article of footwear, comprising:

an upper component including a first side defining a first plurality of openings extending through a material of the upper component, the first plurality of openings including: (i) a first opening and (ii) a second opening separated from the first opening by a first strip of upper component material, wherein the upper component at least partially defines an interior chamber configured to receive a wearer's foot;

a midsole component received in the interior chamber of the upper component, the midsole component having a plurality of protrusions including (i) a first protrusion extending through the first opening and (ii) a second protrusion extending through the second opening, wherein the first strip of upper component material covers a first portion of the midsole component located in a first recess between the first protrusion and the second protrusion, wherein the midsole component further includes: (a) a first layer having a first outer surface and a first inner surface and (b) a second layer having a second outer surface and a second inner surface, wherein the first layer and the second layer form an interior chamber containing a gas, wherein the midsole component further includes a first interior bond where the first inner surface is fixed to the second inner surface, and wherein the first interior bond is spaced inward from an outer perimeter edge that defines the interior chamber formed by the first layer and the second layer;

a first connector component extending through: (a) the upper component and (b) the midsole component at the first interior bond from the first outer surface to the second outer surface, the first connector component connecting the upper component with the midsole component; and an exterior sole component engaged with the midsole component, the exterior sole component including a second plurality of openings extending through a material of the exterior sole component, the second plurality of openings including: (i) a third opening, wherein the first protrusion extends through the third opening and (ii) a fourth opening separated from the third opening by a first strip of exterior sole component material, wherein the second protrusion extends through the fourth opening, and wherein the first strip of exterior sole component material at least partially covers the first strip of upper component material.

2. The article of footwear according to claim 1, wherein the first opening, the second opening, the third opening, the fourth opening, the first protrusion, and the second protrusion are located on a lateral side of the article of footwear, wherein the first plurality of openings of the upper component further includes: (i) a fifth opening and (ii) a sixth opening separated from the fifth opening by a second strip of upper component material, wherein the fifth opening and the sixth opening are located on a medial side of the article of footwear, wherein the plurality of protrusions of the midsole component further includes: (i) a third protrusion extending through the fifth opening and (ii) a fourth protrusion extending through the sixth opening, wherein the second strip of upper component material covers a second portion of the midsole component located in a second recess between the third protrusion and the fourth protrusion, and wherein the second plurality of openings of the exterior sole component further includes: (i) a seventh opening, wherein the third protrusion extends through the seventh opening and (ii) an eighth opening separated from the seventh opening by a second strip of exterior sole component material, wherein the fourth protrusion extends through the eighth opening, and wherein the second strip of exterior sole component material at least partially covers the second strip of upper component material.

3. The article of footwear according to claim 1, further comprising:

an insole component releasably engaged with an upper surface of the midsole component, the insole component including a plurality of projections that extend into a corresponding plurality of upper midsole recesses defined in the upper surface of the midsole component.

4. The article of footwear according to claim 1, wherein the first interior bond is one of a plurality of interior bonds where the first inner surface is fixed to the second inner surface, wherein the plurality of interior bonds are spaced inward from the outer perimeter edge, and wherein the first connector component is one of a plurality of connector components, the plurality of connector components extending through: (a) the upper component and (b) the midsole component at the plurality of interior bonds, and the plurality of connector components connecting the upper component with the midsole component.

5. The article of footwear according to claim 1, wherein the upper component includes a bottom portion that extends across a first portion of a ground-facing surface of the midsole component and forms a portion of a bottom surface of the upper component, and wherein a bottom surface of the exterior sole component covers the bottom portion of the upper component located at the bottom surface of the upper component.

6. The article of footwear according to claim 1, wherein the first protrusion and the second protrusion extend outward at one of a lateral side or a medial side of the midsole component.

7. The article of footwear according to claim 1, wherein the upper component further includes a first rear heel opening, wherein the midsole component further includes a rear heel protrusion that extends through the first rear heel opening, and wherein the exterior sole component further includes a second rear heel opening, wherein the rear heel protrusion extends through the second rear heel opening.

8. The article of footwear according to claim 1, wherein the upper component further includes a first center rear heel opening, wherein the midsole component further includes a center rear heel protrusion that extends through the first center rear heel opening, and wherein the exterior sole component further includes a second center rear heel opening, wherein the center rear heel protrusion extends through the second center rear heel opening.

9. The article of footwear according to claim 1, wherein the upper component further includes a first lateral side forward toe opening and a first medial side forward toe opening separated from the first lateral side forward toe opening by a first center forward toe band, wherein the midsole component further includes a lateral side forward toe projection extending through the first lateral side forward toe opening and a medial side forward toe projection extending through first medial side forward toe opening, and wherein the exterior sole component further includes a second lateral side forward toe opening and a second medial side forward toe opening separated from the second lateral side forward toe opening by a second center forward toe band, wherein the lateral side forward toe projection extends through the second lateral side forward toe opening, wherein the medial side forward toe projection extends through the second medial side forward toe opening, and wherein the second center forward toe band at least partially covers the first center forward toe band.

10. The article of footwear according to claim 1, wherein the plurality of protrusions includes a lateral forefoot protrusion and a medial forefoot protrusion, and wherein the exterior sole component does not completely extend around an outer perimeter of the lateral forefoot protrusion or the medial forefoot protrusion.

11. The article of footwear according to claim 1, wherein the plurality of protrusions includes a lateral forefoot protrusion and a medial forefoot protrusion, and wherein a top edge of the exterior sole component extends along a bottom perimeter edge of the lateral forefoot protrusion and along a bottom perimeter edge of the medial forefoot protrusion.

12. The article of footwear according to claim 1, wherein the article of footwear is assembled in an adhesive-free manner.

13. The article of footwear according to claim 1, wherein one or more of the upper component, the midsole component, and the exterior sole component is formed from a single material and/or as a unitary, one-piece construction and/or from recycled materials.

14. The article of footwear according to claim 1, wherein the exterior sole component is releasably engaged with the midsole component and/or wherein the midsole component is releasably engaged with the upper component.

15. An article of footwear, comprising:

an upper component including a first side defining a first plurality of openings extending through a material of the upper component, the first plurality of openings including: (i) a first opening, (ii) a second opening separated from the first opening by a first strip of upper component material, and (iii) a third opening separated from the second opening by a second strip of upper component material, wherein the upper component at least partially defines an interior chamber configured to receive a wearer's foot;

a midsole component received in the interior chamber of the upper component, the midsole component having a plurality of protrusions including (i) a first protrusion extending through the first opening, (ii) a second protrusion extending through the second opening, and (iii) a third protrusion extending through the third opening, wherein the first strip of upper component material covers a first portion of the midsole component located in a first recess between the first protrusion and the second protrusion, and wherein the second strip of upper component material covers a second portion of the midsole component located in a second recess between the second protrusion and the third protrusion, wherein the midsole component further includes: (a) a first layer having a first outer surface and a first inner surface and (b) a second layer having a second outer surface and a second inner surface, wherein the first layer and the second layer form an interior chamber containing a gas, wherein the midsole component further includes a first interior bond where the first inner surface is fixed to the second inner surface, and wherein the first interior bond is spaced inward from an outer perimeter edge that defines the interior chamber formed by the first layer and the second layer;

a first connector component extending through: (a) the upper component and (b) the midsole component at the first interior bond from the first outer surface to the second outer surface, the first connector component connecting the upper component with the midsole component; and an exterior sole component engaged with the midsole component, the exterior sole component including a second plurality of openings extending through a material of the exterior sole component, the second plurality of openings including: (i) a fourth opening, wherein the first protrusion extends through the fourth opening, (ii) a fifth opening separated from the fourth opening by a first strip of exterior sole component material, wherein the second protrusion extends through the fifth opening, and wherein the first strip of exterior sole component material at least partially covers the first strip of upper component material, and (iii) a sixth opening separated from the fifth opening by a second strip of exterior sole component material, wherein the third protrusion extends through the sixth opening, and wherein the second strip of exterior sole component material at least partially covers the second strip of upper component material.

16. The article of footwear according to claim 15, wherein the first protrusion, the second protrusion, and the third protrusion extend outward at one of a lateral side or a medial side of the midsole component.

17. The article of footwear according to claim 15, wherein the first opening, the second opening, the third opening, the fourth opening, the fifth opening, the sixth opening, the first protrusion, the second protrusion, and the third protrusion are located on a lateral side of the article of footwear, wherein the first plurality of openings of the upper component further includes: (i) a seventh opening, (ii) an eighth opening separated from the seventh opening by a third strip of upper component material, and (iii) a ninth opening separated from the eighth opening by a fourth strip of upper component material, wherein the seventh opening, the eighth opening, and the ninth opening are located on a medial side of the article of footwear, wherein the plurality of protrusions of the midsole component further includes: (i) a fourth protrusion extending through the seventh opening, (ii) a fifth protrusion extending through the eighth opening, and (iii) a sixth protrusion extending through the ninth opening, wherein the third strip of upper component material covers a third portion of the midsole component located in a third recess between the fourth protrusion and the fifth protrusion, and wherein the fourth strip of upper component material covers a fourth portion of the midsole component located in a fourth recess between the fifth protrusion and the sixth protrusion, and wherein the second plurality of openings of the exterior sole component further includes: (i) a tenth opening, wherein the fourth protrusion extends through the tenth opening, (ii) an eleventh opening separated from the tenth opening by a third strip of exterior sole component material, wherein the fifth protrusion extends through the eleventh opening, and wherein the third strip of exterior sole component material at least partially covers the third strip of upper component material, and (iii) a twelfth opening separated from the eleventh opening by a fourth strip of exterior sole component material, wherein the sixth protrusion extends through the twelfth opening, and wherein the fourth strip of exterior sole component material at least partially covers the fourth strip of upper component material.

18. The article of footwear according to claim 15, wherein the exterior sole component includes at least one lace-engaging element located above the sixth opening.

19. An article of footwear, comprising:

an upper component including a first side defining a first plurality of openings extending through a material of the upper component, the first plurality of openings including a first opening and a second opening separated from the first opening by a first strip of upper component material, wherein the upper component at least partially defines an interior chamber configured to receive a wearer's foot;

a midsole component received in the interior chamber of the upper component, the midsole component having a plurality of protrusions including a first protrusion extending through the first opening and a second protrusion extending through the second opening, wherein the first strip of upper component material covers a first portion of the midsole component located in a first recess between the first protrusion and the second protrusion, and wherein a first portion of the upper component extends across and contacts a ground-facing surface of the midsole component, wherein the midsole component further includes: (a) a first layer having a first outer surface and a first inner surface and (b) a second layer having a second outer surface and a second inner surface, wherein the first layer and the second layer form an interior chamber containing a gas, wherein the midsole component further includes a first interior bond where the first inner surface is fixed to the second inner surface, and wherein the first interior bond is spaced inward from an outer perimeter edge that defines the interior chamber formed by the first layer and the second layer;

a first connector component extending through: (a) the upper component and (b) the midsole component at the first interior bond from the first outer surface to the second outer surface, the first connector component connecting the upper component with the midsole component; and an exterior sole component engaged with the midsole component, the exterior sole component including a second plurality of openings extending through a material of the exterior sole component, the second plurality of openings including: (i) a third opening, wherein the first protrusion extends through the third opening and (ii) a fourth opening separated from the third opening by a first strip of exterior sole component material, wherein the second protrusion extends through the fourth opening, wherein the first strip of exterior sole component material at least partially covers the first strip of upper component material, and wherein a bottom surface of the exterior sole component covers the first portion of the upper component extending across the ground-facing surface of the midsole component.

20. The article of footwear according to claim 19, wherein the first interior bond is one of a plurality of interior bonds where the first inner surface is fixed to the second inner surface, wherein the plurality of interior bonds are spaced inward from the outer perimeter edge, and wherein the first connector component is one of a plurality of connector components, the plurality of connector components extending through: (a) the upper component and (b) the midsole component at the plurality of interior bonds, and the plurality of connector components connecting the upper component with the midsole component.

* * * * *